US009047813B2

(12) United States Patent
Minami et al.

(10) Patent No.: US 9,047,813 B2
(45) Date of Patent: Jun. 2, 2015

(54) PIXEL CIRCUIT, DISPLAY DEVICE, ELECTRONIC APPARATUS, AND METHOD OF DRIVING PIXEL CIRCUIT

(75) Inventors: Tetsuo Minami, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 224 days.

(21) Appl. No.: 13/523,486

(22) Filed: Jun. 14, 2012

(65) Prior Publication Data

US 2012/0327058 A1 Dec. 27, 2012

(30) Foreign Application Priority Data

Jun. 22, 2011 (JP) ..... 2011-138255

(51) Int. Cl.
*G09G 3/30* (2006.01)
*G09G 3/32* (2006.01)

(52) U.S. Cl.
CPC ..... *G09G 3/3225* (2013.01); *G09G 3/3208* (2013.01); *G09G 2320/043* (2013.01); *G09G 3/3233* (2013.01); *G09G 3/3258* (2013.01); *G09G 2300/0852* (2013.01); *G09G 2310/0251* (2013.01); *G09G 2320/0223* (2013.01); *G09G 2320/045* (2013.01)

(58) Field of Classification Search
CPC ..... G09G 3/3225; G09G 3/3233; G09G 2320/043; G09G 2320/045; G09G 2320/0233
See application file for complete search history.

(56) References Cited

U.S. PATENT DOCUMENTS

| | | | | |
|---|---|---|---|---|
| 7,545,348 | B2 * | 6/2009 | Tseng et al. | 345/76 |
| 8,405,584 | B2 * | 3/2013 | Chen | 345/82 |
| 2007/0052647 | A1 * | 3/2007 | Chen | 345/92 |
| 2009/0079679 | A1 * | 3/2009 | Nam | 345/82 |
| 2011/0273419 | A1 * | 11/2011 | Park et al. | 345/211 |

FOREIGN PATENT DOCUMENTS

| | | |
|---|---|---|
| JP | 4240059 | 1/2009 |
| JP | 4240068 A | 1/2009 |

OTHER PUBLICATIONS

Chou et al., "Dual-Gate IGZO TFT for Threshold-Voltage Compensation in AMOLED Pixel Circuit", SID 2012 Digest, p. 768-770.*

* cited by examiner

*Primary Examiner* — Quan-Zhen Wang
*Assistant Examiner* — Xuemei Zheng
(74) *Attorney, Agent, or Firm* — Fishman Stewart Yamaguchi PLLC

(57) ABSTRACT

Disclosed herein is a pixel circuit, including: a display portion; a drive transistor driving the display portion; and a characteristics controlling portion configured to control characteristics of the drive transistor.

6 Claims, 19 Drawing Sheets

EXAMPLE OF DISPLAY NONUNIFORMITY DUE TO CATHODE RESISTANCE

INFLUENCE EXERTED ON CATHODE ELECTRIC POTENTIAL DUE TO DIFFERENCE IN CATHODE RESISTANCE BETWEEN PERIPHERAL PORTION AND CENTRAL PORTION

EXPLANATION OF SOURCE OF LUMINANCE CHANGE DUE TO CHANGE IN CATHODE ELECTRIC POTENTIAL

PIXEL CIRCUIT, DISPLAY DEVICE, ELECTRONIC APPARATUS, AND METHOD OF DRIVING PIXEL CIRCUIT

BACKGROUND

The present disclosed technology relates to a pixel circuit, a display device including the pixel circuit, an electronic apparatus including the display device, and a method of driving the pixel circuit.

At present, a display device including a pixel circuit (referred to as "a pixel" as well) having a display element (referred to as "an electrooptic element" as well), and an electronic apparatus including the display device are generally utilized. There is known a display device which uses an electrooptic element in which a luminance is changed depending on a voltage applied thereto or a current caused to flow therethrough as a display element in a pixel. For example, the electrooptic element in which the luminance is changed depending on the voltage applied thereto is typified by a liquid crystal display element. On the other hand, the electrooptic element in which the luminance is changed depending on the current caused to flow therethrough is typified by an Organic Electro Luminescence element (Organic EL element or Organic Light Emitting Diode (OLED)) (hereinafter referred to as "an organic EL element"). An organic EL display device using the latter organic EL element is a so-called self-emission type display device using the electrooptic element, as a self-emission element, as the display element in the pixel.

Now, in the display device using the display element, both of a passive matrix system and an active matrix system can be adopted as a system for driving the display device. However, the display device utilizing the passive matrix system involves a problem that it may be difficult to realize the large and fine-definition display device although a structure is simple.

For this reason, in recent years, the active matrix system for controlling a pixel signal supplied to a display element which is provided inside a pixel by using a transistor such as an active element which is also provided inside the pixel, for example, an insulated gate field-effect transistor (in general, a Thin Film Transistor (TFT)) as a switching transistor has been actively developed. This technique, for example, is described in Japanese Patent Nos. 4240059 and 4240068.

SUMMARY

However, it was found out that as far as the display element concerned, a luminance change (display nonuniformity in terms of the display device) due to a resistance component between a reference electric potential point and the display element is caused in some cases. It is noted that the luminance change due to the resistance component between the reference electric potential point and the display element may be caused in the passive matrix system as well as in the active matrix system.

The present disclosure has been made in order to solve the problems described above, and it is therefore desirable to provide a pixel circuit which is capable of suppressing a luminance change due to a resistance component between a reference electric potential point and a display element, a display device including the pixel circuit, an electronic apparatus including the display device, and a method of driving the pixel circuit.

In order to attain the desire described above, according to an embodiment of the present disclosure, there is provided a pixel circuit including: a display portion; a drive transistor configured to drive the display portion; and a characteristics controlling portion controlling characteristics of the drive transistor.

According to another embodiment of the present disclosure, there is provided a display device including: a pixel portion in which display elements each including a display portion and a drive transistor driving the display portion are arranged; and a characteristics controlling portion configured to control characteristics of the drive transistor.

According to still another embodiment of the present disclosure, there is provided an electronic apparatus including: a pixel portion in which display elements each including a display portion and a drive transistor driving the display portion are arranged; a signal generating portion configured to generate a video signal which is to be supplied to the pixel portion; and a characteristics controlling portion controlling characteristics of the drive transistor.

According to yet another embodiment of the present disclosure, there is provided a method of driving a pixel circuit including a drive transistor driving a display portion including: controlling characteristics of the drive transistor.

In short, since with the technique disclosed in this specification, the characteristics of the drive transistor are controlled, it is possible to adjust the drive current in the display portion. Even when the levels of the video signals supplied are equal to one another, the drive current in the display portion is adjusted by controlling the characteristics of the drive transistor. As a result, it is possible to adjust the luminance. Also, this technique can be utilized to suppress the luminance change due to the resistance component between the reference electric potential point and the display element.

As set forth hereinabove, according to the present disclosure, it is possible to suppress the luminance change due to the resistance component between the reference electric potential point and the display element by controlling the characteristics of the drive transistor.

DETAILED DESCRIPTION OF THE PREFERRED EMBODIMENTS

Figure 1:
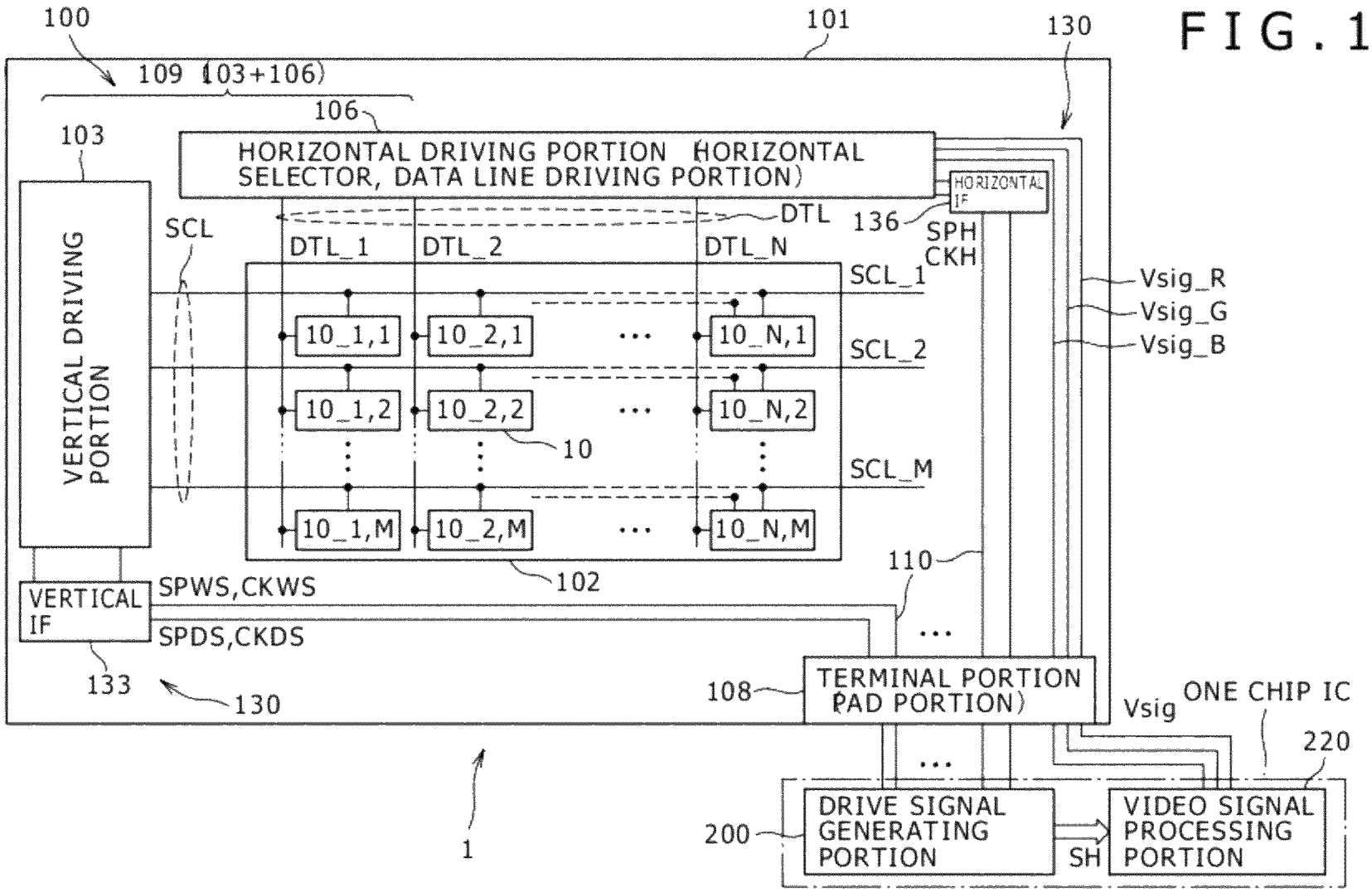
FIG. 1 is a block diagram showing a schematic configuration of an active matrix type display device as a display device according to a first embodiment of the present disclosure.

Embodiments of the present disclosure will be described in detail hereinafter with reference to the accompanying drawings. When functional elements are distinguished from one another with respect to forms, the functional elements are distinguished by adding thereto the alphabet or "_n" (n: numerical character), or suffixes of a combination thereof. On the other hand, when the functional elements are described without necessity for being especially distinguished from one another, such suffixes are omitted for the description. This is also applied to the accompanying drawings.

It is noted that the description will be given below in accordance with the following order:

1. Whole Outline;
2. Outline of Display Device;
   - 2-1. Display Device (First Embodiment)
   - 2-2. Light Emitting Element: Pixel Circuit (Second Embodiment)
   - 2-3. Method of Driving Light Emitting Element: Basis (Third Embodiment)
   - 3. Electronic Apparatus (Fourth Embodiment);
4. Concrete Examples;
   - 4-1. Example 1: Scanning Type
   - 4-2. Example 2: Connection between Back-gate and Cathode
   - 4-3. Example 3: Example 2+Voltage Correction
   - 4-4. Example 4: Example 1+Voltage Monitoring
5. Examples of Application; and
   - 5-1. Example 1 of Application
   - 5-2. Example 2 of Application
   - 5-3. Example 3 of Application
   - 5-4. Example 4 of Application
   - 5-5. Example 5 of Application
6. Constitutions of the Present Disclosure.

1. Whole Outline

Firstly, basic points will be described hereinafter.

In a configuration of any of embodiments of the present disclosure, a pixel circuit, a display device, or an electronic apparatus includes a display portion, a drive transistor for driving the display portion, and a characteristics controlling portion configured to control characteristics of the drive transistor.

Preferably, it is only necessary that the characteristics controlling portion controls the characteristics of the drive transistor in accordance with an electric potential at one end on a side opposite to the drive transistor of the display portion on a circuit. In a word, the display on the display portion is carried out in accordance with a drive current supplied from the drive transistor. In this case, the electric potential at the one end on the side opposite to the drive transistor of the display portion is influenced by a resistance component between a reference electric potential point and the one end to be changed. The wording "the electric potential at one end on the side opposite to the drive transistor" means the electric potential at the one end on the side opposite to the drive transistor on an electric circuit diagram. However, when viewed from a positional relationship on a device, the electric potential concerned is not the electric potential on the side of the drive transistor of the display portion, but corresponds to the electric potential on the side opposite to the drive transistor. The characteristics controlling portion controls the characteristics of the drive transistor in accordance with a change in the electric potential, whereby it is possible to more reliably suppress the luminance change due to the resistance component between the reference electric potential point and the one end.

Preferably, it is only necessary that a transistor having a characteristics control terminal capable of controlling a threshold voltage is used as the drive transistor. In this case, the characteristics controlling portion supplies a control signal in accordance with which the threshold voltage is controlled to the characteristics control terminal.

A Metal Oxide Semiconductor Field-Effect Transistor (MOSFET), or a back-gate type thin film transistor, for example, is preferably used as the transistor having the characteristics control terminal capable of controlling the threshold voltage. In particular, it is better to use the MOSFET. On the other hand, when the back-gate type thin film transistor is used, the characteristics controlling portion can be composed of a terminal through which a back-gate electric potential is controlled. Or, in any case, the characteristics controlling portion can control the back-gate electric potential.

When the transistor having the characteristics control terminal capable of controlling the threshold voltage is used as the drive transistor, the characteristics controlling portion can adopt a configuration in which one end of the display portion and the back-gate of the drive transistor are connected to each other.

As far as the device configuration concerned, one pixel circuit (display portion) may be provided, or a pixel portion may also be provided in which the display portions are disposed in a line or in a two-dimensional matrix. In the case of the configuration including the pixel portion, preferably, it is only necessary that the characteristics controlling portion controls the characteristics of the drive transistor every display portion.

When the pixel portion has the configuration of including the display portions disposed in a two-dimensional matrix, it is only necessary that the characteristics controlling portion controls the characteristics of the drive transistor every display element through scanning processing. By the way, when the characteristics controlling portion carries out the control every display element, it is only necessary that wells of the respective drive transistors are individually separated from one another. When the light emission control is carried out in a line sequential manner, it is only necessary that the well electric potentials (transistor characteristics control signals) are separated from one another every row (or every column), and for the wells of the drive transistors, it is not excluded to separate the wells of the drive transistors every display element, but the wells of the drive transistors are separated from one another at least every row (or every column).

A light emitting element (display element) including a self-emission type light emitting portion such as an organic electro luminescence light emitting portion, an inorganic electro luminescence light emitting portion, an LED light emitting portion or a semiconductor laser light emitting portion, for example, can be used as the display portion. In particular, it is only necessary to use the organic electro luminescence light emitting portion as the display portion.

2. Outline of Display Device

In the following description, for facilitating understanding of a correspondence relationship, a resistance value, a capacitance (electrostatic capacitance), and the like of members composing a circuit are designated by the same reference symbols as those added to these members, respectively.

[Basis]

Firstly, a description will be given with respect to an outline of a display device including a light emitting element. In a description of a circuit configuration which will be described below, the wording "electrically connected" is simply described as "connected." Also, the wording "electrically connected" is by no means limited to the wording "directly connected," and thus includes the wording "connected" through any other suitable transistor (typified by a switching transistor) or any other suitable electric element (which may be a passive element in addition to an active element).

The display device includes plural pixel circuits (or simply referred to as "a pixel" in some cases). Each of the pixel circuits includes a display element (eloectrooptic element) having a display portion, and a driving circuit for driving the display portion. A light emitting element including a self-emission type light emitting portion such as an organic electro luminescence light emitting portion, an inorganic electro luminescence light emitting portion, an LED light emitting portion or a semiconductor laser light emitting portion, for example, can be used as the display portion. It is noted that although a constant current drive type is adopted as a system for driving the light emitting portion of the display element, in principle, the system concerned is by no means limited to the constant current drive type, and thus may also adopt a constant voltage drive type.

In the case which will be described below, a description will be given with respect to the case of the display device including an organic electro luminescence light emitting portion as the light emitting element. More specifically, the light emitting element is the organic electro luminescence light emitting element (organic EL element) having a structure in which the driving circuit, and the organic electro luminescence light emitting portion (ELP: light emitting portion) connected to the driving circuit are laminated on top of each other.

Although various kinds of circuits are known as the driving circuit for driving the light emitting portion ELP, the pixel circuit can adopt a configuration of including a drive circuit of a 5Tr/1C type, a 4Tr/1C type, a 3Tr/1C type, a 2Tr/1C type or the like. Here, a in a term of "$\alpha$Tr/1C type" means the number of transistors, and "1C" means that a capacitance portion includes one hold capacitor $C_{CS}$ (capacitor). Although preferably, all of the transistors composing the driving circuit are suitably composed of n-channel transistors, the present disclosure is by no means limited thereto, and thus a part of the transistors composing the driving circuit may also be composed of a P-channel transistor(s) in some cases. It is noted that it is also possible to adopt a structure in which the transistors are formed on a semiconductor substrate or the like. A structure of each of the transistors composing the driving circuit is especially by no means limited, and it is possible to use an insulated gate field-effect transistor (in general, a Thin Film Transistor (TFT)) typified by a MOSFET. In addition thereto, each of the transistors composing the driving circuit may be any of an enhance type or a depletion type, or may also be any of a single-gate type or a dual-gate type.

In any of the structures described above, basically, the display device includes a light emitting portion ELP, a drive transistor $TR_D$, a write transistor $TR_W$ (referred to as "a sampling transistor" as well), a vertical scanning portion including at least a write scanning portion, a horizontal scanning portion having a function of a signal outputting portion, and a hold capacitor $C_{CS}$ as minimum constituent elements similarly to the case of the 2Tr/1C type drive configuration. Preferably, in order to configure a bootstrap circuit, the hold capacitor $C_{CS}$ is connected between a control input terminal (gate terminal) of the drive transistor $TR_D$, and one (typically, a source electrode terminal) of main electrode terminals (source and drain regions). In the drive transistor $TR_D$, one of the main electrode terminals thereof is connected to the light emitting portion ELP, and the other of the main electrode terminals thereof is connected to a power source line PWL. A power source voltage (either a steady voltage or a pulse-like voltage) is supplied from a power source circuit, a scanning circuit for the power source voltage or the like to the power source line PWL.

The horizontal driving portion supplies a video signal $V_{sig}$ used to control a luminance in the light emitting portion ELP or a broad video signal VS representing a reference electric potential(s) (not necessarily corresponds (correspond) to one kind) used for threshold voltage correction or the like to a video signal line DTL (referred to as "a data line" as well). In the write transistor $TR_W$, one of main electrode terminals thereof is connected to the video signal line DTL, and the other of the main electrode terminals thereof is connected to the control input terminal of the drive transistor $TR_D$. The write scanning portion supplies a control pulse (a write drive pulse WS) in accordance with which the write transistor $TR_W$ is controlled so as to be turned ON or OFF to the control input terminal of the write transistor $TR_W$ through a write scanning line WSL. A connection point among the other of the main electrode terminals of the write transistor $TR_W$, the control input terminal of the drive transistor $TR_D$, and one terminal of the hold capacitor $C_{CS}$ is referred to as "a first node $ND_1$." Also, a connection point between one of the main electrode terminals of the drive transistor $TR_D$, and the other terminal of the hold capacitor $C_{CS}$ is referred to as "a second node $ND_2$."

2-1. Display Device (First Embodiment)

[Configuration]

Figure 2:
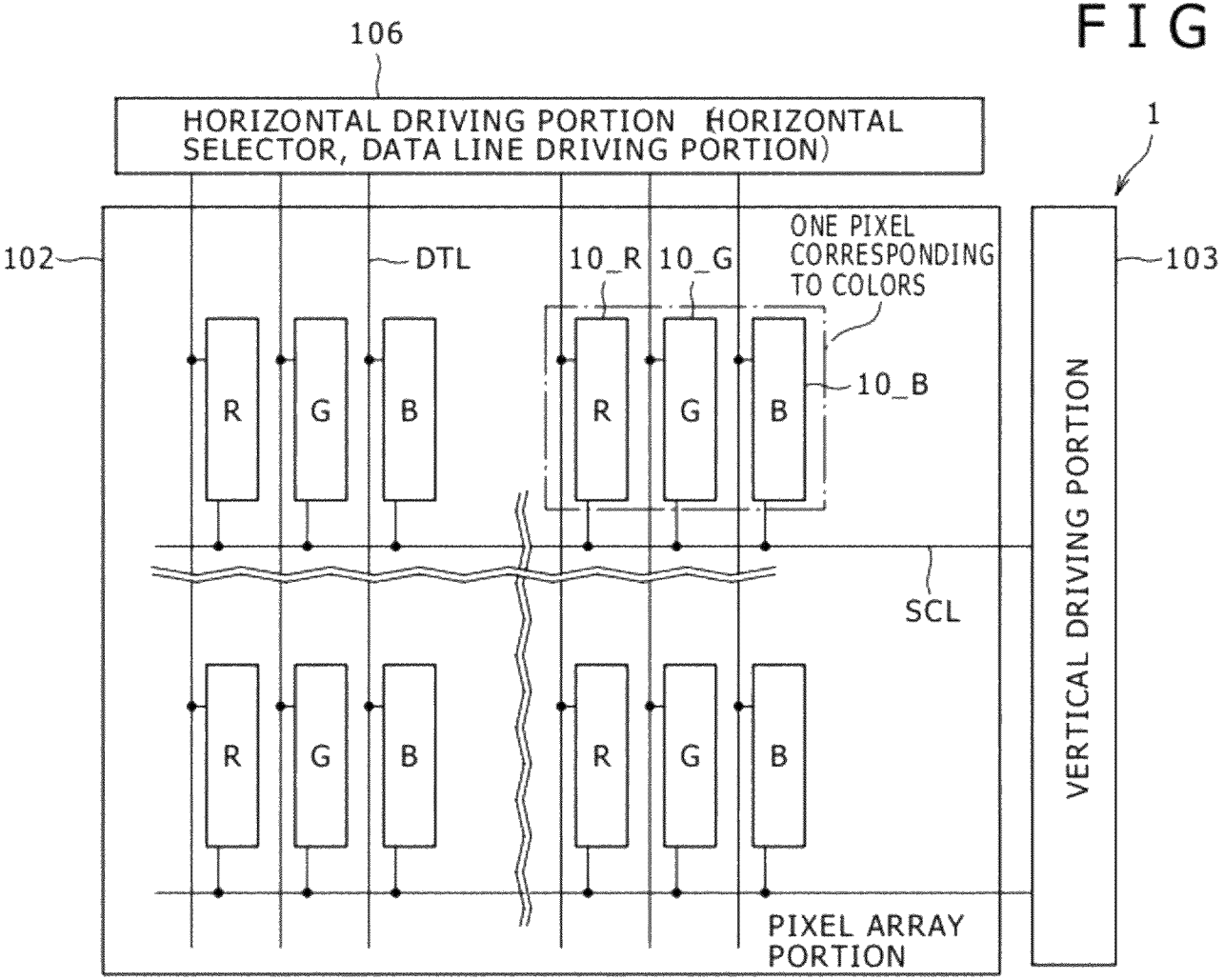
FIG. 2 is a block diagram showing a schematic configuration of an active matrix type display device compatible with color image display as a display device according to a modified change of the first embodiment of the present disclosure.

FIGS. 1 and 2 are respectively block diagrams showing schematic configurations of an active matrix type display device according to a first embodiment of the present disclosure, and a modified change of the first embodiment of the present disclosure. Specifically, FIG. 1 is a block diagram showing a schematic configuration of the general active matrix type display device as the display device according to the first embodiment of the present disclosure. Also, FIG. 2 is a block diagram showing a schematic configuration of the active matrix type display device compatible with color image display according to the modified change of the first embodiment of the present disclosure.

As shown in FIG. 1, the display device 1 includes a display panel block 100, a drive signal generating portion (so-called timing generator) 200, and a video signal processing portion 220. In this case, pixel circuits 10 (referred to as "pixels" as well) including organic EL elements (not shown) as plural display elements, respectively, are disposed so as to compose an effective image area at a horizontal to vertical ratio as an aspect ratio of X:Y (for example, 9:16) in the display panel block 100. Also, the drive signal generating portion 200 as an example of a panel control portion generates various kinds of pulse signals in accordance with which the display panel block 100 is driven and controlled. Both of the drive signal generating portion 200 and the video signal processing portion 220 are built in one-chip Integrated Circuit (IC), and are disposed outside the display panel block 100 in this case.

It is noted that a product form is by no means limited to the case where the display device is provided as the display device 1 having a module (composite components or parts) form including all of the display panel block 100, the drive signal generating portion 200, and the video signal processing portion 220 as shown in FIG. 1. For example, only the display panel block 100 may be provided as the display device 1. In addition, the display device 1 includes a display device as well having a module shape having a structure of being encapsulated. For example, a display module which is formed in such a way that a counter portion such as a transparent glass is stuck to the pixel array portion 102 corresponds to such a display device. A color filter, a protective film, a light blocking film, and the like may be provided on the transparent counter portion. The display module may also be provided with a circuit portion, a Flexible Printed Circuit (FPC) board or the like for input/output of a video signal $V_{sig}$ and various kinds of drive pulses from the outside to the pixel array portion 102.

Such a display device 1 can be utilized in display portions, of various kinds of electronic apparatuses in all of the fields, in each of which a video signal inputted to the electronic apparatus, or a video signal generated in the electronic apparatus is displayed in the form of either a still image or a moving image (video image). In this case, the various kinds of electronic apparatuses, for example, include a portable type music player utilizing a recording medium such as a semiconductor memory, a mini-disc (MD) or a cassette tape, a digital camera, a notebook-size personal computer, mobile terminal equipment such as a mobile phone, a video camera, and the like.

In the display panel block 100, a pixel array portion 102, a vertical driving portion 103, a horizontal driving portion 106 (referred to as "a horizontal selector or a data line driving portion" as well), an interface unit 130 (IF), a terminal portion 108 (pad portion) for connection to the outside, and the like are formed integrally with one another on a substrate 101. In this case, pixel circuits 10 are disposed in a matrix of M in row×N in column in the pixel array portion 102. The vertical driving portion 103 scans the pixel circuits 10 in a vertical direction. The horizontal driving portion 106 scans the pixel circuits 10 in a horizontal direction. Also, the driving portions (the vertical driving portion 103 and the horizontal driving portion 106) and an external circuit interface with each other through the interface unit 130 (IF). That is to say, a configuration is adopted such that peripheral driving circuits such as the vertical driving portion 103, the horizontal driving portion 106, and the interface unit 130 are formed on the same substrate 101 as that of the pixel array portion 102. The light emitting element (the pixel circuit 10) which is located in an m-th row (m=1, 2, 3, . . . , M) and in an n-th column (n=1, 2, 3, . . . , N) is designated by reference symbols 10_*n, m* in FIG. 1.

The interface unit 130 includes a vertical IF portion 133 and a horizontal IF portion 136. In this case, the vertical driving portion 103 and the external circuit interface with each other through the vertical IF portion 133. Also, the horizontal driving portion 106 and the external circuit interface with each other through the horizontal IF portion 136.

The vertical driving portion 103 and the horizontal driving portion 106 compose a control unit 109 for controlling an operation for writing a signal electric potential to the hold capacitor, a threshold voltage correcting operation, a mobility correcting operation, and a bootstrap operation. A drive control circuit for controlling an operation for driving the pixel circuits 10 of the pixel array portion 102 is composed, including the control unit 109 and the interface unit 130 (including the vertical IF portion 133 and the horizontal IF portion 136).

When the 2Tr/1C type drive configuration is adopted, the vertical driving portion 103 includes a write scanning portion (a write scanner WS; Write Scan), and a drive scanning portion (a drive scanner DS; Drive Scan) which functions as a power source scanner having a power source supplying ability. The pixel array portion 102, as an example, is driven from either one side or both sides of a horizontal direction shown in the figure by the vertical driving portion 103. Also, the pixel array portion 102 is driven from either one side or both sides of a vertical direction shown in the figure by the horizontal driving portion 106.

Various kinds of pulse signals are supplied from the drive signal generating portion 200 disposed outside the display device 1 to the terminal portion 108. Likewise, the video signal $V_{sig}$ is supplied from the video signal processing portion 220 to the terminal portion 108. In the case of the display device 1 compatible with the color display, a video signal $V_{sig_R}$, a video signal $V_{sig_G}$, and a video signal $V_{sig_B}$ corresponding to the colors (the three primary colors: Red (R); Green (G); and Blue (B) in this case), respectively, are supplied from the video signal processing portion 220 to the terminal portion 108.

As an example, necessary pulse signals such as shift start pulses SP (two kinds of shift start pulses SPDS and SPWS are shown in the figure) and vertical scanning clocks CK (two kinds of vertical scanning clocks CKDS and CKWS are shown in the figure) as an example of scanning start pulses in the vertical direction, vertical scanning clocks xCK (two kinds of vertical scanning clocks xCKDS and xCKWS are shown in the figure) which are obtained through phase inversion as may be necessary, and an enable pulse used to instruct to output a pulse at a specific timing are supplied as pulse signals for vertical driving to the terminal portion 108. In addition, necessary pulse signals such as a horizontal start pulse SPH and a horizontal scanning clock CKH as an example of scanning start pules in the horizontal direction, a horizontal scanning clock xCKH which is obtained through the phase inversion as may be necessary, and an enable pulse used to instruct to output a pulse at a specific timing are supplied as pulse signals for horizontal driving to the terminal portion 108.

Terminals of the terminal portion 108 are connected to the vertical driving portion 103 and the horizontal driving portion 106 through wirings 110. For example, after the pulses supplied to the terminal portion 108 have been internally adjusted in voltage levels thereof in a level shifter portion (not shown) as may be necessary, the resulting pulses are supplied to the portions of the vertical driving portion 103, and the horizontal driving portion 106 through a buffer.

Although an illustration is omitted here (details will be described later), the pixel array portion 102 is configured in such a way that the pixel circuits 10 provided with the pixel transistors for the organic EL elements as the display elements are two-dimensionally disposed in a matrix, the vertical scanning lines SCL are wired so as to correspond to the rows for the pixel disposition, respectively, and the video signal lines DTL are wired so as to correspond to the columns for the pixel disposition, respectively. In a word, the pixel circuits 10 are connected to the vertical driving portion 103 through the vertical scanning lines SCL, and are also connected to the horizontal driving portion 106 through the video signal lines DTL. Specifically, for the pixel circuits 10 disposed in a matrix, the vertical scanning lines SCL_1 to SCL_m for m rows which are driven in accordance with the drive pulses by the vertical driving portion 103 are wired so as to correspond to the pixel rows, respectively. The vertical driving portion 103 is composed of a combination of logic gates (including a latch, a shift register, and the like as well), and selects the pixel circuits 10 of the pixel array portion 102 in rows. That is to say, the vertical driving portion 103 successively selects the pixel circuits 10 through the vertical scanning lines SCL in accordance with the pulse signals of the vertical drive system supplied from the drive signal generating portion 200. The horizontal driving portion 106 is composed of a combination of logic gates (including a latch, a shift register, and the like as well), and selects the pixel circuits 10 of the pixel array portion 102 in columns. That is to say, the horizontal driving portion 106 samples a predetermined electric potential (for example, a video signal $V_{sig}$ level) within the video signal VS through the video signal lines DTL for the pixel circuits 10 thus selected and writes the predetermined electric potential thus sampled to each of the hold capacitors $C_{CS}$ in accordance with the pulse signals of the horizontal drive system supplied from the drive signal generating portion 200.

The organic EL display device 1 of the first embodiment can carry out line-sequential drive or point-sequential drive. Thus, both of the write scanning portion 104 and drive scanning portion 105 (see FIG. 4) of the vertical driving portion 103 scan the pixel array portion 102 in the line-sequential manner (in a word, in rows), and the horizontal driving portion 106 either simultaneously writes the video signals for one horizontal line (in the case of the line-sequential) or writes the video signals in pixels (in the case of the point-sequential) to the pixel array portion 102 synchronously with the scanning operation.

For the purpose of making a response to the color image display, for example, as shown in FIG. 2, a pixel circuit 10$_{_R}$, a pixel circuit 10$_{_G}$, and a pixel circuit 10$_{_B}$ are provided as sub-pixels corresponding to colors (the three primary colors: Red (R); Green (G); and Blue (B) in this case), respectively, in a longitudinal stripe in a predetermined disposition order in the pixel array portion 102. One pixel compatible with the color image display is composed of one set of sub-pixels corresponding to the colors, respectively. Although in this case, a layout having the stripe structure in which the sub-pixels corresponding to the colors, respectively, are disposed in the longitudinal stripe is shown as an example of a layout of the sub-pixels, the layout of the sub-pixels is by no means limited to such a disposition example. For example, a form may also be adopted in which the sub-pixels are shifted in a vertical direction.

Note that, referring to FIGS. 1 and 2, a configuration is adopted in which the vertical driving portion 103 (specifically, the constituent elements thereof) is disposed on only one side of the pixel array portion 102. However, it is possible to adopt a configuration in which the constituent elements of the vertical driving portion 103 are disposed on the right-hand and left-hand sides, respectively, so as to sandwich the pixel array portion 102 between them. In addition, it is also possible to adopt a configuration in which ones and the others of the constituent elements of the vertical driving portions 103 are disposed on the right-hand and left-hand sides, respectively, separately from each other. Likewise, referring to FIGS. 1 and 2, a configuration is shown in which the horizontal driving portion 106 is disposed on only one side of the pixel array portion 102. However, it is also possible to adopt a configuration in which the horizontal driving portion 106 are disposed on upper and lower sides, respectively, so as to sandwich the pixel array portion 102. In this case, a configuration is adopted in which the pulse signals such as the vertical shift start pulse, the vertical scanning clock pulse, the horizontal start pulse, and the horizontal scanning clock are all inputted from the outside of the display panel block 100. However, the drive signal generating portion 200 for generating these various timing pulses can also be mounted on the display panel block 100.

The configuration shown in the figure is merely one form of the display device, and thus any other suitable form can be adopted in terms of a product form. That is to say, for the display device, all it takes is that the entire display device is configured so as to include the pixel array portion in which the elements composing the pixel circuits 10 are disposed in a matrix, the control unit disposed at the peripheral part of the pixel array portion and having the scanning portion connected to the scanning lines for driving of the pixels as the main portion, the drive signal generating portion configured to generate the various kinds of signals in accordance with which the control unit is operated, and the video signal processing portion. In terms of the product form, in addition to the form as shown in the figure in which the display panel block in which the pixel array portion and the control unit are mounted on the same substrate (for example, a glass substrate), and the drive signal generating portion and the video signal processing portion are provided separately from each other (referred to as "an on-panel-disposition configuration"), it is also possible to adopt a form in which the pixel array portion is mounted on the display panel block, and the peripheral circuits such as the control unit, the drive signal generating portion, and the video signal processing portion are mounted on a board (for example, a flexible board) separate from that substrate of the display panel block (referred to as "a peripheral circuit panel-outside-disposition configuration"). In addition, in the case of the on-panel-disposition configuration in which the display panel block is configured by mounting both of the pixel array portion and the control unit on the same substrate, it is also possible to adopt a form in which the transistors for the control unit (and also the drive signal generating portion and the video signal processing portion as may be necessary) are simultaneously formed in a process for forming the TFTs of the pixel array portion (referred to as "a transistor integration configuration"), and a form in which a semiconductor chip for the control unit (and also the drive signal generating portion and the video signal processing portion as may be necessary) is directly mounted on the substrate on which the pixel array portion is mounted by utilizing a Chip On Glass (COG) mounting technique (referred to as "a COG mounting configuration"). Or, only the display panel block (including at least the pixel array portion) can be provided as a display device.

In the first embodiment of the present disclosure, the display device 1 includes a characteristics controlling portion (not shown) configured to control characteristics of a drive transistor $TR_D$ (not shown) in accordance with a change in an electric potential on the side opposite to the drive transistor $TR_D$. Therefore, it is possible to more reliably suppress a luminance change due to the resistance component between the reference electric potential point and the display element by controlling the characteristics of the drive transistor $TR_D$.

2-2. Light Emitting Element: Pixel Circuit (Second Embodiment)

Figure 3A:
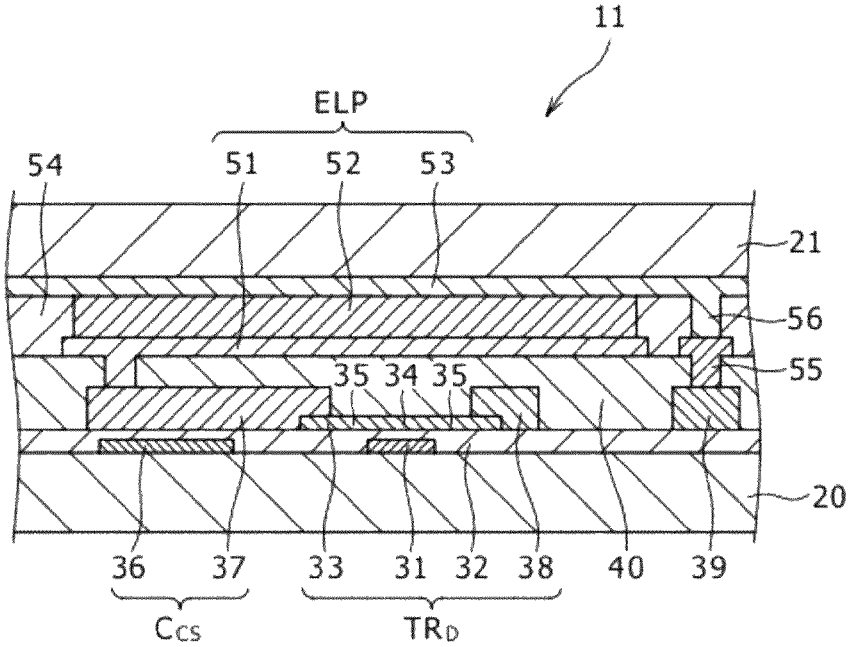
FIGS. 3A and 3B are respective partial cross sectional views each showing a structure of a light emitting element (substantially, a pixel circuit) according to a second embodiment of the present disclosure.
Figure 3B:
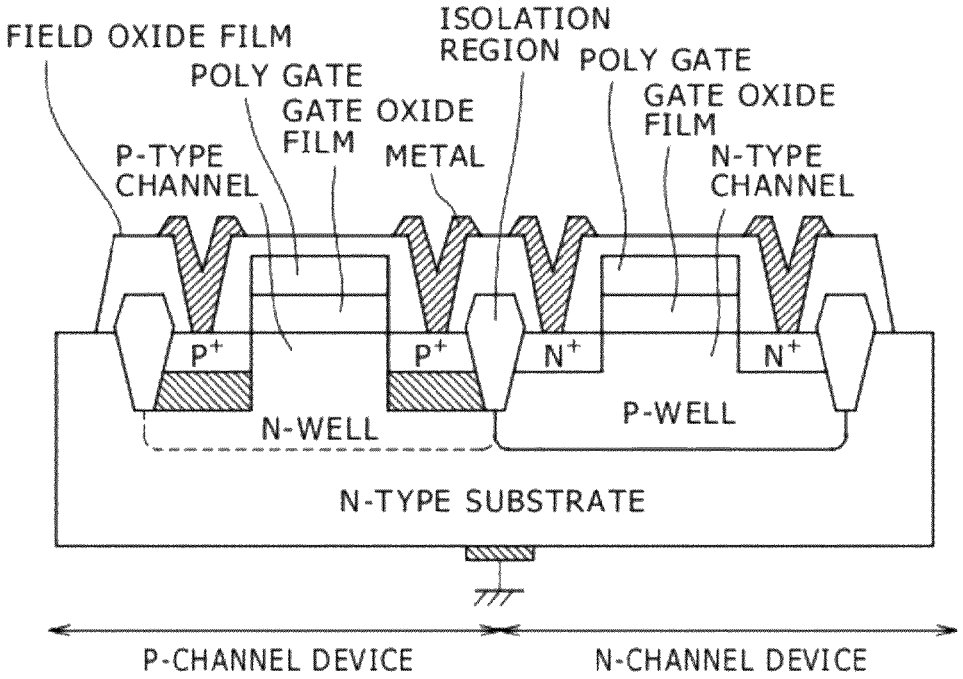

FIGS. 3A and 3B are respectively partial cross sectional views each explaining a structure of a light emitting element 11 (substantially, the pixel circuit 10) including a driving circuit. Here, FIG. 3A is a schematic partial cross sectional view of a part of the light emitting element 11 (the pixel circuit 10). FIG. 3B is a partial cross sectional view showing a structure of a MOS transistor. Referring to FIG. 3A, an insulated gate field-effect transistor is supposed to be a Thin Film Transistor (TFT). As will be described in Examples to be described, however, in the second embodiment, with regard to at least the drive transistor $TR_D$, it is preferable to use either a so-called back-gate type thin film transistor or the MOS transistor as shown in FIG. 3B. In particular, it is preferable to use the MOS transistor as shown in FIG. 3B. The reason for this is because when the thin film transistor adopts the back-gate type structure, the manufacturing processes become complicated (or the manufacture is difficult), whereas in the case of the MOS transistor as shown in FIG. 3B, a semiconductor substrate or a well originally functions as a back-gate (referred to as "a bulk" as well).

As shown in FIG. 3A, transistors and a capacitance portion (a hold capacitor $C_{CS}$) composing the driving circuit for the light emitting element 11 are formed on a supporting body 20. Also, a light emitting portion ELP, for example, is formed above the transistors and the hold capacitor $C_{CS}$ composing the drive circuit through an interlayer insulating layer 40. One of source and drain regions of a drive transistor $TR_D$ is connected to an anode electrode included in the light emitting portion ELP through a contact hole. In FIG. 3A, only the drive transistor $TR_D$ is illustrated. A write transistor $TR_W$ and other transistors stay in hiding and are invisible. The light emitting portion ELP, for example, has the well-known constitution and structure of including an anode electrode, a hole transport layer, a light emitting layer, an electron transport layer, a cathode electrode, and the like.

Specifically, the drive transistor $TR_D$ is composed of a gate electrode 31, a gate insulating layer 32, a semiconductor layer 33, source and drain regions 35 provided in the semiconductor layer 33, and a channel formation region 34 to which a portion of the semiconductor layer 33 between the source and drain regions 35 corresponds. The hold capacitor $C_{CS}$ is composed of the other electrode 36, a dielectric layer composed of an extension portion of the gate insulating layer 32, and one electrode 37 (corresponding to a second node $ND_2$). The gate electrode 31, a part of the gate insulating layer 32, and the other electrode 36 composing the hold capacitor $C_{CS}$ are all formed on the supporting body 20. One of the source and drain regions 35 of the drive transistor $TR_D$ is connected to a wiring 38, and the other of the source and drain regions 35 of the drive transistor $TR_D$ is connected to one electrode 37. The drive transistor $TR_D$, the hold capacitor $C_{CS}$, and the like are all covered with an interlayer insulating layer 40. Also, the light emitting portion ELP composed of the anode electrode 51, the hole transport layer, the light emitting layer, the electron transport layer, and the cathode electrode 53 is provided on the interlayer insulating layer 40. In FIG. 3A, the hole transport layer, the light emitting layer, and the electron transport layer are illustrated as one layer 52. A second interlayer insulating layer 54 is provided on a portion of the interlayer insulating layer 40 on which no light emitting portion ELP is provided. Also, a transparent substrate 21 is disposed on the second interlayer insulating layer 54 and the cathode electrode 53. Thus, a light emitted from the light emitting layer is transmitted through the substrate 21 to be emitted to the outside. One electrode 37 and the anode electrode 51 are connected to each other through a contact hole provided in the interlayer insulating layer 40. The cathode electrode 53 is connected to a wiring 39 provided on the extension portion of the gate insulating layer 32 through a contact hole 56 and a contact hole 55 which are provided in the second interlayer insulating layer 54 and the interlayer insulating layer 40, respectively.

When in the structure shown in FIG. 3A, the TFT is supposed to be the MOS transistor, as shown in FIG. 3B, a gate (having a narrow region channel) is formed on a surface of a semiconductor substrate of a first conductivity type (either a P-type or an N-type (the N-type in FIG. 3B), and a gate terminal is formed so as to cover the channel through an oxide film (especially, referred to as "a gate oxide film"). Poly silicon, for example, can be used as a material of the gate terminal and is especially referred to as "a poly gate." In addition, after an oxide film (especially referred to as "a field oxide film") has been deposited so as to cover the whole N-type semiconductor substrate, including the gate terminal, terminals (a source terminal and a drain terminal) each made of a metallic material of a source region and a drain region each of which is of a second conductivity type (the P-type in this case) different from the first conductivity type are formed on both sides of the gate terminal. As a result, the MOS transistor of the second conductivity type (the P-type in this case) (PMOS) (P-channel device) is formed on a surface layer of the semiconductor substrate of the first conductivity type (N-type). In the P-channel device having this structure, the back-gate is the N-type substrate and is not individually separated from one another, and thus it may be impossible to supply a control signal individually or every row (or every column) in a state of being separated from one another. Thus, it is possible to supply the control signal common to all of the P-channel devices of the pixel array portion 102. In order that the MOS transistor of the first conductivity type (the N-type in this case) (NMOS) (N-channel device) may be formed on the surface layer of the semiconductor substrate of the first conductivity type (N-type), it is only necessary that a well of the second conductivity type (P-type) is formed on the surface layer of the semiconductor substrate of the first conductivity type (N-type), and the resulting well (P-type well) is treated as the semiconductor substrate of the second conductivity type (P-type), and similarly, a gate region, a source region, a drain region, and the like are then formed. In the N-channel device having this structure, since the well of the second conductivity type (P-type) can be separated individually or every row (or every column), a well electric potential (a transistor characteristics control signal Vb) can be separated individually or every row (or every column). It is noted that in forming the MOS transistor (PMOS) (P-channel device) of the second conductivity type (the P-type in this case) on the surface layer of the semiconductor substrate, a well of the first conductivity type (N-type) may be formed on the surface of the semiconductor substrate of the first conductivity type (N-type) (indicated by a broken line in FIG. 3B), and the resulting well (N-type well) may be treated as the semiconductor substrate of the first conductivity type (N-type) and similarly, a gate region, a source region, a drain region, and the like may be then formed. By adopting such a structure, in the P-channel device having this structure, since the well of the first conductivity type (N-type) can be separated individually or every row (or every column), the well electric potential (the transistor characteristics control signal Vb) can be separated individually or every row (or every column). The P-channel device (PMOS) and the N-channel device (NMOS) are insulated from each other through an element isolation region.

In the second embodiment of the present disclosure, the pixel circuit 10 includes the characteristics controlling portion (not shown) configured to control the characteristics of the drive transistor $TR_D$ in accordance with the change in the electric potential on the side opposite to the drive transistor $TR_D$. Therefore, it is possible to more reliably suppress a luminance change due to the resistance component between the reference electric potential point and the display element by controlling the characteristics of the drive transistor $TR_D$.

2-3. Method of Driving Pixel Circuit: Basis (Third Embodiment)

A method of driving the light emitting portion (pixel circuit) will be described hereinafter. The method of driving the light emitting portion is substantially a method of driving the display device 1 according to the first embodiment of the present disclosure. For facilitating understanding, the description is given on the assumption that each of the transistors composing the pixel circuit 10 is composed of an n-channel transistor. In addition, it is supposed that an anode terminal of the light emitting portion ELP is connected to a second node $ND_2$, and a cathode terminal thereof is connected to a cathode wiring cath (an electric potential thereof is supposed to be a cathode electric potential $V_{cath}$). In addition, a light emission state (luminance) in the light emitting portion ELP is controlled in accordance with a magnitude of a value of a drain current $I_{ds}$. In the light emission state in the light emitting element, of the two main electrode terminals (source and drain regions) of the drive transistor $TR_D$, one main electrode terminal (an anode side of the light emitting portion ELP) acts as a source terminal (source region), and the other main electrode terminal acts as a drain terminal (drain region). Then, it is supposed that the display device is a display device compatible with the color image display, and is composed of the pixel circuits 10 which are disposed in a two-dimensional matrix of (N/3)×M. Also, it is supposed that one pixel circuit composing one unit of the color image display is composed of three sub-pixel circuits: a red color light emitting pixel circuit $\mathbf{10}_{_R}$ for emitting a red color light; a green color light emitting pixel circuit $\mathbf{10}_{_G}$ for emitting a green color light; and a blue color light emitting pixel circuit $\mathbf{10}_{_B}$ for emitting a blue color light. Also, it is supposed that the light emitting elements composing each of the pixel circuits 10 are driven in the line-sequential manner, and a display frame rate is FR (time/second). That is to say, the light emitting elements composing (N/3) pixel circuits 10 disposed in a m-th row (m=1, 2, 3, . . . , M), more specifically, N pixel circuits 10 are driven at the same time. In other words, in the light emitting elements composing one row, a timing of an emission/non-emission thereof is controlled in increments of a row to which these light emitting elements belong. It is noted that processing for writing the video signals to the pixel circuits 10 composing one row, respectively, either may be processing for simultaneously writing the video signals to all of the pixel circuits 10, respectively (referred to as "simultaneous write processing" as well), or may be processing for successively writing the video signal every pixel circuit 10 (referred to "successive write processing" as well). It is only necessary to suitably select which of two types of processing is adopted depending on the configuration of the drive circuit.

Here, a description will be given with respect to a driving operation for the pixel element (the pixel circuit 10) located in an m-th row and in an n-th column (n=1, 2, 3, . . . N). By the way, the light emitting element located in the m-th row and in the n-th column is referred to as either the (n, m)-th light emitting element or the (n, m)-th light emitting pixel circuit. Various kinds of processing (such as threshold voltage correcting processing, write processing, and mobility correcting processing) are executed until end of a horizontal scanning period (an m-th horizontal scanning period) for the light emitting elements disposed in the m-th row. It is noted that the write processing and the mobility correcting processing need to be executed within the m-th horizontal scanning period. On the other hand, the threshold voltage correcting processing and preprocessing following the threshold voltage correcting processing can be executed prior to the m-th horizontal scanning period depending on the kind of the drive circuit.

After end of all of the various kinds of processing, the light emitting portions composing the light emitting elements disposed in the m-th row are caused to emit lights, respectively. It is noted that after end of all of the various kinds of processing, the light emitting portions may be immediately caused to emit the lights, respectively, or the light emitting portions may be caused to emit the lights, respectively, after a lapse of a predetermined period of time (for example, the horizontal scanning period for the predetermined number of rows). It is only necessary to suitably set "a predetermined period of time" depending on the specification of the display device, the configuration of the pixel circuit 10 (in a word, the drive circuit), and the like. In the following description, for the sake of convenience of the description, it is supposed that after end of all of the various kinds of processing, the light emitting portions are immediately caused to emit the lights, respectively. The light emission of the light emitting portions composing the light emitting elements disposed in the m-th row is continuously carried out until right before of start of the horizontal scanning period for the light emitting elements disposed in an (m+m')-th row. "m'" may be determined depending on the design and specification of the display device. That is to say, the light emission of the light emitting portions composing the light emitting elements disposed in the m-th row of a certain display frame is continuously carried out until an (m+m'−1)-th horizontal scanning period. On the other hand, as a rule, the light emitting portions composing the light emitting elements disposed in the m-th row maintain a non-light emission state from start of an (m+m')-th horizontal scanning period until end of the write processing and the mobility correcting processing within the m-th horizontal scanning period in a next display frame. The provision of the period for the non-light emission state (referred to as "non-light emission period" as well) results in that the residual image blurring following the active matrix driving is reduced, and thus the moving image quality can be more satisfactory. However, the light emission state/non-light emission state of each of the pixel circuits 10 (light emitting elements) is by no means limited to the state which has been described so far. A time length of the horizontal scanning period is a time length shorter than (1/FR)×(1/M) seconds. When a value of (m+m') exceeds M, the horizontal scanning period for a value exceeding the value of (m+m') is processed in a next display frame.

The wording "the transistor is held in an ON state (in a conduction state)" means a state in which the channel is formed between the main electrode terminals (the source and drain regions), and it is no object whether or not a current is caused to flow from one main electrode terminal to the other main electrode terminal. On the other hand, the wording "the transistor is held in an OFF state (in a non-conduction state)" means that no channel is formed between the main electrode terminals. The wording "a main electrode terminal of a certain transistor is connected to a main electrode terminal of another transistor" implies a form in which a source/drain region of a certain transistor, and a source/drain region of another transistor occupy the same region. In addition thereto, the source/drain region can be not only made of a conductive material such as poly silicon or amorphous silicon containing therein an impurity, but also composed of a layer made of a metal, an alloy, a conductive particle, a lamination structure thereof, or a layer made of an organic material (conductive polymer). In a timing chart used in the following description, a length (time length) of an axis of abscissa representing each of periods of time is merely schematic, and thus does not represent a rate of time lengths of the periods of time.

A method of driving the pixel circuit 10 includes a preprocessing process, a threshold voltage correcting processing process, a video signal writing processing process, a mobility correcting process, and a light emission process. The preprocessing process, the threshold voltage correcting processing process, the video signal writing processing process, and the mobility correcting process are collectively referred to as "a non-light emission process" as well. The video signal writing processing and the mobility correcting process are executed at the same time depending on the configuration of the pixel circuit 10 in some cases. Hereinafter, these processes will be outlined.

In this connection, in the light emission state of the light emitting element, the drive transistor $TR_D$ is driven so as to cause a drain current $I_{ds}$ to flow in accordance with Expression (1):

$$I_{ds}=k\times\mu\times(V_{gs}-V_{th})^2 \quad (1)$$

where μ is an effective mobility, $V_{gs}$ is an electric potential difference (gate-to-source voltage) between an electric potential (a gate electric potential $V_g$) at a control electrode terminal and an electric potential (a source electric potential $V_S$) at a source terminal, $V_{th}$ is a threshold voltage, and k is a coefficient. In this case, the constant k is given by Expression (2):

$$k=(1/2)\times(W/L)\times C_{OX} \quad (2)$$

where W is a channel width, L is a channel length, and $C_{OX}$ ((a relative permittivity of a gate insulating layer)×(a permittivity of a vacuum)/(a thickness of the gate insulating layer)) is an equivalent capacitance. In addition, the drain current $I_{ds}$ is caused to flow through the light emitting portion ELP, whereby the light emitting portion ELP emits a light. Moreover, the light emission state (luminance) in the light emitting portion ELP is controlled in accordance with the magnitude of a value of the drain current $I_{ds}$. In the light emission state of the light emitting element, of two main electrode terminals (source and drain regions) of the drive transistor $TR_D$, one main electrode terminal (an anode terminal side of the light emitting portion ELP) acts as a source terminal (source region), and the other main electrode terminal acts as a drain terminal (drain region). For the sake of convenience of the description, in the following description, one main electrode terminal of the drive transistor $TR_D$ is simply referred to as "a source terminal" and the other main electrode terminal is simply referred to as "a drain terminal" in some cases.

In the following description, unless otherwise stated, it is supposed that an electrostatic capacitance $C_{el}$ of a parasitic capacitance of the light emitting portion ELP is a sufficiently larger value than that of each of an electrostatic capacitance $C_{CS}$ of a hold capacitor $C_{CS}$, and an electrostatic capacitance $C_{gs}$ between a gate electrode terminal and a source electrode terminal as an example of a parasitic capacitance of the drive transistor $TR_D$. Thus, a change in the electric potential (the source electric potential $V_s$) of the source region (the second node $ND_2$) of the drive transistor $TR_D$ based on a change in the electric potential (the gate electric potential $V_g$) at the gate terminal of the drive transistor $TR_D$ is not taken into consideration.

[Preprocessing Process]

A first node initialization voltage ($V_{ofs}$) is applied to the first node $ND_2$, and a second node initialization voltage ($V_{ini}$) is applied to the second node $ND_2$ in such a way that a difference in electric potential between the first node $ND_2$ and the second node $ND_2$ exceeds the threshold voltage $V_{th}$ of the drive transistor $TR_D$, and a difference in electric potential between the second node $ND_2$ and the cathode electrode included in the light emitting portion ELP does not exceed a threshold voltage $V_{thEL}$ of the light emitting portion ELP. For example, the video signal $V_{sig}$ in accordance with which the luminance of the light emitting portion ELP is controlled is set to the range of 0 to 10 V, a power source voltage $V_{cc}$ is set to 20 V, the threshold voltage $V_{th}$ of the drive transistor $TR_D$ is set to 3 V, a cathode electric potential $V_{cath}$ is set to 0 V, and the threshold voltage $V_{thEL}$ of the light emitting portion ELP is set to 3 V. In this case, the electric potential $V_{ofs}$ used to initialize the electric potential at the control input terminal of the drive transistor $TR_D$ (the gate electric potential $V_g$, in a word, the electric potential at the first node $ND_1$) is set to 0 V, and the electric potential $V_{ini}$ used to initialize the electric potential at the source terminal of the drive transistor $TR_D$ (the source electric potential $V_s$, in a word, the electric potential at the second node $ND_2$) is set to −10 V.

[Threshold Voltage Correcting Processing Process]

In a state in which the electric potential at the first node $ND_1$ is held, the drain current $I_{ds}$ is caused to flow through the drive transistor $TR_D$, whereby the electric potential at the second node $ND_2$ is changed from the electric potential at the first node $ND_1$ toward an electric potential obtained by subtracting the threshold voltage $V_{th}$ of the drive transistor $TR_D$ from the electric potential at the first node $ND_1$. In this case, a voltage (for example, a power source voltage in the phase of the light emission) exceeding a voltage obtained by adding the threshold voltage $V_{th}$ of the drive transistor $TR_D$ to the electric potential at the second node $ND_2$ after end of the preprocessing process is applied to the other main electrode terminal (on a side opposite to the second node $ND_2$) of the two main electrode terminals of the drive transistor $TR_D$. In this threshold voltage correcting processing process, the extent to that a difference in electric potential between the first node $ND_1$ and the second node $ND_2$ (in other words, the gate-to-source voltage $V_{gs}$ of the drive transistor $TR_D$) comes close to the threshold voltage $V_{th}$ of the drive transistor $TR_D$ is dependent on a time for the threshold voltage correcting processing. Therefore, for example, when a sufficiently long time for the threshold voltage correcting processing is ensured, the electric potential at the second node $ND_2$ reaches an electric potential obtained by subtracting the threshold voltage $V_{th}$ of the drive transistor $TR_D$ from the electric potential at the first node $ND_1$. As a result, the drive transistor $TR_D$ becomes an OFF state. On the other hand, for example, when the time for the threshold voltage correcting processing is forced to be set short, the difference in electric potential between the first node $ND_1$ and the second node $ND_2$ is larger than the threshold voltage $V_{th}$ of the drive transistor $TR_D$. As a result, the drive transistor $TR_D$ does not become the OFF state in some cases. As a result of execution of the threshold voltage correcting processing, the drive transistor $TR_D$ needs not to be necessarily become the OFF state. It is noted that in the threshold voltage correcting processing process, preferably, the electric potential is selected and decided so as to fulfill Expression (3), thereby preventing the light emitting portion ELP from emitting the light.

$$(V_{ofs}-V_{th})<(V_{thEL}+V_{cath}) \tag{3}$$

[Video Signal Writing Processing Process]

The video signal $V_{sig}$ is applied from the video signal line DTL to the first node $ND_1$ through the write transistor $TR_W$ which has been turned ON in accordance with the write drive pulse WS supplied from the write scanning line WSL, thereby causing the electric potential at the first node $ND_1$ to rise up to the video signal $V_{sig}$. The electric charges generated based on an electric potential change ($\Delta V_{in}=V_{sig}-V_{ofs}$) at the first node $ND_1$ are allocated to the hold capacitor $C_{CS}$, the parasitic capacitance $C_{el}$ of the light emitting portion ELP, and the parasitic capacitance (such as a gate-to-source capacitance $C_{gs}$) of the drive transistor $TR_D$. When the electrostatic capacitance $C_{el}$ is sufficiently larger value than that of each of the electrostatic capacitance $C_{CS}$ and the electrostatic capacitance $C_{gs}$ of the gate-to-source capacitance $C_{gs}$, the change in the electric potential at the second node $ND_2$ based on the electric potential change ($V_{sig}-V_{ofs}$) is small. In general, the electrostatic capacitance $C_{el}$ of the parasitic capacitance $C_{el}$ of the light emitting portion ELP is larger than each of the electrostatic capacitance $C_{CS}$ of the hold capacitor $C_{CS}$, and the electrostatic capacitance $C_{gs}$ of the gate-to-source capacitance $C_{gs}$. In view of this point, except for the case where there is a special necessity, the change in the electric potential at the second node $ND_2$ caused by the change in the electric potential at the first node $ND_2$ is not taken into consideration. In this case, the gate-to-source voltage $V_{gs}$ can be expressed by Expression (4):

$$V_g=V_{sig}$$

$$V_s\approx V_{ofs}-V_{th}$$

$$V_{gs}\approx V_{sig}-(V_{ofs}-V_{th}) \tag{4}$$

[Mobility Correcting Processing Process]

A current is supplied to the hold capacitor $C_{CS}$ through the drive transistor $TR_D$ while the video signal $V_{sig}$ is supplied to one terminal of the hold capacitor $C_{CS}$ through the write transistor $TR_W$ (in a word, the drive voltage corresponding to the video signal $V_{sig}$ is written to the hold capacitor $C_{CS}$). For example, in a state in which the video signal $V_{sig}$ is supplied from the video signal line DTL to the first node $ND_1$ through the write transistor $TR_W$ which has been turned ON in accordance with the write drive pulse WS supplied from the write scanning line WSL, the electric power is supplied from the power source to the drive transistor $TR_D$ to cause the drain current $I_{ds}$ to flow, thereby changing the electric potential at the second node $ND_2$. Then, after a lapse of a predetermined period of time, the write transistor $TR_W$ is turned OFF. Let $\Delta V$ (=an electric potential correction value, or an amount of negative feedback) be a change in the electric potential at the second node $ND_2$ at this time. A predetermined period of time for execution of the mobility correcting processing has to be previously decided as a design value during the design of the display device. It is noted that in this case, preferably, a mobility correction period is determined so as to fulfill Expression (5). By adopting such a procedure, the light emitting portion ELP is prevented from emitting the light in the mobility correction period.

$$(V_{ofs}-V_{th}+\Delta V)<(V_{thEL}+V_{cath}) \tag{5}$$

When a value of the mobility $\mu$ of the drive transistor $TR_D$ is large, the electric potential correction value $\Delta V$ becomes large. On the other hand, when the value of the mobility $\mu$ of the drive transistor $TR_D$ is small, the electric potential correction value $\Delta V$ becomes small. The gate-to-source voltage $V_{gs}$ (in a word, the difference in electric potential between the first node $ND_2$ and the second node $ND_2$) of the drive transistor $TR_D$ at this time can be expressed by Expression (6):

$$V_{gs}\approx V_{sig}-(V_{ofs}-V_{th})-\Delta V \tag{6}$$

Although the gate-to-source voltage $V_{gs}$ regulates the luminance in the phase of the light emission, the electric potential correction value $\Delta V$ is proportional to the drain current $I_{ds}$ of the drive transistor $TR_D$, and also the drain current $I_{ds}$ is proportional to the mobility $\mu$ of the drive transistor $TR_D$. As a result, since the electric potential correction value $\Delta V$ becomes larger as the mobility $\mu$ is larger, it is possible to remove the dispersion of the mobilities $\mu$ in the pixel circuits 10.

By the way, when the mobility correcting processing is regulated by another expression, it can also be said as the processing in which the current is caused to flow to the hold capacitor through the drive transistor $TR_D$ while the video signal is supplied to each of the control input terminal of the drive transistor $TR_D$ and one terminal of the hold capacitor through the write transistor $TR_W$.

[Light Emission Process]

The write transistor $TR_W$ is turned OFF in accordance with the write drive pulse WS supplied from the write scanning line WSL to cause the first node $ND_1$ to be a floating state. Also, the electric power is supplied from the power source to the drive transistor $TR_D$ to cause the drain current $I_{ds}$ corresponding to the gate-to-source voltage $V_{gs}$ (the difference in electric potential between the first node $ND_1$ and the second node $ND_2$) of the drive transistor $TR_D$ to flow through the light emitting portion ELP through the drive transistor $TR_D$, whereby the light emitting portion ELP is driven to emit the light.

[Different Points due to Configuration of Drive Circuit]

Here, different points among the typical 5Tr/1C type drive configuration, 4Tr/1C type drive configuration, 3Tr/1C type drive configuration, and 2Tr/1C type drive configuration are as follows. In the case of the 5Tr/1C type drive configuration, a first transistor $TR_1$ (light emission control transistor), a second transistor $TR_2$, and a third transistor $TR_3$ are provided. In this case, the first transistor $TR_1$ is connected between the main electrode terminal, on the power source side, of the drive transistor $TR_D$, and the power source circuit (power source portion). The second transistor $TR_2$ applies the second node initialization voltage. Also, the third transistor $TR_3$ applies the first node initialization voltage. Each of the first transistor $TR_2$, the second transistor $TR_2$, and the third transistor $TR_3$ is a switching transistor. The first transistor $TR_1$ is held in the ON state for the light emission period, and is then turned OFF to enter the non-light emission period. Also, the first transistor $TR_1$ is turned ON once for the subsequent threshold voltage correction period, and is also held in the ON state in and after the mobility correction period (a next light emission period as well). The second transistor $TR_2$ is held in the ON sate only for the second node initialization period, and is held in the OFF state for any of periods of time other than the second node initialization period. The third transistor $TR_3$ is held in the ON state only for the period of time from the first node initialization period to the threshold voltage correction period, and is held in the OFF state for any of the periods of time other than that period of time. The write transistor $TR_W$ is held in the ON state for the period of time from a video signal writing processing period to the mobility correcting processing period, and is held in the OFF state for any of the periods of time other than that period of time.

In the case of the 4Tr/1C type drive configuration, the third transistor $TR_3$ which supplies the first node initialization voltage is removed from the 5Tr/1C type drive configuration. Also, the first node initialization voltage is supplied with the video signal $V_{sig}$ from the video signal line DTL in a time division manner. The write transistor $TR_W$ is held in the ON state for the first node initialization period as well in order to supply the first node initialization voltage from the video signal line DTL to the first node for the first node initialization period. Typically, the write transistor $TR_W$ is held in the ON state for the period of time from the first node initialization period to the mobility correcting processing period, and is held in the OFF state for any of the periods of time other than that period of time.

In the case of the 3Tr/1C type drive configuration, both of the second transistor $TR_2$ and the third transistor $TR_3$ are removed from the 5TR/1C type drive configuration. Also, the first node initialization voltage and the second node initialization voltage are supplied with the video signal $V_{sig}$ from the video signal line DTL in the time division manner. For the electric potential of the video signal line DTL, in order that the electric potential at the second node $ND_2$ may be set to the second node initialization voltage for the second node initialization period, and the electric potential at the first node $ND_2$ may be set to the first node initialization voltage for the subsequent first node initialization period, a voltage $V_{ofs_H}$ corresponding to the second node initialization voltage is supplied and a first node initialization voltage $V_{ofs_L}$ ($=V_{ofs}$) is then obtained. Also, the write transistor $TR_W$ is held in the ON state for both of the first node initialization period and the second node initialization period as well in correspondence thereto. Typically, the write transistor $TR_W$ is held in the ON state for the period of time from the second node initialization period to the mobility correcting processing period, and is held in the OFF state for any of the periods of time other than that period of time.

In this connection, in the case of the 3Tr/1C type drive configuration, the electric potential at the second node $ND_2$ is changed by utilizing the video signal line DTL. For this reason, the electrostatic capacitance $C_{CS}$ of the hold capacitor $C_{CS}$ is set to a larger value than that of each of the drive circuits (for example, the electrostatic capacitance $C_{CS}$ is set to about ¼ to about ⅓ of the electrostatic capacitance $C_{el}$) in terms of the design. Therefore, a point that the degree of the change in the electric potential at the second node $ND_2$ caused by the change in the electric potential at the first node $ND_1$ is large is taken into consideration.

In the case of the 2Tr/1C type drive configuration, the first transistor $TR_1$, the second transistor $TR_2$ and the third transistor $TR_3$ are removed from the 5TR/1C type drive configuration. Also, the first node initialization voltage is supplied with the video signal $V_{sig}$ from the video signal line DTL in the time division manner. Also, the main electrode terminal, on the power source side, of the drive transistor $TR_D$ is pulse-driven by using both of the first electric potential $V_{cc_H}$ ($=V_{cc}$ in the case of the 5Tr/1C type drive configuration) and the second electric potential $V_{cc_L}$, ($=V_{ini}$ in the case of the 5Tr/1C type drive configuration), thereby giving the second node initialization voltage. The electric potential at the main electrode terminal, on the power source side, of the drive transistor $TR_D$ is set to the first electric potential $V_{cc_H}$ for the light emission period, and is then set to the second electric potential $V_{cc_L}$, so that the light emitting portion ELP enters the non-light emission period. Also, the electric potential at the main electrode terminal, on the power source side, of the drive transistor $TR_D$ is set to the first electric potential $V_{cc_H}$ in and after the subsequent threshold voltage correction period (for the next light emission period as well). The write transistor $TR_W$ is held in the ON state for the first node initialization period as well in order to supply the first node initialization voltage from the video signal line DTL to the first node $ND_1$ for the first node initialization period. Typically, the write transistor $TR_W$ is held in the ON state for the period of time from the first node initialization period to the mobility correcting processing period, and is held in the OFF state for any of the periods of time other than that period of time.

It is noted that although in this case, the description has been given with respect to the case where with regard to the dispersion of the characteristics of the drive transistors, the correction processing is executed for both of the threshold voltage and the mobility, alternatively, the correction processing may also be executed for only one of the threshold voltage and the mobility.

In the third embodiment of the present disclosure, the characteristics of the drive transistor $TR_D$ are controlled in accordance with the change in the electric potential on the side opposite to the drive transistor $TR_D$. Therefore, it is possible to more reliably suppress a luminance change due to the resistance component between the reference electric potential point and the display element by controlling the characteristics of the drive transistor $TR_D$.

3. Electronic Apparatus (Fourth Embodiment)

An electronic apparatus according to a fourth embodiment of the present disclosure includes the pixel array portion 102 in which the display elements (pixel circuits 10) each including the display portion and the drive transistor $TR_D$ for driving the display portion. Also, the electronic apparatus of the fourth embodiment includes the signal generating portion and the transistor characteristics controlling portion 600. In this case, the signal generating portion generates the video signal which is to be supplied to the pixel array portion 102. Also, the transistor characteristics controlling portion 600 controls the characteristics of the drive transistor $TR_D$. Therefore, it is possible to more reliably suppress a luminance change due to the resistance component between the reference electric potential point and the display element by controlling the characteristics of the drive transistor $TR_D$.

Although the present disclosure has been described so far based on the preferred embodiments, the present disclosure is by no means limited to the preferred embodiments. The various kinds of configurations and structures composing the display device, the display element (pixel circuit), the driving circuit, the method of driving the pixel circuit, and the electronic apparatus which have been described in the embodiments, and the processes in the method of driving the pixel circuit are all merely exemplified, and thus can be suitably changed.

In addition, in each of the operations with the 5Tr/1C type drive configuration, the 4Tr/1C type drive configuration, and the 3Tr/1C type drive configuration, the writing processing and the mobility correcting processing may be separately executed, or the mobility correcting processing may also be executed together with the writing processing as with the 2Tr/1C type configuration. Specifically, it is only necessary that in a state in which the first transistor $TR_1$ (light emission controlling transistor) is held in the ON state, the video signal $V_{sig}$ is applied from the data line DTL to the first node $ND_1$ through the write transistor $TR_W$.

4. Concrete Examples

Hereinafter, a description will be given with respect to Concrete Examples of the technique of the embodiments with which the threshold voltage $V_{th}$ of the drive transistor $TR_D$ is controlled. It is noted that in the display device using the active matrix type organic EL panel, for example, the various kinds of gate signals (control pulses) which are to be supplied to the control input terminals of the transistors by the vertical scanning portion disposed either of both sides of the panel or on one side of the panel are generated, and are then applied to the pixel circuit 10. In addition thereto, in the display device using such an organic EL panel, for both of reduction of the number of elements, and the high definition promotion, the 2Tr/1C type pixel circuit 10 is used in some cases. In view of this point, in the following description, Concrete Examples each of which is applied to the 2Tr/1C type drive configuration will now be typically described.

4-1. Example 1

Scanning Type

[Pixel Circuit]

Figure 4:
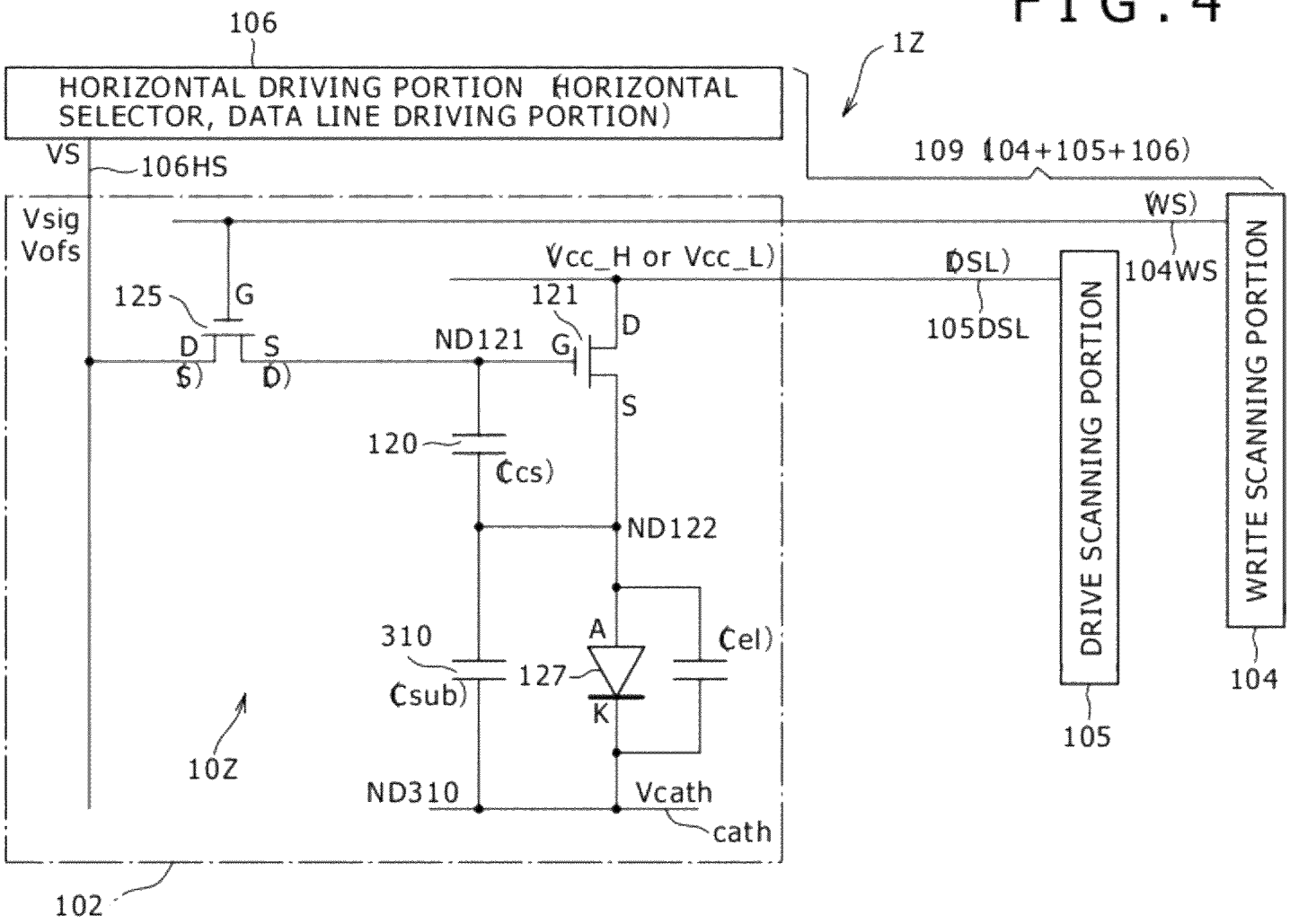
FIG. 4 is a circuit diagram, partly in block, showing a configuration of one form of a pixel circuit in a display device according to Comparative Example of Example 1 of the first embodiment of the present disclosure.
Figure 5:
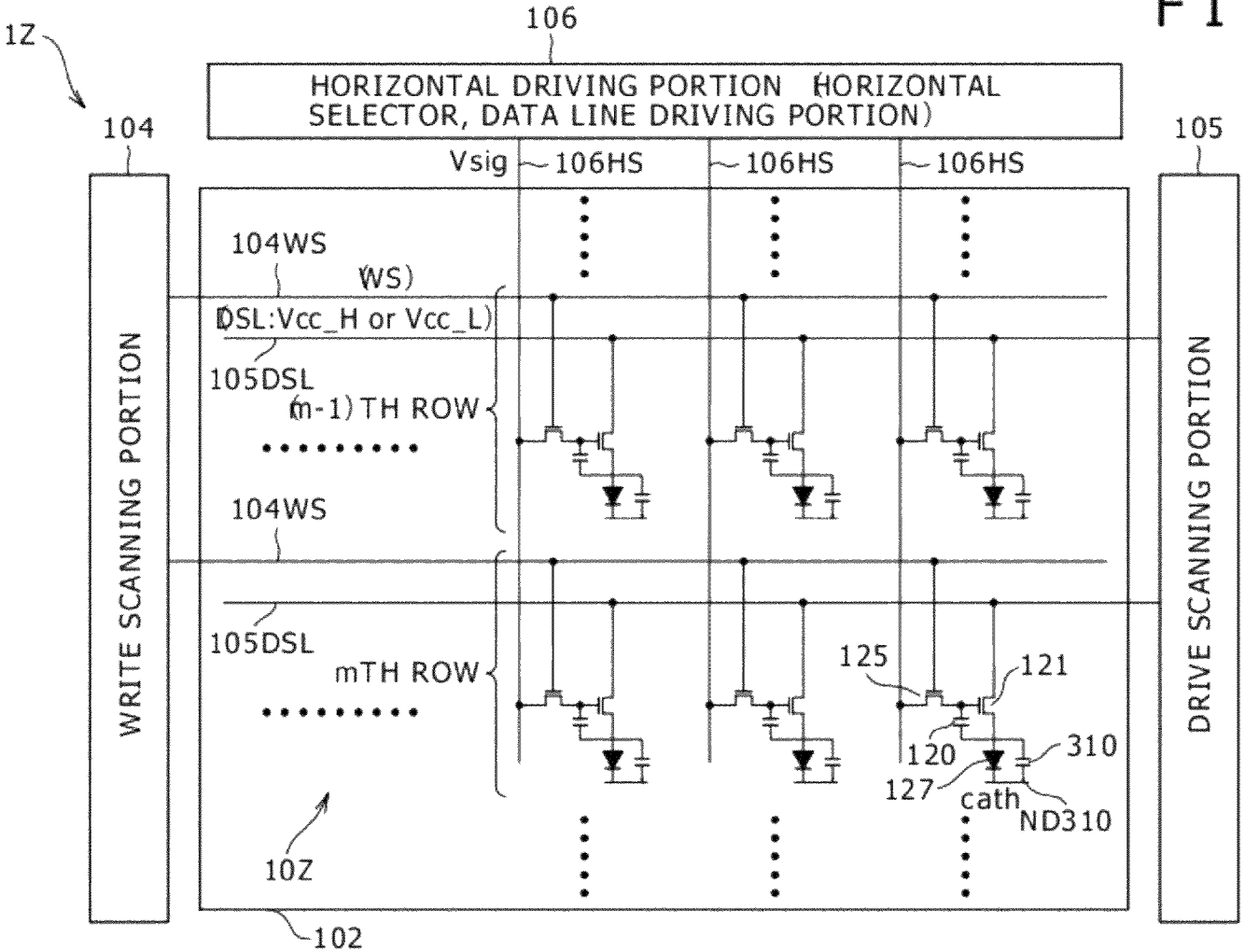
FIG. 5 is a circuit diagram, partly in block, showing a configuration of an entire outline of the display device including the pixel circuit of Comparative Example shown in FIG. 4.
Figure 6:
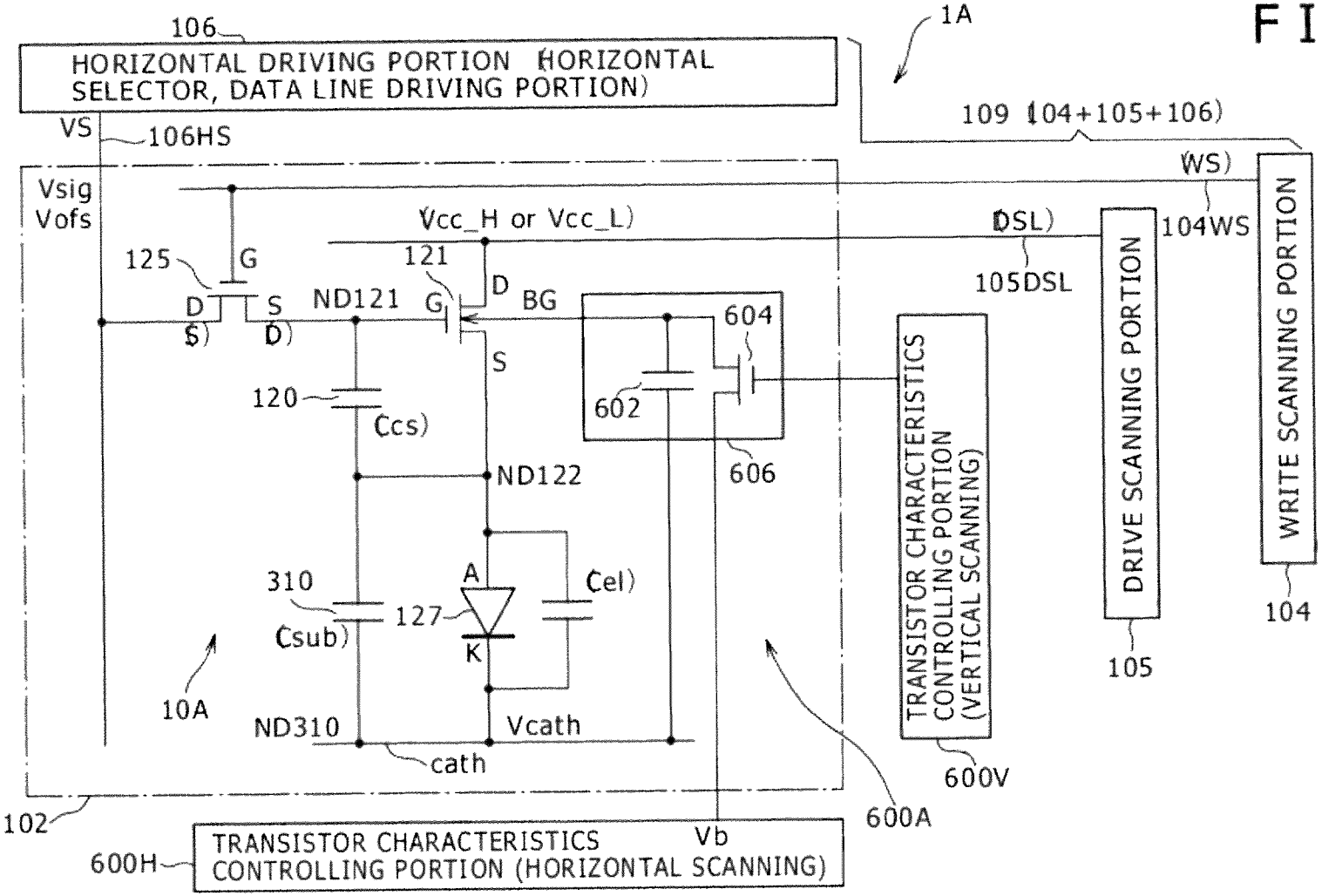
FIG. 6 is a circuit diagram, partly in block, showing a configuration of one form of a pixel circuit in a display device according to Example 1 of the first embodiment of the present disclosure.
Figure 7:
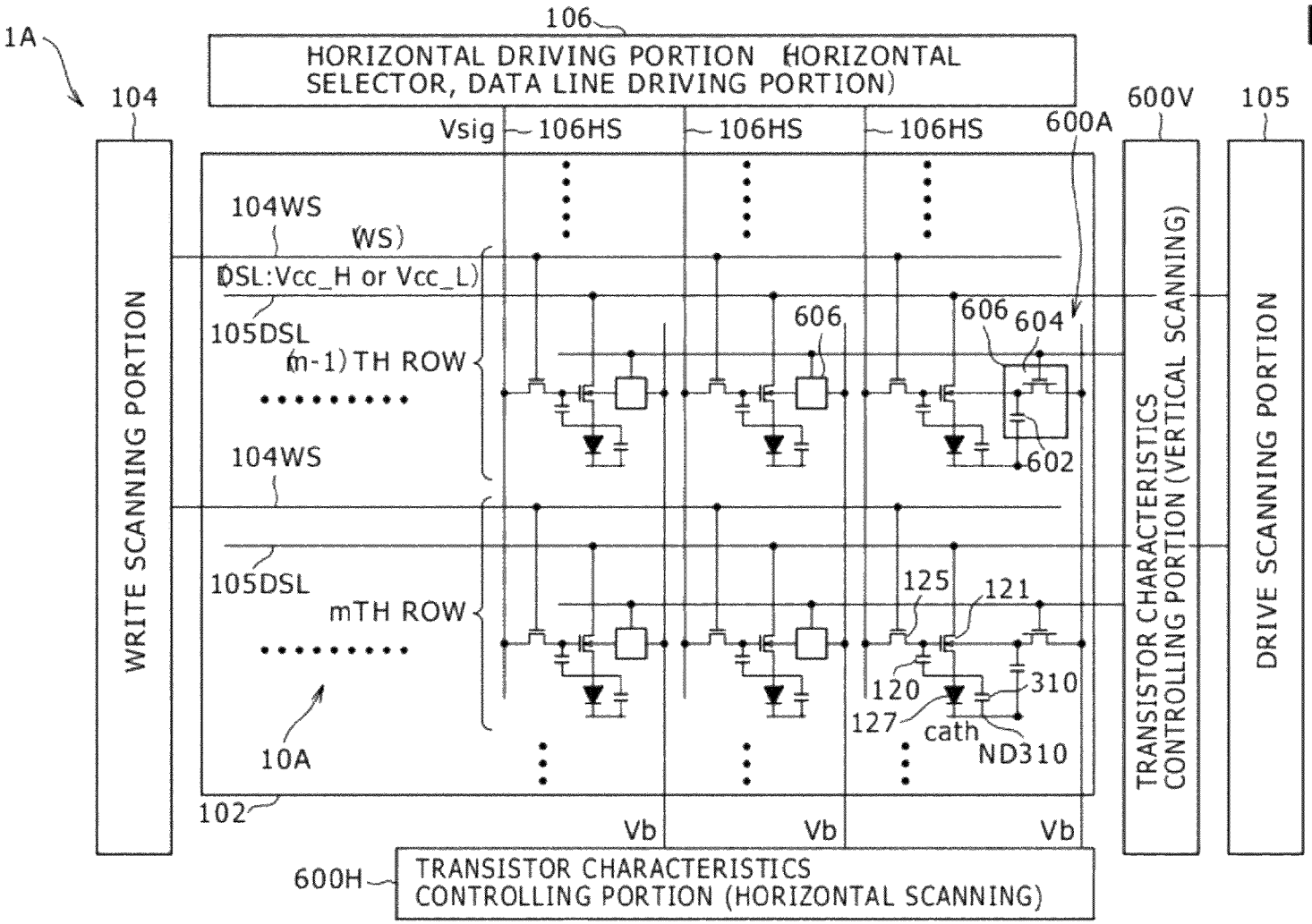
FIG. 7 is a circuit diagram, partly in block, showing a configuration of an entire outline of the display device, including the pixel circuit, according to Example 1 of the first embodiment of the present disclosure.

FIGS. 4 and 5 are respectively diagrams showing one form of a pixel circuit 10Z of Comparative Example for Examples, and a display device including the pixel circuit 10Z concerned. The display device including the pixel circuit 10Z of Comparative Example in the pixel array portion 102 is referred to as a display device 1Z. FIG. 4 shows a basic configuration (for one pixel), and FIG. 5 shows a concrete configuration (of the entire display device). FIGS. 6 and 7 are respectively diagrams showing one form of a pixel circuit 10A of Example 1, and a display device including the pixel circuit 10A concerned. The display device including the pixel circuit 10A of Example 1 in the pixel array portion 102 is referred to as a display device 1A of Example 1. FIG. 6 shows a basic configuration (for one pixel), and FIG. 7 shows a concrete configuration (of the entire display device). It is noted that even in any of Comparative Example and Example 1, both of the vertical driving portion 103 and the horizontal driving portion 106 are shown together with other constituent portions on the substrate 101 of the display panel block 100. This also applies to each of Examples which will be described later.

Firstly, portions common to Comparative Example and Example 1 will be described with reference symbols A and Z being omitted. In the display device 1, an electrooptic element (an organic EL element 127 is used as the light emitting portion ELP in this case) within the pixel circuit 10 is caused to emit a light in accordance with the video signal $V_{sig}$ (specifically, a signal amplitude $\Delta V_{in}$). For this reason, the display device 1 includes at least a drive transistor 121 (the drive transistor $TR_D$), a hold capacitor 120 (the hold capacitor $C_{CS}$), the organic EL element 127 (the light emitting portion ELP), and a sampling transistor 125 (the write transistor $TR_W$) in each of the pixel circuits 10 disposed in a matrix in the pixel array portion 102. In this case, the drive transistor 121 generates a drive current. The hold capacitor 120 is connected between a control input terminal (typically, a gate electrode terminal) and an output terminal (typically, a source electrode terminal) of the drive transistor 121. The organic EL element 127 is an example of the electrooptic element and is connected to the output terminal of the drive transistor 121. Also, the sampling transistor 125 writes information on the signal amplitude $\Delta V_{in}$ to the hold capacitor 120. In the pixel circuit 10, the drive current $I_{ds}$ based on the information held in the hold capacitor 120 is generated by the drive transistor 121 to be caused to flow the organic EL element 127 as the example of the electrooptic element, thereby causing the organic EL element 127 to emit a light.

Since the sampling transistor 125 writes the information on the signal amplitude $\Delta V_{in}$ to the hold capacitor 120, the sampling transistor 125 fetches a signal electric potential ($V_{ofs}+\Delta V_{in}$) in an input terminal thereof (either one of a source electrode terminal and drain electrode terminal thereof), and writes the information on the signal amplitude $\Delta V_{in}$ to the hold capacitor 120 connected to an output terminal (the other of the source electrode terminal and drain electrode terminal thereof). Of course, the output terminal of the sampling transistor 125 is connected to the control input terminal as well of the drive transistor 121.

Note that, a most basic configuration is shown as a connection configuration of the pixel circuit 10 shown here. Thus, all it takes is that the pixel circuit 10 is one including at least the constituent elements described above. Thus, the pixel circuit 10 may include constituent elements (in a word, other constituent elements) other than those constituent elements. In addition, the wording "connection" is by no means limited to direct connection, but may also be connection made through any other suitable constituent element(s). For example, a change such as interposition of a switching transistor or a functional portion having a certain function may also be further added to interconnection in some cases as may be necessary. Typically, a switching transistor for dynamically controlling a display period of time (in other words, a non-light emission period) may be disposed either between the output terminal of the drive transistor 121 and the electrooptic element (the organic EL element 127), or between the power source supply terminal (typically, the drain electrode terminal) of the drive transistor 121, and a power source line PWL (a power source supply line 105DSL in this case) as a wiring for the power source supply in some cases. Even in the case of the pixel circuits of such modified changes, any of such modified changes is the pixel circuit 10 which realizes the display device according to the first embodiment of the present disclosure as long as it can realize the constitution and operation which will be described in Example 1 (or any other suitable Example).

In addition, for example, a control unit 109 including a write scanning portion 104 and a drive scanning portion 105 is provided in the peripheral portion configured to drive the pixel circuit 10. In this case, the write scanning portion 104 scans the pixel circuits 10 in the line-sequential manner by successively controlling the sampling transistors 125 with the horizontal cycle, thereby writing the information on the signal amplitude $\Delta V_{in}$ of the video signal $V_{sig}$ to the hold capacitors 120 for one row. Also, the drive scanning portion 105 outputs a scanning drive pulse (a power source drive pulse DSL) for control for the power source supply whose electric power is applied to the power source supply terminals of the drive transistors 121 for one row in accordance with the line-sequential scanning in the write scanning portion 104. In addition, the control unit 109 is provided with a horizontal driving portion 106. In this case, the horizontal driving portion 106 carries out the control in such a way that the video signal $V_{sig}$ which is switched between the reference electric potential ($V_{ofs}$) and the signal electric potential ($V_{ofs}+\Delta V_{in}$) with each of the horizontal cycles in accordance with the line-sequential scanning in the write scanning portion 104 is supplied to the sampling transistor 125.

Preferably, it is only necessary that the control unit 109 carries out the control so as to perform a bootstrap operation in which the sampling transistor 125 is caused to become a non-conduction state at a time point at which the information on the signal amplitude $\Delta V_{in}$ is written to the hold capacitor 120 to stop the supply of the video signal $V_{sig}$ to the control input terminal of the drive transistor 121, and thus the electric potential at the control input terminal is changed in conjunction with the change in the electric potential at the output terminal of the drive transistor 121. Preferably, the control unit 109 carries out the bootstrap operation even at an initial stage of start of the light emission after completion of the sampling operation. That is to say, after the sampling transistor 125 has been caused to become the conduction state in a state in which the signal electric potential ($V_{ofs}+\Delta V_{in}$) has being supplied to the sampling transistor 125, the sampling transistor 125 is caused to become the non-conduction state, whereby a difference in electric potential between the control input terminal and the output terminal of the drive transistor 121 is made to be maintained constant.

In addition, preferably, the control unit 109 controls the bootstrap operation in such a way that a temporal change correcting operation of the electrooptic element (the organic EL element 127) is realized for the light emission period. For this reason, all it takes is that the control unit 109 continuously holds the sampling transistor 125 in the non-conduction state for a period of time for which the drive current $I_{ds}$ based on the information held in the hold capacitor 120 is caused to flow through the electrooptic element (the organic EL element 127), whereby the difference in electric potential between the control input terminal and the output terminal of the drive transistor 121 can be maintained constant, thereby realizing the temporal change correcting operation of the electrooptic element. Even when current vs. voltage characteristics of the organic EL element 127 is changed with time due to the bootstrap operation of the hold capacitor 120 in the phase of the light emission, the voltage difference in electric potential between the control input terminal and the output terminal of the drive transistor 121 is held constant by the hold capacitor 120 carrying out the bootstrap operation, whereby the constant emission luminance is held on a constant basis. In addition, preferably, the control unit 109 carries out the control in such a way that the sampling transistor 125 is caused to conduct in a time zone for which the reference electric potential (=the first node initialization voltage $V_{ofs}$) is supplied to the input terminal (typically, the source electrode terminal) of the sampling transistor 125, thereby carrying out a threshold voltage correcting operation for holding the voltage corresponding to the threshold voltage $V_{th}$ of the drive transistor 121 in the hold capacitor 120.

All it takes is that the threshold voltage correcting operation is repetitively carried out with plural horizontal cycles preceding the operation for writing the information on the signal amplitude $\Delta V_{in}$ to the hold capacitor 120 as may be necessary. Here, the wording "as may be necessary" means the case where for the threshold voltage correction period within one horizontal cycle, it may be impossible to sufficiently hold the voltage corresponding to the threshold voltage of the drive transistor 121 in the hold capacitor 120. The threshold voltage correcting operation is carried out plural times, whereby the voltage corresponding to the threshold voltage $V_{th}$ of the drive transistor 121 is reliably held in the hold capacitor 120.

In addition, more preferably, the control unit 109 carries out the control in such a way that in a time zone for which the reference electric potential ($V_{ofs}$) is supplied to the input terminal of the sampling transistor 125, the sampling transistor 125 is caused to conduct prior to the threshold voltage correcting operation, thereby carrying out preparation operations (such as a discharging operation and an initialization operation) for the threshold voltage correction. The electric potentials at the control input terminal and the output terminal of the drive transistor 121 are initialized before the threshold voltage correction is carried out. More specifically, the difference in electric potential between the both terminals of the hold capacitor 120 is set so as to become equal to or larger than the threshold voltage $V_{th}$ by connecting the hold capacitor 120 between the control input terminal and the output terminal in advance.

Note that, all it takes is that in carrying out the threshold voltage correction with the 2TR/1C type drive configuration, a drive scanning portion 105 is provided in the control unit 109, and the control unit 109 carries out the control in such a way that in a time zone for which a voltage corresponding to a first electric potential $V_{cc_H}$ is supplied to the power source supply terminal of the drive transistor 121, and the signal electric potential ($V_{ofs}+\Delta V_{in}$) is supplied to the sampling transistor 125, the sampling transistor 125 is caused to conduct, thereby carrying out the threshold voltage correcting operation for the pixel circuits 10 for one row in accordance with the line-sequential scanning in the write scanning portion 104. In this case, the drive scanning portion 105 switches the first electric potential $V_{cc_H}$ used to cause the drive current $I_{ds}$ to flow through the electrooptic element (the organic EL element 127), and a second electric potential $V_{cc_L}$ which is different from the first electric potential $V_{cc_H}$ over to each other to output either the first electric potential $V_{cc_H}$ or the second electric potential $V_{cc_L}$ thus switched. In addition, all it takes is that in carrying out the preparation operation for the threshold voltage correction with the 2Tr/1C type drive configuration, in a time zone for which a voltage corresponding to the second electric potential $V_{cc_L}$ (=the second node initialization voltage $V_{ini}$) is supplied to the power source supply terminal of the drive transistor 121, and the reference electric potential ($V_{ofs}$) is supplied to the sampling transistor 125, the sampling transistor 125 is caused to conduct, and thus the electric potential at the control input terminal (in a word, the first node $ND_1$) of the drive transistor 121 is initialized to the reference electric potential ($V_{ofs}$), and the electric potential at the output terminal (in a word, the second node $ND_2$) is initialized to the second electric potential $V_{cc_L}$.

More preferably, the control unit 109 carries out the control in such a way that after completion of the threshold voltage correcting operation, when in a time zone for which the voltage corresponding to the first electric potential $V_{cc_H}$ is supplied to the drive transistor 121, and the signal electric potential ($V_{ofs}+\Delta V_{in}$) is supplied to the sampling transistor 125, the sampling transistor 125 is caused to conduct to write the information on the signal amplitude $\Delta V_{in}$ to the hold capacitor 120, information for the correction for the mobility μ of the drive transistor 121 is added to the information which is to be written to the hold capacitor 120. In this case, all it takes is that in a predetermined position within a time zone for which the signal electric potential ($V_{ofs}+\Delta V_{in}$) is supplied to the sampling transistor 125, only for a period of time shorter than the time zone, the sampling transistor 125 is caused to conduct. Hereinafter, an example of the pixel circuit 10 with the 2Tr/1C type drive configuration will be concretely described.

In the pixel circuit 10, basically, the drive transistor is composed of an n-channel thin film field-effect transistor. In addition, the pixel circuit 10 adapts a drive system in which the pixel circuit 10 includes a circuit for suppressing a change in the drive current $I_{ds}$ supplied to the organic EL element due to the temporal deterioration of the organic EL element, that is, a drive signal fixing circuit (part 1) for maintaining the drive current $I_{ds}$ constant by correcting change in current vs. voltage characteristics of the organic EL element as an example of the electrooptic element, and thus the drive current $I_{ds}$ is maintained constant by realizing a threshold voltage correcting function and a mobility correcting function of preventing the change in the drive current $I_{ds}$ due to the change in the characteristics (such as the dispersion of the threshold voltages and the dispersion of the mobilities) of the drive transistor.

With regard to a method of suppressing an influence exerted on the drive current $I_{ds}$ due to the change in the characteristics (such as the dispersion and the change in the threshold voltage, the mobility, and the like) of the drive transistor 121, the drive timings for the transistors (the drive transistor 121 and the sampling transistor 125) are devised while the drive circuit with the 2Tr/1C type drive configuration is directly adopted as the drive signal fixing circuit (part 1), thereby coping with the dispersion and the change in the threshold voltage, the mobility, and the like. Since the pixel circuit 10 has the 2Tr/1C type drive configuration and thus the number of elements and the number of wirings are each small, the high definition promotion is possible. In addition thereto, since the sampling can be carried out without the deterioration of the video signal $V_{sig}$, it is possible to obtain the excellent image quality.

In addition, the pixel circuit 10 has the feature in the connection form of the hold capacitor 120, and composes the bootstrap circuit, as an example of a drive signal fixing circuit (part 2), as a circuit for preventing the change in the drive current $I_{ds}$ due to the temporal deterioration of the organic EL element 127. The pixel circuit 10 includes the drive signal fixing circuit (part 2) which realizes the bootstrap function of fixing the drive current $I_{ds}$ (preventing the change in the drive current $I_{ds}$) even when there is the temporal change in the current vs. voltage characteristics of the organic EL element.

It is noted that the pixel circuit 10 includes a subsidiary capacitor 310 related to the write gain, the bootstrap gain, and the mobility correction period.

However, it is not essential to the present disclosure to include the subsidiary capacitor 310. A basic controlling operation when the pixel circuit 10 is driven is identical to that in the pixel circuit 10 not including the subsidiary capacitor 310.

Field-effect transistors (TFTs) are used as the transistors, including the drive transistor. In this case, with regard to the drive transistor, a gate electrode terminal is treated as a control input terminal, one of a source electrode terminal and a drain electrode terminal (the source electrode terminal in this case) is treated as an output terminal, and the other (the drain electrode terminal in this case) is treated as a power source supply terminal.

Specifically, as shown in FIGS. 4 and 5, the pixel circuit 10 includes an n-channel drive transistor 121, an n-channel sampling transistor 125, and an organic EL element 127 as an example of the electrooptic element which emits a light by causing a current to flow therethrough. In general, since the organic EL element 127 has a rectification property, the organic EL element 127 is represented by a symbol of a diode. It is noted that a parasitic capacitance $C_{el}$ exists in the organic EL element 127. In FIGS. 4 and 5, the parasitic capacitance $C_{el}$ is shown in parallel with the organic EL element 127 (represented by the symbol of the diode).

With regard to the drive transistor 121, a drain terminal D thereof is connected to a power source supply line 105DSL through which either the first electric potential $V_{cc_H}$ or the second electric potential $V_{cc_L}$ is supplied, and a source terminal S thereof is connected to an anode terminal A of the organic EL element 127 (a connection point thereof is the second node $ND_2$ and is represented as a node ND122). Also, a cathode terminal K of the organic EL element 127 is connected to a cathode wiring cath (an electric potential thereof is a cathode electric potential $V_{cath}$, for example, GND) through which the reference electric potential is supplied and which is common to all of the pixel circuits 10. It is noted that the cathode wiring cath may be composed of only a single layer wiring (upper layer wiring) therefor, or for example, an auxiliary wiring for the cathode wiring may be provided in the anode layer in which a wiring for an anode is formed, thereby reducing a resistance value of the cathode wiring. The auxiliary wiring is wired in a lattice-like shape, in a column-like shape or in a row-like shape within the pixel array portion 102 (display area), and has the same electric potential as that of the upper layer wiring, that is, a fixed electric potential.

With regard to the sampling transistor 125, a gate terminal G thereof is connected to a write scanning line 104WS extending from a write scanning portion 104, a drain terminal D thereof is connected to a video signal line 106HS (a video signal line DTL), and a source terminal S thereof is connected to a gate terminal G of the drive transistor 121 (a connection point thereof is the first node $ND_1$ and is represented as a node ND121). A write drive pulse WS set at an active H level is supplied from the write scanning portion 104 to the gate terminal G of the sampling transistor 125. The sampling transistor 125 may adopt a connection form in which the source terminal S and the drain terminal D are reversed.

The drain terminal D of the drive transistor 121 is connected to a power source supply line 105DSL extending from the drive scanning portion 105 functioning as a power source scanner. The power source supply line 105DSL itself has an ability to supply an electric power from a power source to the drive transistor 121. The drive scanning portion 105 switches the first electric potential $V_{cc_H}$, on the high voltage side, corresponding to the power source voltage, and the second electric potential $V_{cc_L}$, (referred to as either an initialization voltage or an initial voltage as well), on the low voltage side, which is utilized for the preparation operation preceding the threshold voltage correction and which corresponds to the power source voltage over to each other to supply one of the first electric potential $V_{cc_H}$ and the second electric potential $V_{cc_L}$ thus switched to the drain terminal D of the drive transistor 121.

The drain terminal D side (power source circuit side) of the drive transistor 121 is driven by using the power source drive pulse DSL taking two values of the first electric potential $V_{cc_H}$ and the second electric potential $V_{cc_L}$, thereby making it possible to carry out the preparation operation preceding the threshold voltage correction. The second electric potential $V_{cc_L}$ is set to an electric potential sufficiently lower than the reference electric potential ($V_{ofs}$) of the video signal $V_{sig}$ of the video signal line 106HS. Specifically, the second electric potential $V_{cc_L}$ on the low electric potential side of the power source supply line 105DSL is set in such a way that a gate-to-source voltage $V_{gs}$ (a difference between a gate electric potential $V_g$ and a source electric potential $V_s$) of the drive transistor 121 becomes larger than the threshold voltage $V_{th}$ of the drive transistor 121. It is noted that the reference electric potential ($V_{ofs}$) is not only utilized for the initialization operation preceding the threshold correcting operation, but also utilized for previously precharging the video signal line 106HS.

In such a pixel circuit 10, when the organic EL element 127 is driven, the first electric potential $V_{cc_H}$ is supplied to the drain terminal D of the drive transistor 121, and the source terminal S of the drive transistor 121 is connected to the anode terminal A side of the organic EL element 127, thereby forming a source follower circuit as a whole.

When such a pixel circuit 10 is adopted, the 2Tr/1C type drive configuration is adopted in which in addition to the drive transistor 121, one switching transistor (the sampling transistor 125) is used for the scanning. Also, the influence exerted on the drive current $I_{ds}$ due to the temporal change of the organic EL element 127, and the change in characteristics (such as the dispersion and the change in the threshold voltage, the mobility, and the like) of the drive transistor 121 is prevented by the setting of the ON/OFF timings for the power source drive pulse DSL and the write drive pulse WS in accordance with which the switching transistors are controlled.

In addition thereto, in the display device 1A of Example 1, the subsidiary capacitor 310 as a capacitive element having an electrostatic capacitance $C_{sub}$ is added to a node ND122 (a connection point between each of the source terminal S of the drive transistor 121 and one terminal of the hold capacitor 120, and the anode terminal A of the organic EL element 127) every pixel circuit 10A. Irrespective of a connection portion of the other terminal (referred to as "a node ND 310") of the subsidiary capacitor 310, the subsidiary capacitor 310 is electrically connected in parallel with the organic EL element 127 (the parasitic capacitance thereof is $C_{el}$) in terms of the circuit configuration. The connection portion of the node ND310, as an example, is the cathode wiring cath (either may be an upper layer wiring or may be a subsidiary wiring) common to all of the pixel circuits 10 to which the cathode terminals K of all of the organic EL elements 127 are connected, respectively. The connection point of the node ND310, for example, may also be the power source supply line 105DSL in the auto-stage (row), the power source supply line 105DSL in any other suitable stage other than the auto-stage, or a fixed electric potential point having an arbitrary value (including the grounding electric potential) in addition thereto. Although there are strong and weak points (an advantage and a disadvantage) depending on which of portions the connection point of the node ND310 corresponds to, a description thereof is omitted here for the sake of simplicity.

Both of the electrostatic capacitance $C_{CS}$ of the hold capacitor 120, and the electrostatic capacitance $C_{el}$ of the parasitic capacitance $C_{el}$ are determined in such a way that a balance between the write gain $G_{in}$ and the bootstrap gain $G_{bst}$ is struck, and thus these gains $G_{in}$ and $G_{bst}$ become suitable ones. Both of the write gain $G_{in}$ and the bootstrap gain $G_{bst}$ can be adjusted by adjusting the electrostatic capacitance $C_{sub}$ of the subsidiary capacitor 310. When this fact is utilized, the electrostatic capacitance $C_{sub}$ is relatively adjusted among the three pixel circuits 10 corresponding to R, G, and B, respectively, thereby making it also possible to obtain a white balance. That is to say, since the luminous efficiencies of the organic EL elements 127 for the three primary colors: R; G; and B are different from one another, in the case where there is no subsidiary capacitor 310, it may be impossible to obtain the white balance when the same drive current $I_{ds}$ (in a word, the same signal amplitude $V_{in}$) is used. Therefore, the signal amplitude $V_{in}$ is made to differ so as to correspond to the three primary colors of R, G, and B, respectively, thereby obtaining the white balance. On the other hand, the electrostatic capacitance $C_{sub}$ of the subsidiary capacitor 310 is relatively adjusted among the pixel circuits 10 corresponding to R, G, and B, respectively, whereby even when the same drive current $I_{ds}$ (in a word, the same signal amplitude $V_{in}$) is used, it is possible to obtain the white balance. In addition thereto, the adding of the subsidiary capacitor 310 results in that it is possible to adjust a time required for correction for the mobility μ (mobility correction period) without exerting an influence on the threshold voltage correcting operation. The mobility correction period is made adjustable by utilizing the subsidiary capacitor 310, whereby even when the operation for driving the pixel circuit 10 is speeded up, it is possible to sufficiently correct the mobility μ.

[Configuration Peculiar to Example 1]

Here, in the pixel circuit 10Z of Comparative Example, each of the transistors is the general thin film transistor having no back-gate terminal. On the other hand, in the pixel circuit 10A of Example 1, the transistor having the control terminal (hereinafter referred to as "the transistor characteristics control terminal" as well) capable of controlling the transistor characteristics (increasing or decreasing of the threshold voltage $V_{th}$ in this case) in addition to the control input terminal (gate terminal) is used as at least the drive transistor 121 (and also the sampling transistor 125 in FIG. 6). A typical example of the transistor having the transistor characteristics control terminal is either the back-gate type thin film transistor or the MOS transistor as shown in FIG. 3B. It goes without saying that the N-channel and the P-channel are replaced with each other in each of the transistors, and the complementary configuration can be adopted in which the polarities of the power sources and the signals are inverted in accordance with the replacement.

Each of the transistors in the pixel circuit 10 of Comparative Example can also be replaced with the transistor having the transistor characteristics control terminal. In this case, however, the transistor characteristics control terminal is normally connected to one of the grounding line or one of the main electrode terminals (for example, the source terminal) (refer to FIG. 9B which will be described later). On the other hand, in Example 1, the display device 1A includes the transistor characteristics controlling portion 600A. Thus, the display device 1A is configured in such a way that "a predetermined control electric potential" is applied from the transistor characteristics controlling portion 600A to the transistor characteristics control terminal of the drive transistor 121. Although the details of "the predetermined control electric potential" will be described later, the predetermined control electric potential is a control voltage for suppression of the gradation-like display nonuniformity due to the cathode resistance distribution. The gradation-like display nonuniformity due to the cathode resistance distribution has an intra-surface distribution. Therefore, basically, as far as the configuration of the transistor characteristics controlling portion 600A concerned, a configuration obtained by combining the vertical scanning and the horizontal scanning with each other is adopted in order to supply the control voltage (described as "the transistor characteristics control signal Vb") for the horizontal distribution and the vertical distribution to the transistor characteristics control terminal. Specifically, the transistor characteristics controlling portion 600A includes a transistor characteristics controlling portion 600H, a transistor characteristics controlling portion 600V, and the hold capacitor $C_{CS}$. In this case, the transistor characteristics controlling portion 600H supplies the transistor characteristics control signal Vb. Also, the switching transistor is controlled so as to be turned ON or OFF by the transistor characteristics controlling portion 600V. As a result, the transistor characteristics control signal Vb of the drive transistor 121 can be set every pixel circuit 10A. For example, it is only necessary to adopt a configuration in which the hold capacitor 602 for holding therein "a predetermined control electric potential" supplied to the transistor characteristics control terminal of the drive transistor 121 is connected between the transistor characteristics control terminal of the drive transistor 121, and the reference electric potential point (for example, the cathode wiring cath), and "a predetermined control electric potential" is supplied to the hold capacitor 602 through the switching transistor 604. The hold capacitor 602 and the switching transistor 604 are collectively referred to as "a correcting element 606." This is similar to the relationship between the sampling transistor 125 and the hold capacitor 120 in relation to the video signal $V_{sig}$.

[Operation of Pixel Circuit]

Figure 8:
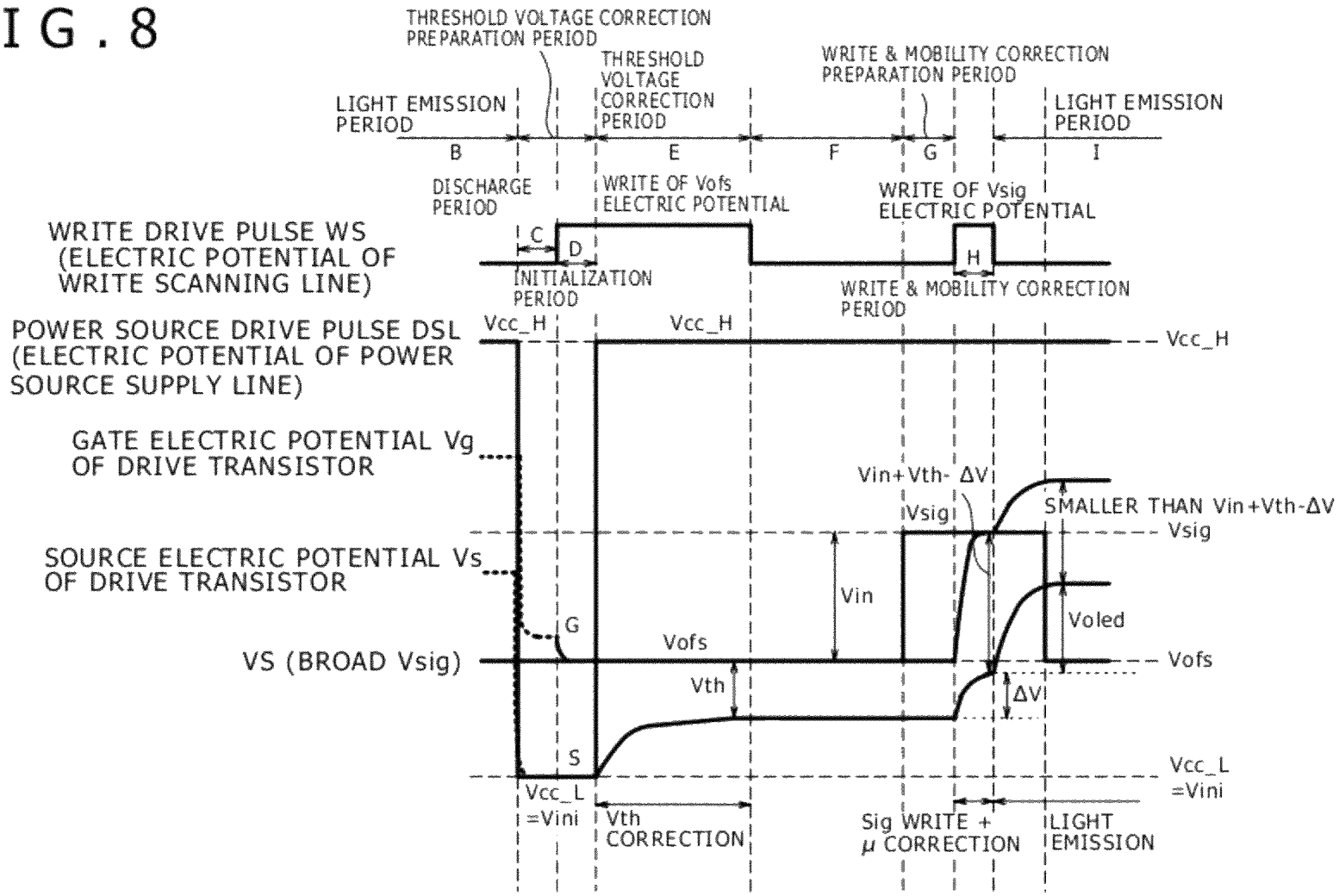
FIG. 8 is a timing chart explaining a method of driving the pixel circuit of the display device according to a third embodiment of the present disclosure.

FIG. 8 is a timing chart (ideal state) explaining an operation of the pixel circuit 10 when the information on the signal amplitude $V_{in}$ is written to the hold capacitor 120 in the line-sequential manner as an example of the drive timing for the pixel circuit 10 (corresponding to each of the pixel circuit 10Z of Comparative Example and the pixel circuit 10A of Example 1). In FIG. 8, a change in the electric potential of the write scanning line 104WS, a change in the electric potential of the power source supply line 105DSL, and a change in the electric potential of the video signal line 106HS are shown with a time axis as being common. Changes in the gate electric potential $V_g$ and the source electric potential $V_s$ of the drive transistor 121 are also shown in parallel with these electric potential changes. Basically, the same driving operation is carried out with a delay of one horizontal scanning period every one row of the write scanning line 104WS and the power source supply line 105DSL.

The value of the current caused to flow through the organic EL element 127 is controlled in accordance with the timings of the pulses like the signals shown in FIG. 8. In the example of the timings shown in FIG. 8, after the quenching, and the initialization of the node ND122 have been carried out by setting the power source drive pulse DSL to the second electric potential $V_{cc_L}$, while the first node initialization voltage $V_{ofs}$ is supplied to the video signal line 106HS, the sampling transistor 125 is turned ON to initialize the node ND121, and in this state, the power source drive pulse DSL is set to the first electric potential $V_{cc_H}$, thereby carrying out the threshold voltage correction. After that, the sampling transistor 125 is turned OFF, thereby applying the video signal $V_{sig}$ to the video signal line 106HS. In this state, the sampling transistor 125 is turned ON, thereby carrying out the mobility correction concurrently with writing of the signal. After the signal has been written, the emission is started at the time when the sampling transistor 125 is turned OFF. In such a manner, for the mobility correction, the threshold voltage correction, and the like, the driving operation is controlled by using a phase difference between the pulses. When the pixel circuit 10A of the display device 1A of Example 1 is driven, the operation for writing the transistor characteristics control signal Vb to the hold capacitor 602 is carried out in conjunction with the operation for writing the video signal $V_{sig}$.

Hereinafter, the operation will be described by paying attention to the threshold voltage correction and the mobility correction. In the pixel circuit 10, with regard to the drive timing, firstly, the sampling transistor 125 is caused to conduct in accordance with the write drive pulse WS supplied thereto from the write scanning line 104WS, and samples the video signal $V_{sig}$ supplied thereto from the video signal line 106HS to hold the video signal $V_{sig}$ thus supplied in the hold capacitor 120. Firstly, in the following description, for the purpose of facilitating the description and understanding, unless otherwise stated, under the condition in which the write gain is assumed to be 1 (ideal value), the description is given in such a way that the information on the signal amplitude $V_{in}$ is simply described as, for example, being written, held or sampled in the hold capacitor 120. When the write gain is smaller than 1, the information on the signal amplitude $V_{in}$ itself is not held in the hold capacitor 120, but the information which is obtained through gain-fold corresponding to the magnitude of the signal amplitude $V_{in}$ is held in the hold capacitor 120.

With regard to the driving timing for the pixel circuit 10, when the information on the signal amplitude $V_{in}$ of the video signal $V_{sig}$ is written to the hold capacitor 120, from a viewpoint of the line-sequential scanning, the line-sequential driving for simultaneously transmitting the video signals for one row to the video signal lines 106HS belonging to the respective columns is carried out. In particular, in the basis way of thinking when both of the threshold voltage correction and the mobility correction are carried out at the drive timing in the pixel circuit 10 with the 2Tr/1C type drive configuration, firstly, it is supposed that the video signal $V_{sig}$ has both of the reference electric potential ($V_{ofs}$) and the signal electric potential ($V_{ofs}+V_{in}$) for 1 H period in the time division manner. Specifically, a period of time for which the video signal $V_{sig}$ is held at the reference electric potential ($V_{ofs}$) as an invalid period is set as a first-half portion of one horizontal period. Also, a period of time for which the video signal $V_{sig}$ is held at the signal electric potential ($V_{sig}=V_{ofs}+V_{in}$) as a valid period is set as a second-half portion of one horizontal period. When one horizontal period is divided into the first-half portion and the second-half portion, typically, one horizontal period is divided into about half period of time and about half period of time. However, such a division manner is not essential to the present disclosure. That is to say, the second-half portion may be made longer than the first-half portion. Or, contrary to this, the second-half portion may be made shorter than the first-half portion.

We shall use the write drive pulse WS, used for the signal writing, for both of the threshold voltage correction and the mobility correction as well. Thus, the write drive pulse WS is made active twice for one horizontal period to turn ON the sampling transistor 125. Also, the threshold voltage correction is carried out at the first ON-timing, and both of the signal voltage writing and the mobility correction are simultaneously carried out at the second ON-timing. After that, the drive transistor 121 receives the supply of the current from the power source supply line 105DSL held at the first electric potential (high electric potential side), and then causes the drive current $I_{ds}$ to flow through the organic EL element 127 in accordance with the signal electric potential (the electric potential corresponding to the electric potential for the valid period of the video signal $V_{sig}$) held in the hold capacitor 120. It is noted that instead of making the write drive pulse WS active twice for one horizontal period, the electric potential of the video signal line 106HS may be set to the signal electric potential ($=V_{ofs}+V_{in}$) in accordance with which the luminance in the organic EL element 127 is controlled while the sampling transistor 125 is held in the ON state.

For example, in a time zone for which the electric potential of the power source supply line 105DSL is held at the first electric potential, and the electric potential of the video signal line 106HS is held at the reference electric potential ($V_{ofs}$) of the video signal $V_{sig}$ within the invalid period, the vertical drive portion 103 outputs the write drive pulse WS as a control signal in accordance with which the sampling transistor 125 is caused to conduct, and holds the voltage corresponding to the threshold voltage $V_{th}$ of the drive transistor 121 in the hold capacitor 120. This operation realizes the threshold voltage correcting function. The influence of the threshold voltage $V_{th}$ of the drive transistor 121 which is dispersed every pixel circuit 10 can be canceled by the threshold voltage correcting function.

It is only necessary for the vertical driving portion 103 to repetitively carry out the threshold correcting operation for plural horizontal periods preceding the sampling of the signal amplitude $V_{in}$, thereby reliably holding the voltage corresponding to the threshold voltage $V_{th}$ of the drive transistor 121 in the hold capacitor 120. A sufficiently long write time is ensured by carrying out the threshold voltage correcting operation plural times. As a result, the voltage corresponding to the threshold voltage $V_{th}$ of the drive transistor 121 can be previously, reliably held in the hold capacitor 120.

The voltage corresponding to the threshold voltage $V_{th}$ held in the hold capacitor 120 is used to cancel the threshold voltages $V_{th}$ of the drive transistors 121. Therefore, even when the threshold voltages $V_{th}$ of the drive transistors 121 is dispersed in the respective pixel circuits 10, since the dispersion of the threshold voltages $V_{th}$ can be perfectly canceled in the pixel circuits 10, the uniformity of the image, that is, the uniformity of the emission luminance over the entire picture of the display is enhanced. In particular, it is possible to prevent the luminance nonuniformity which is apt to appear when the signal electric potential corresponds to the low gradation.

Preferably, prior to the threshold voltage correcting operation, in a time zone for which the electric potential of the power source supply line 105DSL is held at the second electric potential $V_{cc_L}$, and the electric potential of the video signal line 106HS is held at the reference electric potential ($V_{ofs}$) of the video signal $V_{sig}$ within the invalid period, the vertical drive portion 103 makes the write drive pulse WS active (the H level in this case) to cause the sampling transistor 125 to conduct. After that, the vertical drive portion 103 sets the electric potential of the power source supply line 105DSL to the first electric potential $V_{cc_H}$ while the write drive pulse WS is held at the active H level.

As a result, after the source electric potential $V_s$ at the source terminal S of the drive transistor 121 has been set to the second electric potential $V_{cc_L}$ sufficiently lower than the reference electric potential ($V_{ofs}$) (a discharge period C=a second node initialization period), and the gate electric potential $V_g$ at the gate terminal G of the drive transistor 121 has been set to the reference electric potential ($V_{ofs}$) (an initialization period D=a first node initialization period), the threshold voltage correcting operation is started (a threshold voltage correction period E). By carrying out such an operation for resetting the gate electric potential and the source electric potential (initialization operation), it is possible to reliably carry out the threshold voltage correcting operation following the initialization operation by carrying out such a resetting operation (initializing operation) for the gate electric potential $V_g$ and the source electric potential $V_s$. A combination of the discharge period C and the initialization period D is referred to as "a threshold voltage correction preparation period as well (=a preprocessing period) for which both of the gate electric potential $V_g$ and source electric potential $V_s$ of the drive transistor 121 are initialized."

For the threshold voltage correction period E, the electric potential of the power source supply line 105DSL transits from the second electric potential $V_{cc_L}$ on the low electric potential side to the first electric potential $V_{cc_H}$ on the high electric potential side, whereby the source electric potential $V_s$ of the drive transistor 121 starts to rise. That is to say, the gate electric potential $V_g$ at the gate terminal G of the drive transistor 121 is held at the reference electric potential ($V_{ofs}$) of the video signal $V_{sig}$. Thus, the drain current $I_{ds}$ is attempting to flow until the source electric potential $V_s$ at the source terminal of the drive transistor 121 rises to cut off the drive transistor 121.

When the drive transistor 121 is cut off, the source electric potential $V_s$ at the source terminal of the drive transistor 121 becomes equal to "$V_{ofs}-V_{th}$." For the threshold voltage correction period E, in order that the drain current $I_{ds}$ may be exclusively caused to flow through the hold capacitor 120 side (in a phase of $C_{CS} \ll C_{el}$) and may be prohibited from being caused to flow through the organic EL element 127 side, an electric potential $V_{cath}$ of a grounding wiring cath common to all of the pixels is set in such a way that the organic EL element 127 is cut off.

The equivalent circuit of the organic EL element 127 is represented as a parallel circuit of a diode and the parasitic capacitance $C_{el}$. Therefore, the drain current $I_{ds}$ of the drive transistor 121 is used to charge both of the hold capacitor 120 and the parasitic capacitance $C_{el}$ as long as an electric potential relationship of "$V_{el} \leq V_{cath}+V_{thEL}$" holds, in a word, as long as a leakage current of the organic EL element 127 is considerably smaller than a current caused to flow through the drive transistor 121. As a result, a voltage $V_{el}$ at the anode terminal A of the organic EL element 127, in a word, an electric potential at the node ND122 rises with time. Also, at the time when an electric potential difference between the electric potential at the node ND122 (the source electric potential $V_s$) and the voltage at the node ND121 (the gate electric potential $V_g$) has been just equal to the threshold voltage $V_{th}$, the drive transistor 121 is switched from the ON state over to the OFF state, and thus the drain current $I_{ds}$ is prohibited from being caused to flow. As a result, the threshold voltage correction period E is ended. In a word, after a lapse of a given time, the gate-to-source voltage $V_{gs}$ of the drive transistor 121 takes a value of the threshold voltage $V_{th}$.

Here, although the threshold voltage correcting operation can also be carried out only once, this is not essential to the present disclosure. One horizontal period is set as a processing cycle, and the threshold voltage correcting operation may also be repetitively carried out plural times. For example, actually, the voltage corresponding to the threshold voltage $V_{th}$ is written to the hold capacitor 120 connected between the gate terminal G and the source terminal S of the drive transistor 121. However, the threshold voltage correction period E ranges from the timing at which the write drive pulse WS is set at the active H level to the timing at which the write drive pulse WS is returned back to the inactive L level. Thus, when this period of time is not sufficiently ensured, the threshold voltage correcting operation is ended in and after this period of time. For the purpose of solving this problem, it is only necessary to repetitively carry out the threshold voltage correcting operation plural times. An illustration of the timing concerned is omitted here for the sake of simplicity.

The reason why when the threshold voltage correcting operation is carried out plural times, one horizontal period becomes the processing cycle for the threshold voltage correcting operation is because the initializing operation for supplying the reference electric potential ($V_{ofs}$) through the video signal line 106HS in the first-half portion of one horizontal period to set the source electric potential $V_s$ to the second electric potential $V_{cc_L}$ is carried out prior to the threshold voltage correcting operation. Necessarily, the threshold voltage correction period E becomes shorter than one horizontal period. Therefore, there may be caused the case where the accurate voltage corresponding to the threshold voltage $V_{th}$ is too large to be held in the hold capacitor 120 for the short threshold voltage correcting operation period E for one time due to the magnitude relationship between the electrostatic capacitance $C_{CS}$ of the hold capacitor 120, and the second electric potential $V_{cc_L}$ and other causes. The reason why the threshold voltage correcting operation is preferably carried out plural times is because it is necessary to cope with this situation. That is to say, preferably, the threshold voltage correcting operation is repetitively carried out for plural horizontal periods preceding the sampling (signal writing) of the signal amplitude $V_{in}$ to the hold capacitor 120, whereby the voltage corresponding to the threshold voltage $V_{th}$ of the drive transistor 121 is reliably held in the hold capacitor 120.

The pixel circuit 10 includes the mobility correcting function in addition to the threshold voltage correcting function. That is to say, in order that the sampling transistor 125 may be made the conduction state in a time zone for which the electric potential of the video signal line 106HS is held at the signal electric potential "$V_{ofs}+V_{in}$" of the video signal $V_{sig}$ in the valid period, the vertical driving portion 103 makes the write drive pulse WS, which is supplied to the write scanning line 104WS, at the active H level only for a period of time shorter than that time zone. For this period of time, in a state in which the signal electric potential ($V_{ofs}+V_{in}$) is supplied to the control input terminal of the drive transistor 121, both of the parasitic capacitance $C_{el}$ of the organic EL element 127, and the hold capacitor 120 are charged with the electricity through the drive transistor 121. An active period (corresponding not only to a sampling period, but to a mobility correction period) of the write drive pulse WS is suitably set, whereby when the information on the signal amplitude $V_{in}$ is held in the hold capacitor 120, at the same time, it is possible to correct the mobility μ of the drive transistor 121. The signal electric potential ($V_{ofs}+V_{in}$) is actually supplied to the video signal line 106HS by the horizontal driving portion 106, whereby a period of time for which the write drive pulse WS is made at the active H level is set as a period of time for which the information on the signal amplitude $V_{in}$ is written to the hold capacitor 120 (referred to as "the sampling period" as well).

In particular, at the drive timing in the pixel circuit 10, in a time zone for which the electric potential of the power source supply line 105DSL is held at the first electric potential $V_{cc_H}$ as the high electric potential side, and the video signal $V_{sig}$ is held in the valid period (a period of time of the signal amplitude $V_{in}$), the write drive pulse WS is made at the active H level. In a word, as a result, the mobility correction time (and the sampling period as well) is determined depending on a region in which a time width for which the electric potential of the video signal line 106HS is held at the signal electric potential ($V_{ofs}+V_{in}$) of the video signal $V_{sig}$ in the valid period, and the active period of the write drive pulse WS overlap each other. In particular, a width of the active period of the write drive pulse WS is narrowly determined so as to fall in a time width in which the electric potential of the video signal line 106HS is held at the signal electric potential, which results in that the mobility correction time is determined depending on the write drive pulse WS. Exactly, the mobility correction time (and the sampling period as well) becomes a time ranging from a time point at which the write drive pulse WS rises to turn ON the sampling transistor 125 to a time point at which the write drive pulse WS falls to turn OFF the sampling transistor 125.

Specifically, for the sampling period, in a state in which the gate electric potential $V_g$ of the drive transistor 121 is held at the signal electric potential ($V_{ofs}+V_{in}$) the sampling transistor 125 becomes the conduction (ON) state. Therefore, for the write and mobility correction period H, in a state in which the gate electric potential $V_g$ of the drive transistor 121 is fixed to the signal electric potential ($V_{ofs}+V_{in}$), the drive current $I_{ds}$ is caused to flow through the drive transistor 121. The information on the signal amplitude $V_{in}$ is held in the form of being added to the threshold voltage $V_{th}$ of the drive transistor 121. As a result, since the change in the threshold voltage $V_{th}$ of the drive transistor 121 is usually canceled, the threshold voltage correction is carried out. By carrying out the threshold voltage correction, the gate-to-source voltage $V_{gs}$ held in the hold capacitor 120 becomes equal to "$V_{sig}+V_{th}$"="$V_{in}+V_{th}$." In addition, at the same time, since the mobility correction is carried out for the sampling period, the sampling period serves as the mobility correction period as well (the write and mobility correction period H).

Here, when let $V_{thEL}$ be a threshold voltage of the organic EL element 127, the threshold voltage $V_{thEL}$ is set so as to fulfill an electric potential relationship of "$V_{ofs}-V_{th}<V_{thEL}$." As a result, since the organic EL element 127 is held in a reversely-biased state and thus held in a cut-off state (high impedance state), the organic EL element 127 is prevented from emitting a light, and thus does not offer diode characteristics, but offers simple capacitance characteristics. Therefore, the drain current (the drive current $I_{ds}$) caused to flow through the drive transistor 121 is written to a capacitance "$C=C_{CS}+C_{el}$" which is obtained by adding the electrostatic capacitance $C_{CS}$ of the hold capacitor 120 to the parasitic capacitance (equivalent capacitance) $C_{el}$ of the organic EL element 127. As a result, the drain current of the drive transistor 121 is caused to flow into the parasitic capacitance $C_{el}$ of the organic EL element 127 to start the charging operation. As a result, the source electric potential $V_s$ of the drive transistor 121 rises.

In the timing chart shown in FIG. 8, a rise amount of source electric potential $V_s$ is represented by ΔV. The rise amount of source electric potential $V_s$, that is, an electric potential correction value ΔV as a mobility correction parameter is subtracted from the gate-to-source voltage "$V_{gs}=V_{in}+V_{th}$" held in the hold capacitor 120 through the threshold voltage correction to become "$V_{gs}=V_{in}+V_{th}-\Delta V$," which results in that the negative feedback is carried out. At this time, the source electric potential $V_s$ at the source terminal S of the drive transistor 121 becomes equal to "$-V_{th}+\Delta V$" which is obtained by subtracting the voltage "$V_{gs}=V_{in}+V_{th}-\Delta V$" held in the hold capacitor 120 from the gate electric potential $V_g$ ($=V_{in}$).

In such a manner, at the driving timing in the pixel circuit 10, for the write and mobility correction period H, both of the sampling of the signal amplitude $V_{in}$, and the rise amount $\Delta V$ of source electric potential $V_s$ (the amount of negative feedback or the mobility correction parameter) with which the mobility $\mu$ is corrected are adjusted. The write scanning portion 104 can adjust a time width of the write and mobility correction period H. As a result, it is possible to optimize the amount of negative feedback of the drive current $I_{ds}$ for the hold capacitor 120.

The voltage correction value $\Delta V$ is expressed by Expression (7):

$$\Delta V \approx I_{ds} \times t / C_{el} \tag{7}$$

As apparent from Expression (7), the voltage correction value $\Delta V$ becomes larger as the drive current $I_{ds}$ as the drain-to-source current of the drive transistor 121 is larger. Contrary to this, when the drive current $I_{ds}$ of the drive transistor 121 is small, the voltage correction value $\Delta V$ becomes small. In such a manner, the voltage correction value $\Delta V$ is determined depending on the drive current $I_{ds}$. As the signal amplitude $V_{in}$ is larger, the drive current $I_{ds}$ becomes larger and an absolute value of the voltage correction value $\Delta V$ also becomes larger. Therefore, it is possible to realize the mobility correction corresponding to the emission luminance level. In this case, the write and mobility correction period H is not necessarily constant, and contrary is preferably adjusted in accordance with the drive current $I_{ds}$ in some cases. For example, it is only necessary that when the drive current $I_{ds}$ is large, a mobility correction period, t, of time is set short. Contrary to this, it is only necessary that when the drive current $I_{ds}$ is small, the write and mobility correction period H is set long.

In addition, the electric potential correction value $\Delta V$ is expressed by $I_{ds} \times t/C_{el}$. Thus, even when the drive current $I_{ds}$ is dispersed due to the dispersion of the mobilities $\mu$ in the pixel circuits 10, the electric potential correction values $\Delta V$ are obtained so as to correspond to the respective cases. Therefore, it is possible to correct the dispersion of the mobilities $\mu$ in the pixel circuits 10. In a word, when the signal amplitude $V_{in}$ is made constant, the absolute value of the electric potential correction value $\Delta V$ becomes larger as the mobility $\mu$ of the drive transistor 121 is larger. In other words, since the electric potential correction value $\Delta V$ becomes larger as the mobility $\mu$ is larger, it is possible to remove the dispersion of the mobilities $\mu$ in the pixel circuits 10.

The pixel circuit 10 includes the bootstrap function as well. That is to say, in a stage in which the information on the signal amplitude $V_{in}$ is held in the hold capacitor 120, the write scanning portion 104 releases the application of the write drive pulse WS to the write scanning line 104WS (that is, sets the electric potential of the write drive pulse WS to the inactive L level) to set the sampling transistor 125 in the non-conduction state, thereby electrically separating the gate terminal G of the drive transistor 121 from the video signal line 106HS (a light emission period I). When the operation proceeds to the light emission period I, the horizontal driving portion 106 returns the electric potential of the video signal line 106HS back to the reference electric potential ($V_{ofs}$) at the following suitable time point.

The light emission state of the organic EL element 127 continues up to an (m+m'−1)-th horizontal scanning period. With that, the operation of the light emission of the organic EL element 127 composing the (n, m)-th sub-pixel is completed. After that, the operation is moved to a next frame (or a next field), and the threshold voltage correction preparing operation, the threshold voltage correcting operation, the mobility correcting operation, and the light emitting operation are repetitively carried out again.

Here, for the light emission period I, the gate terminal G of the drive transistor 121 is disconnected from the horizontal signal line 106HS. Since the application of the signal electric potential ($V_{ofs}+V_{in}$) to the gate terminal G of the drive transistor 121 is released, the gate electric potential $V_g$ of the drive transistor 121 can rise. The hold capacitor 120 is connected between the gate terminal G and the source terminal S of the drive transistor 121, and the bootstrap operation is carried out based on the effect by the hold capacitor 120. When the bootstrap gain is assumed to be 1 (ideal value), the gate electric potential $V_g$ is changed in conjunction with the change in the source electric potential $V_s$ of the drive transistor 121, and thus the gate-to-source voltage $V_{gs}$ can be maintained constant. At this time, the drive current $I_{ds}$ caused to flow through the drive transistor 121 is also caused to flow through the organic EL element 127, and thus the anode electric potential of the organic EL element 127 rises in accordance with the drive current $I_{ds}$. Let $V_{el}$ be an amount of anode electric potential thus risen. In a short time, since the reverse bias state of the organic EL element 127 is canceled along with the rise of the source electric potential $V_s$, the organic EL element 127 actually starts to emit the light by the inflow of the drive current $I_{ds}$.

Here, a relationship of the drive current $I_{ds}$ vs. the gate voltage $V_{gs}$ can be expressed in the form of either Expression (8) or (9) by subtracting either "$V_{sig}+V_{th}-\Delta V$" or "$V_{in}+V_{th}-\Delta V$" into Expression (1) expressing the former transistor characteristics:

$$I_{ds}=k\times\mu\times(V_{sig}-V_{ofs}-\Delta V)^2 \tag{8}$$

$$I_{ds}=k\times\mu\times(V_{in}-V_{ofs}-\Delta V)^2 \tag{9}$$

It is understood from both of Expressions (8) and (9) that the term of the threshold voltage $V_{th}$ is canceled, and thus the drive current $I_{ds}$ supplied to the organic EL element 127 is independent of the threshold voltage $V_{th}$ of the drive transistor 121. That is to say, when the reference electric potential $V_{ofs}$ is set to, for example, 0 V, the drive current $I_{ds}$ caused to flow through the organic EL element 127 is proportional to a square of a value which is obtained by subtracting the value of the electric potential correction value $\Delta V$ in the second node $ND_2$ (the source terminal of the drive transistor 121) due to the mobility $\mu$ of the drive transistor 121 from the value of the video signal $V_{sig}$ in accordance with which the luminance in the organic EL element 127 is controlled. In other words, the current $I_{ds}$ caused to flow through the organic EL element 127 is independent of both of the threshold voltage $V_{thEL}$ of the organic EL element 127, and the threshold voltage $V_{th}$ of the drive transistor 121. That is to say, an amount of light emission (luminance) of the organic EL element 127 does not suffer both of an influence of the threshold voltage $V_{thEL}$ of the organic EL element 127, and an influence of threshold voltage $V_{th}$ of the drive transistor 121. Also, the luminance of the (n, m)-th organic EL element 127 has a value corresponding to the current $I_{ds}$.

In addition thereto, since the electric potential correction value $\Delta V$ becomes larger in the drive transistor 121 having the larger mobility $\mu$, the value of the gate-to-source voltage $V_{gs}$ becomes smaller. Therefore, even when the value of the mobility $\mu$ is large in both of Expressions (8) and (9), a value of $(V_{sig}-V_{ofs}-\Delta V)^2$ is small. As a result, it is possible to correct the drain current $I_{ds}$. That is to say, if the values of the video signals $V_{sig}$ are identical to one another even in drive transistors 121 different in mobility μ from one another, the values of the drain currents $I_{ds}$ become approximately equal to one another. As a result, the currents $I_{ds}$ which are caused to flow through the respective organic EL elements 127, and in accordance with which the luminances of the organic EL elements 127 are controlled are uniformized. That is to say, it is possible to correct the dispersion of the luminances in the organic EL elements 127 due to the dispersion of the mobilities μ(and the dispersion of k).

In addition, the hold capacitor 120 is connected between the gate terminal G and the source terminal S of the drive transistor 121. Thus, the bootstrap operation is carried out in the first part of the light emission period based on the effect by the hold capacitor 120, and both of the gate electric potential $V_g$ and the source electric potential $V_s$ of the drive transistor 121 rise while the gate-to-source voltage "$V_{gs}=V_{in}+V_{th}-\Delta V$" of the drive transistor 121 is maintained constant. The source electric potential $V_s$ of the drive transistor 121 becomes equal to "$-V_{th}+\Delta V+V_{el}$." whereby the gate electric potential $V_g$ becomes equal to "$V_{in}+V_{el}$." At this time, since gate-to-source voltage $V_{gs}$ of the drive transistor 121 is held constant, the drive transistor 121 causes the constant current (the drive current $I_{ds}$) to flow through the organic EL element 127. As a result, the electric potential (=the electric potential at the node ND122) at the anode terminal A of the organic EL element 127 continuously rises until a voltage with which a current as the drive current $I_{ds}$ in the saturated state is caused to flow through the organic EL element 127.

Here, when the light emission period becomes long, the I-V characteristics of the organic EL element 127 are changed accordingly. For this reason, the electric potential at the node ND122 is also changed with a lapse of time. However, even when the anode electric potential of the organic EL element 127 is changed due to such temporal deterioration of the organic EL element 127, the gate-to-source voltage $V_{gs}$ held in the hold capacitor 120 is usually maintained at a constant voltage of "$V_{in}+V_{th}-\Delta V$." Since the drive transistor 121 is operated as the constant current source, even when the I-V characteristics of the organic EL element 127 suffer the temporal change and the source electric potential $V_s$ at the source terminal S of the drive transistor 121 is changed so as to follow that temporal change, the gate-to-source voltage $V_{gs}$ of the drive transistor 121 is held at the constant voltage ($\approx V_{in}+V_{th}-\Delta V$) by the hold capacitor 120. Therefore, the current caused to flow through the organic EL element 127 is not changed, and thus the emission luminance of the organic EL element 127 is also held constant. Although since actually, the bootstrap gain is smaller than "1," the gate-to-source voltage $V_{gs}$ becomes smaller than "$V_{in}+V_{th}-\Delta V$," it is remained that the gate-to-source voltage $V_{gs}$ is held at the gate-to-source voltage $V_{gs}$ corresponding to the bootstrap gain.

As described above, in each of the pixel circuit 10Z of Comparative Example, and the pixel circuit 10 in the display device 1 of Example 1, the threshold voltage correcting circuit and the mobility correcting circuit are automatically configured by devising the drive timings. Also, the pixel circuit 10 functions as the drive signal fixing circuit for maintaining the drive current constant by correcting the influences by the threshold voltage $V_{th}$ and the mobility μ in order to prevent the influence exerted on the drive current $I_{ds}$ due to the dispersion of the characteristics of the drive transistors 121 (the dispersion of the threshold voltages $V_{th}$ and the carrier mobilities μ in the drive transistors 121 in this case). Since not only the bootstrap operation, but also the threshold voltage correcting operation and the mobility correcting operation are carried out, the gate-to-source voltage $V_{gs}$ maintained by the bootstrap operation is adjusted by both of the voltage corresponding to the threshold voltage $V_{th}$, and the electric potential correction value ΔV for the mobility correction. Therefore, the emission luminance of the organic EL element 127 does not suffer either the influence of the dispersions of the threshold voltages $V_{th}$ and the carrier mobilities μ in the drive transistors 121, or the influence of the temporal deterioration of the organic EL element 127. Thus, the image can be displayed with the stable gradation(s) corresponding to the video signal $V_{sig}$ (the signal amplitude $V_{in}$) inputted and thus it is possible to obtain the image having the high image quality.

In addition, since the pixel circuit 10 can be composed of the source follower circuit using the re-channel drive transistor 121, even when the existing organic EL element having the anode and cathode electrodes is used as it is, the driving for the organic EL element 127 becomes possible. In addition, the pixel circuit 10 can be composed by using the transistors each of which is only of the n-channel type, including the drive transistor 121, and the sampling transistor 125 and the like of the peripheral portion, and thus the cost saving is realized even in the manufacture of the transistors.

[Cause of Display Nonuniformity Phenomenon]

Figure 9A:
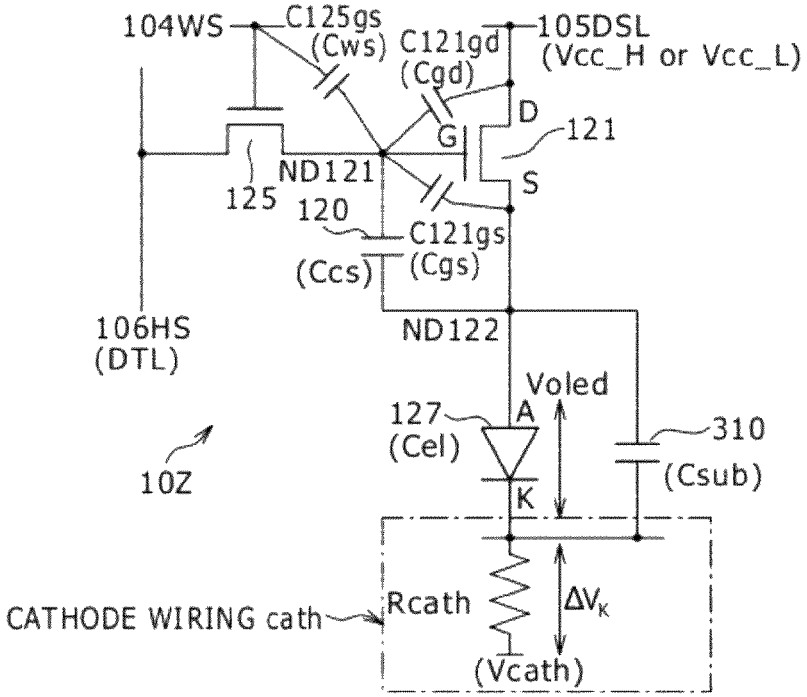
FIGS. 9A and 9B are respectively circuit diagrams explaining a display nonuniformity phenomenon generated in the display device of Comparative Example of Example 1 of the first embodiment of the present disclosure.
Figure 9B:
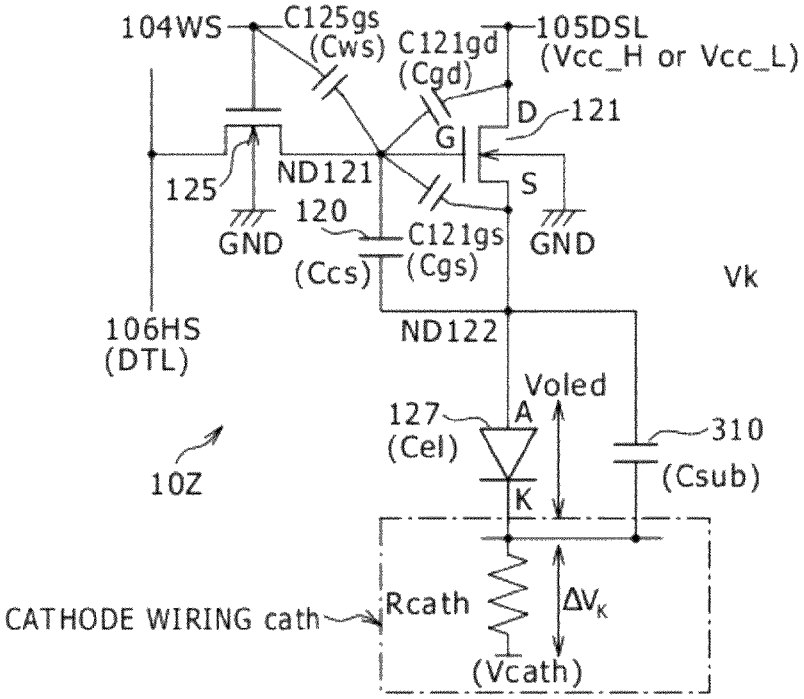

FIGS. 9A and 9B, and FIGS. 10A to 10C are respectively diagrams explaining the display nonuniformity phenomenon generated in the display device 1Z of Comparative Example. Here, FIG. 9A is a circuit diagram showing one pixel circuit 10Z in the display device 1Z of Comparative Example. In FIG. 9A, each of the transistors is a Thin Film Transistor (TFT). FIG. 9B is a circuit diagram showing a configuration in which each of the transistors in the pixel circuit 10Z in the display device 1Z of Comparative Example is replaced of a MOSFET. In FIG. 9B, the back-gate functioning as the transistor characteristics control terminal is connected to the grounding line GND.

Figure 10A:
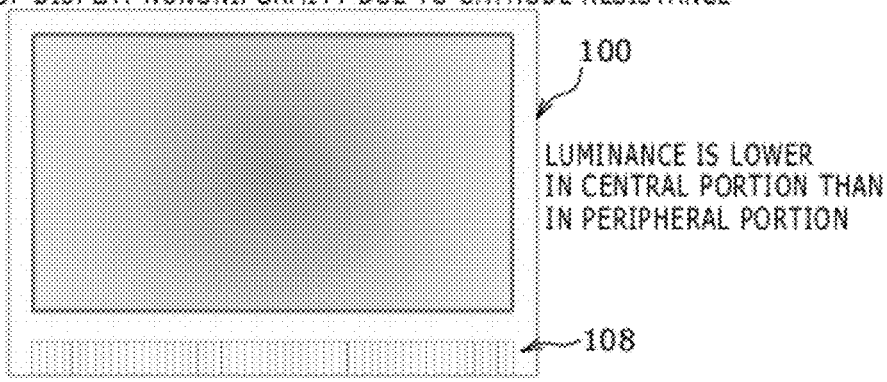
FIGS. 10A, 10B, and 10C are respectively a view, a circuit diagram, and a diagram explaining the display nonuniformity phenomenon generated in the display device of Comparative Example of Example 1 of the first embodiment of the present disclosure.
Figure 10B:
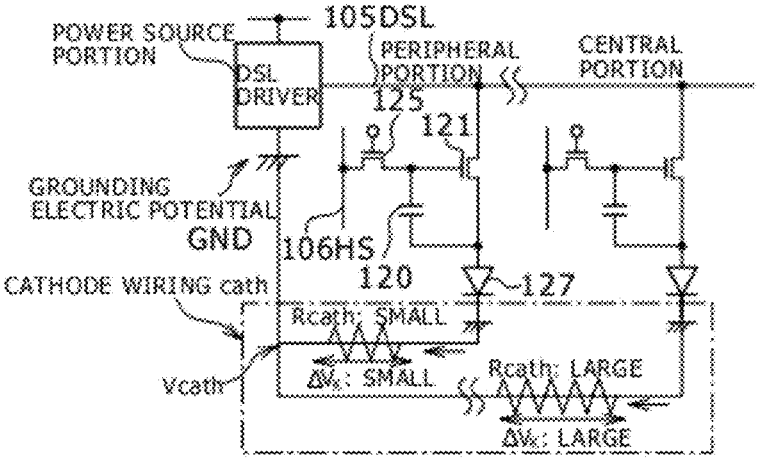
Figure 10C:
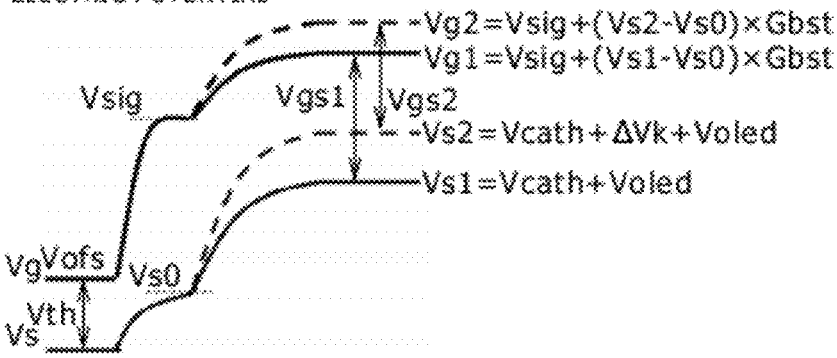

FIGS. 10A, 10B, and 10C are respectively a view and diagrams explaining the display nonuniformity due to the wiring resistance (a cathode resistance $R_{cath}$) of the cathode wiring cath in Comparative Example. Here, FIG. 10A is a view showing an example of the display nonuniformity when an overall uniform image is displayed. Also, FIGS. 10B and 10C are respectively a circuit diagram and a diagram explaining the principles of generation of the display nonuniformity.

Each of the drive currents $I_{ds}$ in the pixel circuits 10Z is caused to flow into the cathode wiring cath (the grounding as an example) which is common to all of the pixels and through which the reference electric potential is supplied. Here, a cathode resistance $R_{cath}$ of a panel central portion becomes about several tens to about several hundreds of ohms higher than that of a peripheral portion (refer to FIG. 10B). Therefore, even when the overall uniform image is displayed, the degree of increasing of the cathode electric potential itself of the organic EL element 127 has the intra-surface distribution in relation to the wiring resistance (the cathode resistance $R_{cath}$) of the cathode wiring cath. As a result, the emission luminance is changed depending on the cathode electric potential (specifically, a difference depending on the pixel positions), and thus the gradation-like nonuniformity is caused owing to the cathode resistance distribution within the panel. As an example, when the cathode resistance of the panel central portion is 250 ohms higher than that of the peripheral portion and as a result, the voltage is increased by 50 millivolts, the luminance is reduced by 2%. If the video signals having the same level are supplied to all of the pixels composing the screen, all of the pixels emit lights with the same luminance and thus the uniformity of the picture ought to be obtained. However, even when the threshold voltage correction and the mobility correction are carried out, the display nonuniformity is caused owing to the cathode resistance, which impairs the uniformity of the picture. Specifically, since the cathode resistance $R_{cath}$ is higher in the central portion than in the peripheral portion, the increase of the cathode electric potential of the peripheral portion is small and the luminance thereof is high, whereas the increase of the cathode electric potential of the central portion is large and the luminance thereof is low. In general, since the visibility level of the luminance difference falls within 1%, it is required to take measures so as to fulfill this visibility level. In addition, since the floating of the cathode electric potential differs depending on the drive current $I_{ds}$ in a word, the gradation, the γ-characteristics differ every gradation. Thus, in the case of the color display, the generation of the color drift is feared.

The cause by which the luminance is reduced when the cathode electric potential become high will be described in more detail with reference to FIGS. 9A and 9B, and FIG. 10C. Firstly, a relationship between the write gain $G_{in}$ and the bootstrap gain $G_{bst}$ will be described with reference to FIGS. 9A and 9B. FIGS. 9A and 9B show the parasitic capacitances parasitic in the gate terminal G of the drive transistor 121. In this case, as an example, a parasitic capacitance C121$_{gs}$ (an electrostatic capacitance thereof is taken to be $C_{gs}$) formed between the gate terminal G and the source terminal S of the drive transistor 121, a parasitic capacitance C121$_{gd}$ (an electrostatic capacitance thereof is taken to be $C_{gd}$) formed between the gate terminal G and the drain terminal D of the drive transistor 121, and a parasitic capacitance C125$_{gs}$ (an electrostatic capacitance thereof is taken to be $C_{WS}$) formed between the gate terminal G and the source terminal S (the drain terminal D when the source terminal S is set on the video signal line 106HS side), as a diffusion capacitance of the sampling transistor 125, are shown as the parasitic capacitances on the assumption that these parasitic capacitances exist so as to be parasitic in the gate terminal G of the drive transistor 121.

In a phase of the operation for writing the signal in the sampling period and the mobility correction period, how to largely write the information on the signal electric potential $V_{in}$ to the hold capacitor 120 becomes important. A ratio of the size of the information on the signal electric potential $V_{in}$ written to the hold capacitor 120 is referred to as a write gain $G_{in}$. For the sampling period and the mobility correction period, the signal writing (sampling) is carried out in a state in which the power source drive pulse DSL is held at the first electric potential $V_{cc_H}$. Therefore, at the moment the writing operation is started and thus the gate electric potential $V_g$ of the drive transistor 121 rises, the drive current $I_{ds}$ is caused to flow between the drain terminal D and the source terminal S, and thus the parasitic capacitance $C_{el}$ of the organic EL element 127 is charged based on the drive current $I_{ds}$, so that the source electric potential $V_s$ rises. In order to efficiently take the luminance for the signal electric potential $V_{in}$ of the video signal $V_{sig}$, it is only necessary that the ratio (the write gain $G_{in}$) of the voltage held in the hold capacitor 120 having the electrostatic capacitance $C_{CS}$ to the video signal $V_{sig}$ (the signal electric potential $V_{in}$) under the condition that the drive current $I_{ds}$ is caused to flow with the rise in the gate electric potential $V_g$ of the drive transistor 121 in the phase of the signal writing and the source electric potential $V_s$ does not rise, that is, in a situation in which the source electric potential $V_s$ of the drive transistor 121 is low in the phase of the signal writing is made high as much as possible. The write gain $G_{in}$ under such a condition can be expressed by Expression (10):

$$G_{in} = C2/(C1 + C2) \tag{10}$$

$$= (C_{cs} + C_{gs})/\{(C_{cs} + C_{gs}) + C_{el}\}$$

where $C_{CS}$ is the electrostatic capacitance of the hold capacitor 120, $C_{gs}$ is the electrostatic capacitance of the parasitic capacitance C121$_{gs}$ formed in the gate terminal G of the drive transistor 121, and $C_{el}$ is the electrostatic capacitance of the parasitic capacitance $C_{el}$ of the organic EL element 127. When the subsidiary capacitor 310 is taken into consideration, it is only necessary to replace $C_{el}$ with "$C_{el}$+$C_{sub}$."

It may be thought that the electrostatic capacitance $C_{gs}$ of the parasitic capacitance C121$_{gs}$ is smaller than each of the electrostatic capacitance $C_{CS}$ of the hold capacitor 120, and the parasitic capacitance $C_{el}$ of the organic EL element 127. Therefore, if the parasitic capacitance $C_{el}$ of the organic EL element 127 is sufficiently larger than the electrostatic capacitance $C_{CS}$ of the hold capacitor 120, in other words, if the capacitance value (the electrostatic capacitance $C_{CS}$ of the hold capacitor 120 in this case) added between the gate terminal G and the source terminal S of the drive transistor 121 is made small, or the capacitance value (the parasitic capacitance $C_{el}$ of the organic EL element 127 in this case) added between the source terminal S of the drive transistor 121 (in a word, the anode terminal A of the organic EL element 127) and the cathode writing cath (in a word, the cathode terminal K of the organic EL element 127) is made large, then, the write gain $G_{in}$ becomes close to "1" without limit. As a result, the information on the voltage closer to the magnitude of the signal electric potential $V_{in}$ can be written to the hold capacitor 120.

On the other hand, for the light emission period for which the bootstrap operation functions, since the hold capacitor 120 is connected between the gate terminal G and the source terminal S of the drive transistor 121, in a phase of rise of the source electric potential V, the coupling voltage is applied to the gate terminal G of the drive transistor 121. The luminance reduction in the phase of rise of the drive voltage following the characteristics change (including the deterioration) of the organic EL element 127 is suppressed as the rate of the coupling to the gate electric potential $V_g$ relative to the rise of the source electric potential $V_s$ is closer to 100%. A rate of the rise of the gate electric potential $V_g$ to the rise of the source electric potential $V_s$ is referred to as the bootstrap gain $G_{bst}$ (bootstrap operating ability). The bootstrap gain $G_{bst}$ can be expressed by Expression (11):

$$G_{bst} = C2/(C2 + C3) \tag{11}$$

$$= (C_{cs} + C_{gs})/\{(C_{cs} + C_{gs}) + (C_{gd} + C_{ws})\}$$

where $C_{CS}$ is the electrostatic capacitance of the hold capacitor 120, $C_{gs}$ is the electrostatic capacitance of the parasitic capacitance C121$_{gs}$ formed in the gate terminal G of the drive transistor 121, and C3 is the electrostatic capacitance of the parasitic capacitance parasitic in the gate terminal G of the drive transistor 121 (for example, the electrostatic capacitance $C_{gd}$ of the parasitic capacitance C121$_{gd}$ and the electrostatic capacitance $C_{WS}$ of the parasitic capacitance C125$_{gs}$).

Therefore, when each of the electrostatic capacitance $C_{gd}$ of the parasitic capacitance C121$_{gd}$ and the electrostatic capacitance $C_{WS}$ of the parasitic capacitance C125$_{gs}$ are sufficiently smaller than the electrostatic capacitance $C_{CS}$ of the hold capacitor 120, in other words, as the value of the capacitance (the electrostatic capacitance $C_{CS}$ in this case) added between the gate terminal G and the source terminal S of the drive transistor 121 is larger, the bootstrap gain $G_{bst}$ is close to "1" without limit. Thus, the correcting ability of the drive current $I_{ds}$ for the temporal change of the current-voltage characteristics of the organic EL element 127 is high. In a word, in developing the system with which the threshold voltage correcting operation and mobility correcting operation for suppressing the luminance change due to the dispersion of the characteristics of the elements are realized while the pixel circuit is simplified, the pixel circuit 10 is configured in which the elements other than the hold capacitor 120 connected to the gate terminal G of the drive transistor 121 are limited to only the minimum sampling transistor 125, whereby the parasitic capacitance parasitic in the gate terminal G of the drive transistor 121 can be made small without limit. This subsidizes the bootstrap operation, thereby making it possible to enhance the subsidizing ability of the drive current $I_{ds}$ for the temporal change of the current-voltage characteristics of the organic EL element 127.

Here, when the large bootstrap gain $G_{bst}$ is attempted to be obtained and the large electrostatic capacitance $C_{CS}$ of the hold capacitor 120 is obtained in terms of the layout, the electrostatic capacitance $C_{CS}$ of the hold capacitor 120 becomes larger than the parasitic capacitance $C_{el}$ of the organic EL element 127, and thus the write gain $G_{in}$ becomes small. When the write gain $G_{in}$ becomes small, in order to write the large information to the hold capacitor 120, it is necessary to take the large dynamic range of the signal electric potential $V_{in}$, which leads to an increase in power consumption. Contrary to this, when the electrostatic capacitance $C_{CS}$ of the hold capacitor 120 is made small in order to take the large write gain $G_{in}$, the electrostatic capacitance $C_{CS}$ of the hold capacitor 120 becomes smaller than each of the electrostatic capacitance $C_{gd}$ of the parasitic capacitance $C\mathbf{121}_{gd}$, and the electrostatic capacitance $C_{CS}$ of the parasitic capacitance $C\mathbf{125}_{gs}$. As a result, the bootstrap gain $G_{bst}$ becomes small, the correction effect for the characteristics change in the organic EL element 127 is reduced, and the luminance reduction in the phase of the characteristics deterioration becomes remarkable. As described above, the write gain $G_{in}$ and the bootstrap gain $G_{bst}$ show a trade-off relationship. Thus, when one of the write gain $G_{in}$ and the bootstrap gain $G_{bst}$ is attempted to be made large, the other becomes small accordingly. Thus, it may be impossible to make one of the write gain $G_{in}$ and the bootstrap gain $G_{bst}$ large without exerting a bad influence on the other (without making the other small). Of course, if a weight is given to one of the write gain $G_{in}$ and the bootstrap gain $G_{bst}$, no attention is forced to be paid to the other gain all the more. Thus, it may be impossible to obtain both of the high gains. For this reason, actually, a balance between the write gain $G_{in}$ and the bootstrap gain $G_{bst}$ is struck, and thus the electrostatic capacitance $C_{CS}$ of the hold capacitor 120, and the electrostatic capacitance $C_{el}$ of the parasitic capacitance $C_{el}$ of the organic EL element 127 are both determined in such a way that the write gain $G_{in}$ and the bootstrap gain $G_{bst}$ become suitable ones.

Let us further consider the case where under such a situation, the actual cathode electric potential $V_k$ is changed owing to the cathode resistance. Although also shown in FIG. 10C, the signal voltage is taken to be $V_{sig}$ ($=V_{ofs}+V_{in}$), the source electric potential $V_s$ after completion of the mobility correction is taken to be $V_{s0}$, the gate electric potential $V_g$ in the phase of the light emission is taken to be $V_{g1}$, and the source electric potential $V_s$ in the phase of the light emission is taken to be $V_{s1}$. Also, the gate electric potential $V_g$ in the phase of the light emission when the cathode electric potential $V_k$ is changed by $\Delta V_k$ due to the cathode resistance is taken to be $V_{g2}$, the source electric potential $V_s$ in the phase of the light emission when the cathode electric potential $V_k$ is changed by $\Delta V_k$ is taken to be $V_{s2}$, and the voltage developed across the opposite terminals of the organic EL element 127 in the phase of the light emission is taken to be $V_{oled}$.

In a normal state in which the cathode electric potential is not changed by $\Delta V_k$ (in a word, the cathode resistance is disregarded), the gate electric potential $V_{g1}$ in the phase of the light emission is expressed by "$V_{sig}+(V_{s1}-V_{s0})\times G_{bst}$" and the source electric potential $V_{s1}$ in the phase of the light emission is expressed by "$V_{cath}+V_{oled}$." Therefore, the gate-to-source voltage $V_{gs2}$ in the phase of the light emission can be expressed by Expression (12):

$$\begin{aligned} V_{gs1} &= V_{g1} - V_{s1} \\ &= V_{sig} + (V_{s1} - V_{s0}) \times G_{bst} - V_{s1} \\ &= V_{sig} - V_{s0} \times G_{bst} + V_{s1} \times G_{bst} - V_{s1} \\ &= V_{sig} - V_{s0} \times G_{bst} + (G_{bst} - 1) \times V_{s1} \\ &= V_{sig} - V_{s0} \times G_{bst} + (G_{bst} - 1) \times (V_{cath} + V_{oled}) \\ &= V_{sig} - V_{s0} \times G_{bst} - (1 - G_{bst}) \times (V_{cath} + V_{oled}) \end{aligned} \tag{12}$$

On the other hand, in a state in which the cathode electric potential $V_k$ is changed (rises) by $\Delta V_k$, the gate electric potential $V_{g2}$ in the phase of the light emission is expressed by "$V_{sig}+(V_{s2}-V_{s0})\times G_{bst}$," and the source electric potential $V_{s2}$ in the phase of the light emission is expressed by "$V_{s1}+\Delta V_k=V_{cath}+V_{oled}+\Delta V_k$." Therefore, the gate-to-source voltage $V_{gs2}$ in the phase of the light emission can be expressed by Expression (13):

$$\begin{aligned} V_{gs2} &= V_{g2} - V_{s2} \\ &= V_{sig} + (V_{s2} - V_{s0}) \times G_{bst} - V_{s2} \\ &= V_{sig} - V_{s0} \times G_{bst} + V_{s2} \times G_{bst} - V_{s2} \\ &= V_{sig} - V_{s0} \times G_{bst} + (G_{bst} - 1) \times V_{s2} \\ &= V_{sig} - V_{s0} \times G_{bst} - (1 - G_{bst}) \times V_{s2} \\ &= V_{sig} - V_{s0} \times G_{bst} - (1 - G_{bst}) \times (V_{cath} + V_{oled} + \Delta V_k) \\ &= V_{sig} - V_{s0} \times G_{bst} - (1 - G_{bst}) \times (V_{cath} + V_{oled}) - \\ &\quad (1 - G_{bst}) \times \Delta V_k \\ &= V_{gs1} - (1 - G_{bst}) \times \Delta V_k \end{aligned} \tag{13}$$

As a result, it is understood that when the cathode electric potential rises by $\Delta V_k$, the gate-to-source voltage $V_{gs}$ in the phase of the light emission is reduced by $(1-G_{bst})\times\Delta V_k$, which results in the luminance being reduced.

[Measures Taken to Cope with Display Nonuniformity Phenomenon]

In the first embodiment of the present disclosure, the threshold voltage $V_{th}$ is increased or decreased by supplying the transistor characteristics control signal Vb to the transistor characteristics control terminal of the drive transistor 121, thereby suppressing the gradation-like display nonuniformity due to the cathode resistance distribution.

Figure 11:
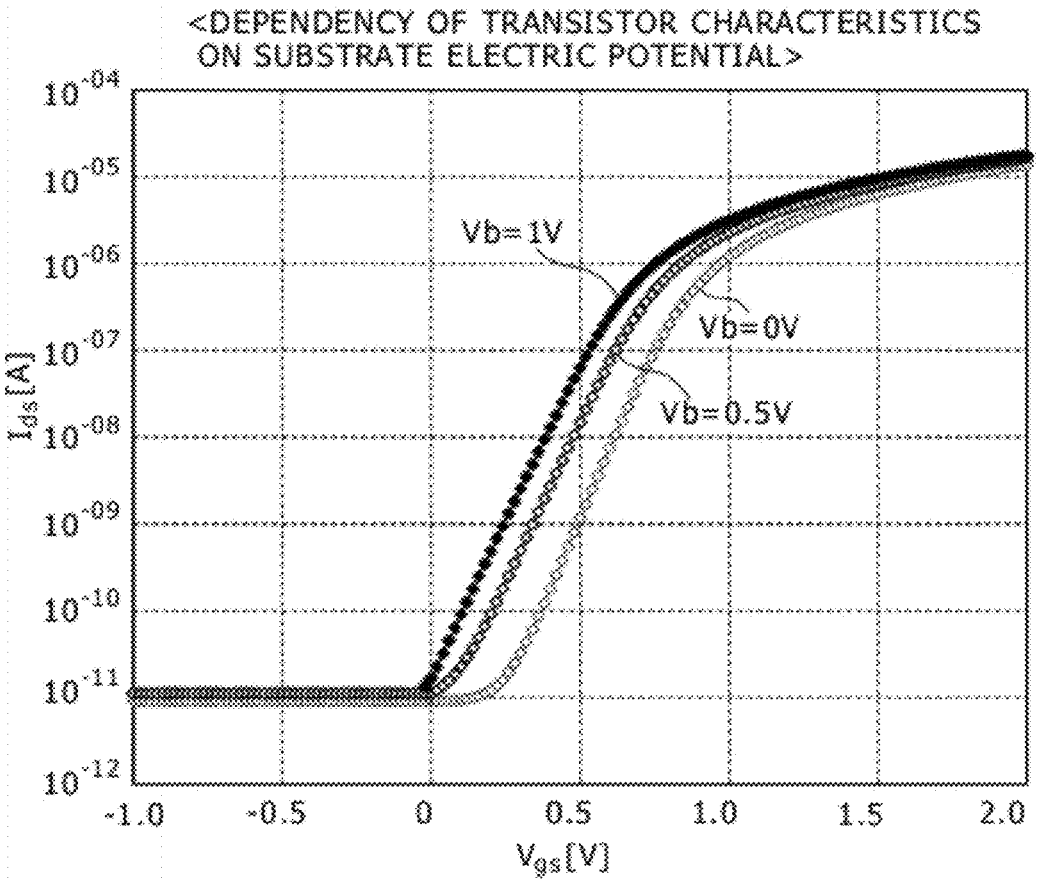
FIG. 11 is a graph explaining the principles of measures taken to cope with the display nonuniformity phenomenon, and also explaining dependency of transistor characteristics on a substrate electric potential.

FIG. 11 is a graph explaining the principles of the measures taken to cope with the display nonuniformity phenomenon due to the cathode resistance distribution, and also explaining dependency of transistor characteristics ($V_{gs}$–$I_{ds}$ characteristics) on a substrate electric potential. As well known, in the back-gate type thin film transistor or the MOS transistor, the transistor characteristics are changed due to the back-gate effect. For example, the MOS transistor is normally treated as a three-terminal device similarly to the case of the bipolar transistor in many cases. However, since the substrate on which the source region and the drain region are formed, or the well should also be thought to be the control terminal (transistor characteristics control terminal), to be exact, the MOS transistor should be treated as a four-terminal device. Also, when the transistor characteristics control signal $V_{sig}$ (referred to as any of "the back-gate voltage," "the substrate electric potential" or "the base electric potential" as well) is applied across the source terminal and the transistor characteristics control terminal (for example, the substrate (referred to as "the body" as well), it is possible to control the transistor characteristics. Normally, the back-gate voltage is applied as a negative voltage in such a way that the diode in operation becomes a cutoff state. For example, when the back-gate voltage is applied, a depletion layer right under a source and drain channels is changed similarly to the case of the diode, and thus the electric potential on the surface of the semiconductor is changed. For this reason, the electric charges accumulated in the depletion layer are different between when the back-gate voltage is applied and when no back-gate voltage is applied, and thus the transistor characteristics ($V_{gs}$–$I_{ds}$ characteristics) are changed as shown in FIG. 11. For this reason, the threshold voltage $V_{th}$ is changed. It is known that when the back-gate effect is taken into consideration, the threshold voltage $V_{th}$ has the characteristics in which the threshold voltage $V_{th}$ is increased in the form of about the square root of the back-gate voltage. In this connection, although in the simple theory, the threshold voltage $V_{th}$ is increased in the form of the square root of the back-gate voltage, even when actually, the increasing of the threshold voltage $V_{th}$ is regarded as the linear increasing, there is no problem in many cases.

As shown in FIG. 11, as the substrate electric potential (in a word, the transistor characteristics control signal Vb) rises, the threshold voltage $V_{th}$ becomes low and is changed in such a way that the more drain current $I_{ds}$ is caused to flow. Therefore, when the transistor characteristics controlling portion 600A is configured in such a way that the transistor characteristics control signal Vb of the drive transistor 121 is set every pixel circuit 10A, so that the transistor characteristics control signal Vb of the drive transistor 121 is made to rise as the cathode electric potential becomes higher toward the panel central portion, the more drain current $I_{ds}$ is caused to flow, thereby making it possible to control the luminance reduction due to the cathode resistance. The luminance reduction is caused due to the rise of the cathode electric potential of the organic EL element 127. However, the transistor characteristics control signal Vb of the drive transistor 121 is made to rise similarly to the case of the cathode electric potential of the organic EL element 127 to shift the threshold voltage $V_{th}$, whereby it is possible to suppress and solve the gradation-like display nonuniformity due to the cathode resistance distribution. The above measure can suppress the luminance difference to 1% or below and the display nonuniformity of gradation is not visible. Therefore, with the above configuration, such problems that displaying the high luminance display is difficult or requires a higher signal voltage are solved.

4-2. Example 2

Connection Between Back-Gate and Cathode

Figure 12:
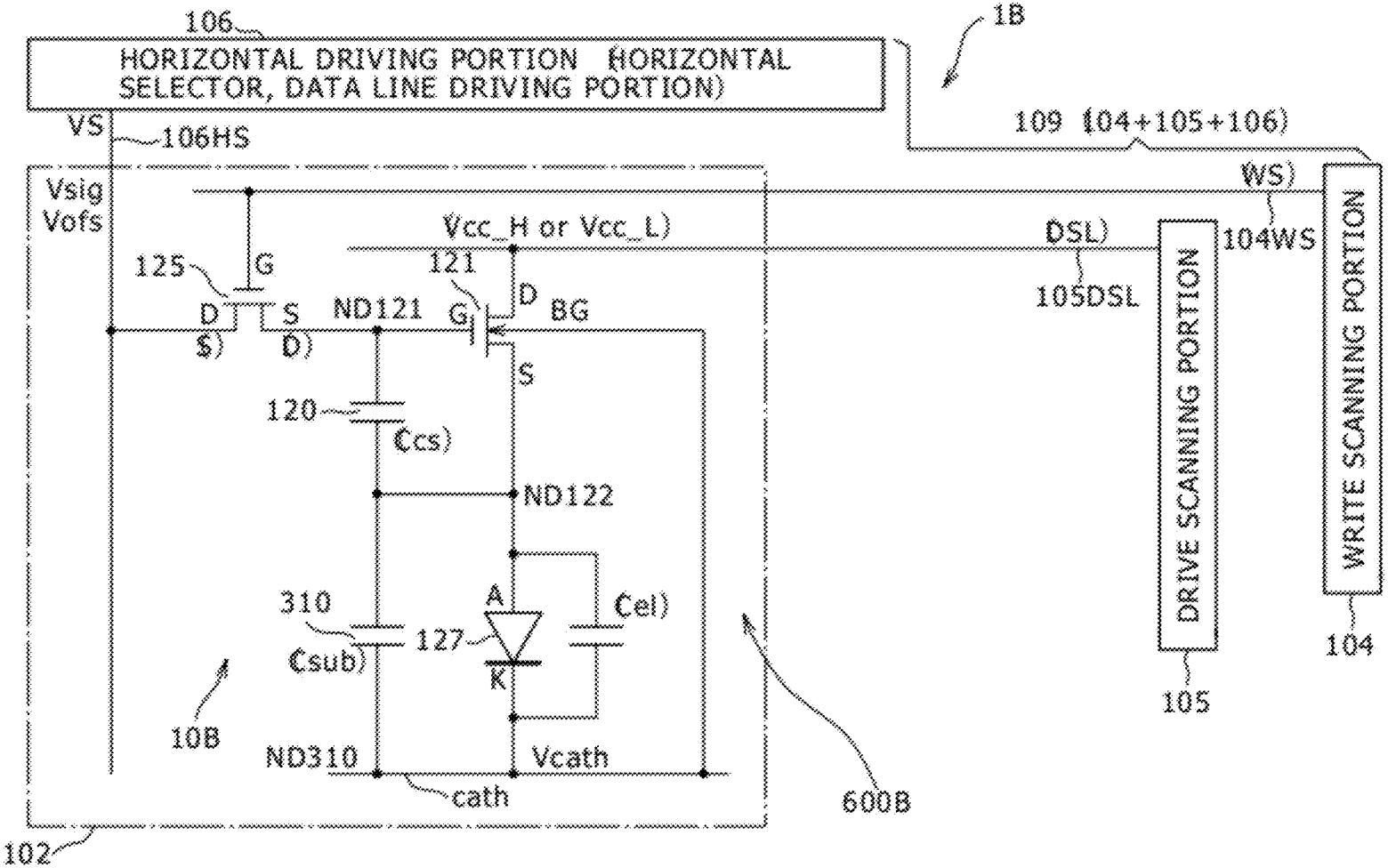
FIG. 12 is a circuit diagram, partly in block, showing a configuration of one form of a pixel circuit in a display device according to Example 2 of the first embodiment of the present disclosure.
Figure 13:
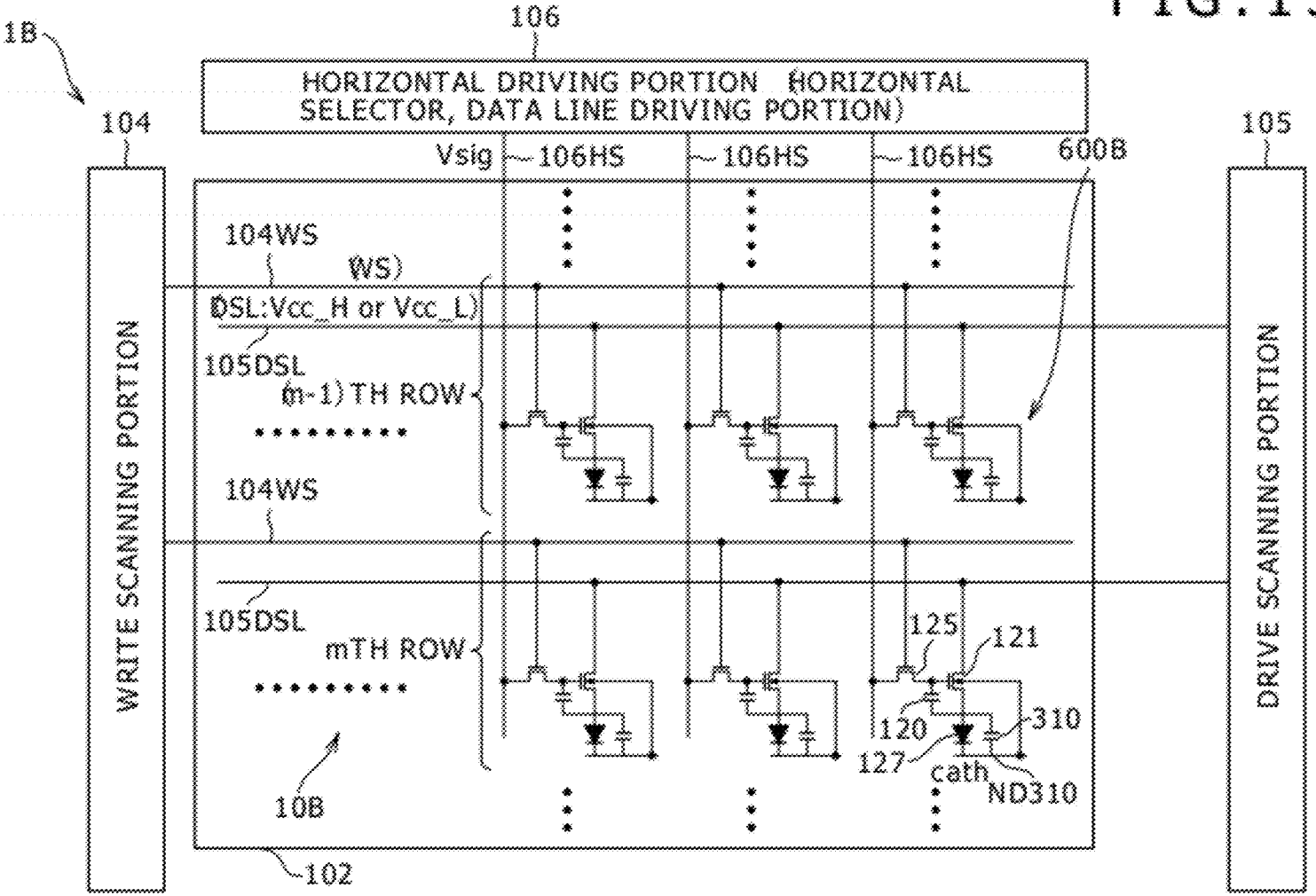
FIG. 13 is a circuit diagram, partly in block, showing a configuration of an entire outline of the display device, including the pixel circuit, of Example 2 of the first embodiment of the present disclosure.
Figure 14:
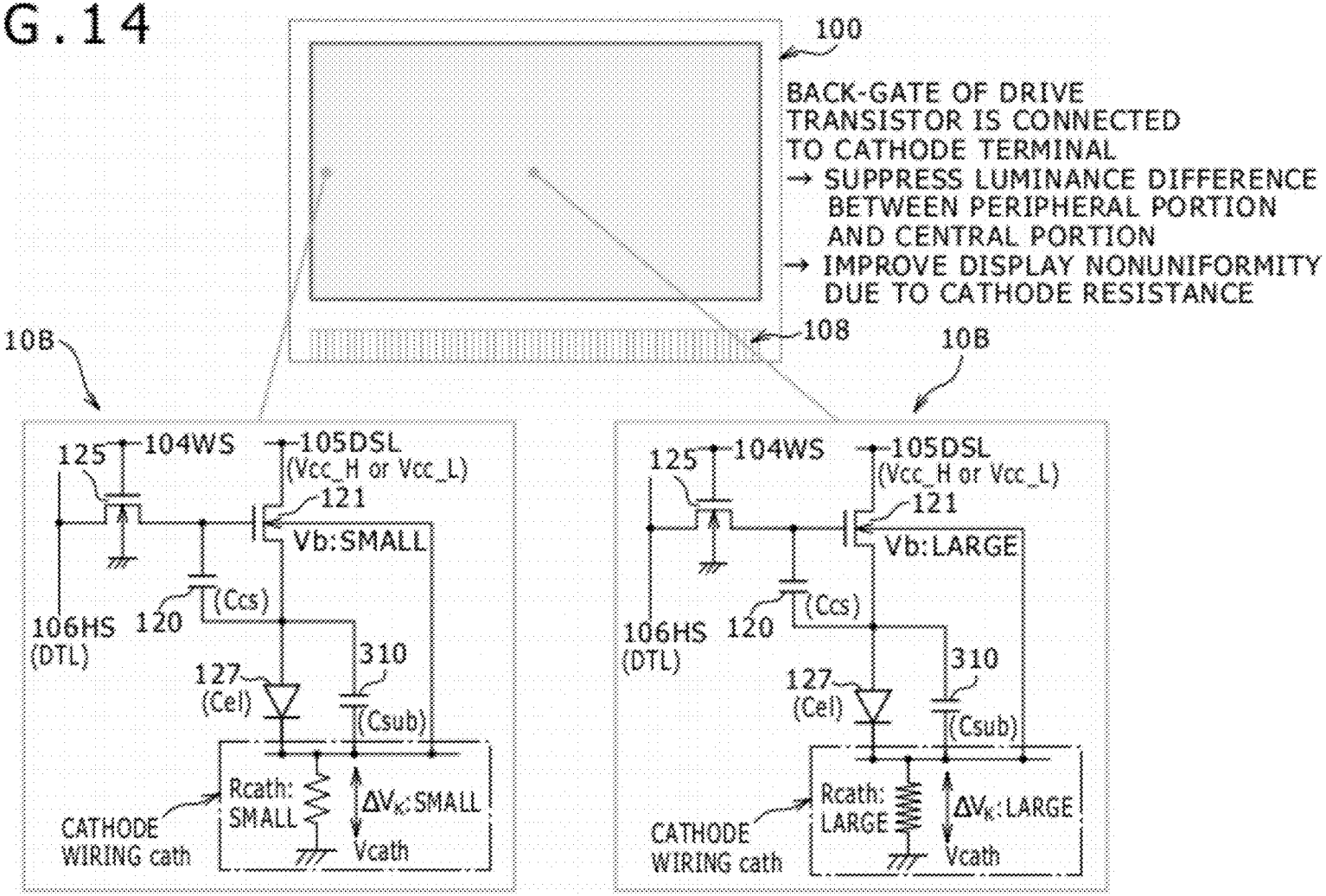
FIG. 14 is a diagram explaining an effect of Example 2.

FIGS. 12 to 14 are respectively diagrams showing one form of a pixel circuit 10B and a display device including the pixel circuit 10B of Example 2 of the first embodiment of the present disclosure. The display device including the pixel circuit 10B in the pixel array portion 102 is referred to as the display device 1B of Example 2. FIG. 12 shows a basic configuration (for one pixel), and FIG. 13 shows a concrete configuration (of the entire display device). Also, FIG. 14 is a diagram explaining an effect of Example 2.

As shown in FIGS. 12 and 13, in Example 2, the transistor characteristics control terminal of the drive transistor 121 is directly connected to the cathode terminal K of the organic EL element 127 every pixel circuit 10B, thereby configuring a transistor characteristics controlling portion 600B. Unlike the transistor characteristics controlling portion 600A in Example 1, both of the transistor characteristics controlling portion 600V and the transistor characteristics controlling portion 600H are unnecessary in Example 2. The reason for this is because the change in the electric potential itself at the cathode terminal can be utilized as the transistor characteristics control signal Vb. That is to say, although the luminance reduction is caused due to the rise in the electric potential at the cathode terminal of the organic EL element 127, when the cathode electric potential itself is used as the transistor characteristics control signal Vb, the transistor characteristics control signal Vb of the drive transistor 121 can be similarly made to rise to shift the threshold voltage $V_{th}$. Also, it is possible to suppress and solve the gradation-like display nonuniformity due to the cathode resistance distribution. In a word, as shown in FIG. 14, the cathode resistance is larger in the panel central portion than in the panel peripheral portion, and as the cathode electric potential becomes higher toward the panel central portion, the transistor characteristics control signal Vb of the drive transistor 121 can be made to rise. Therefore, the more drain current $I_{ds}$ is caused to flow through the panel central portion, thereby making it possible to cancel the reduction in the luminance due to the cathode resistance. Although the change in the cathode electric potential differs depending on the drain current $I_{ds}$, that is, the video signal $V_{sig}$, the transistor characteristics control terminal can be controlled every pixel circuit 10B by reflecting the change in the cathode electric potential as well.

4-3. Example 3

Example 2+Voltage Correction

Figure 15:
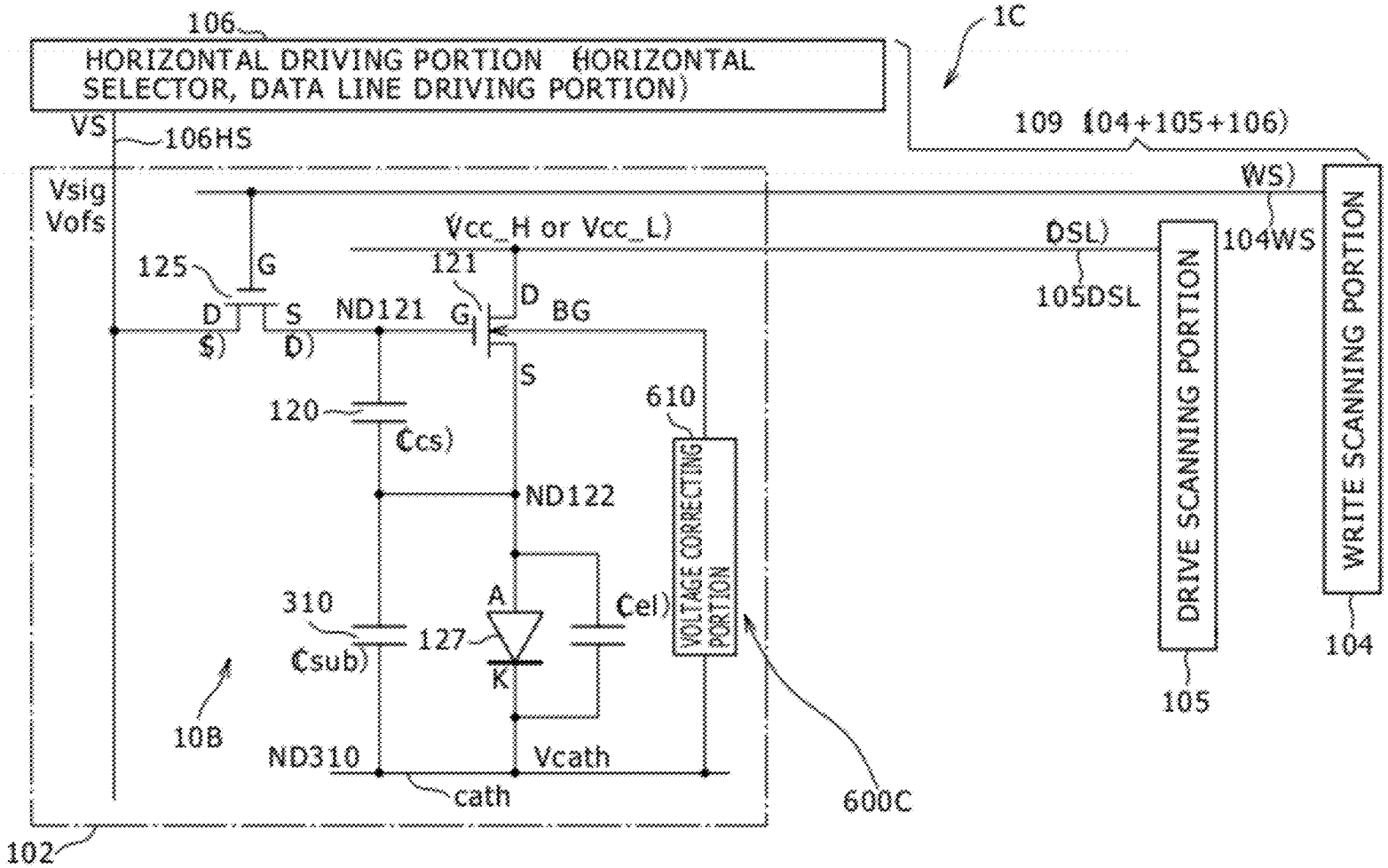
FIG. 15 is a circuit diagram, partly in block, showing a configuration of one form of a pixel circuit in a display device according to Example 3 of the first embodiment of the present disclosure.
Figure 16:
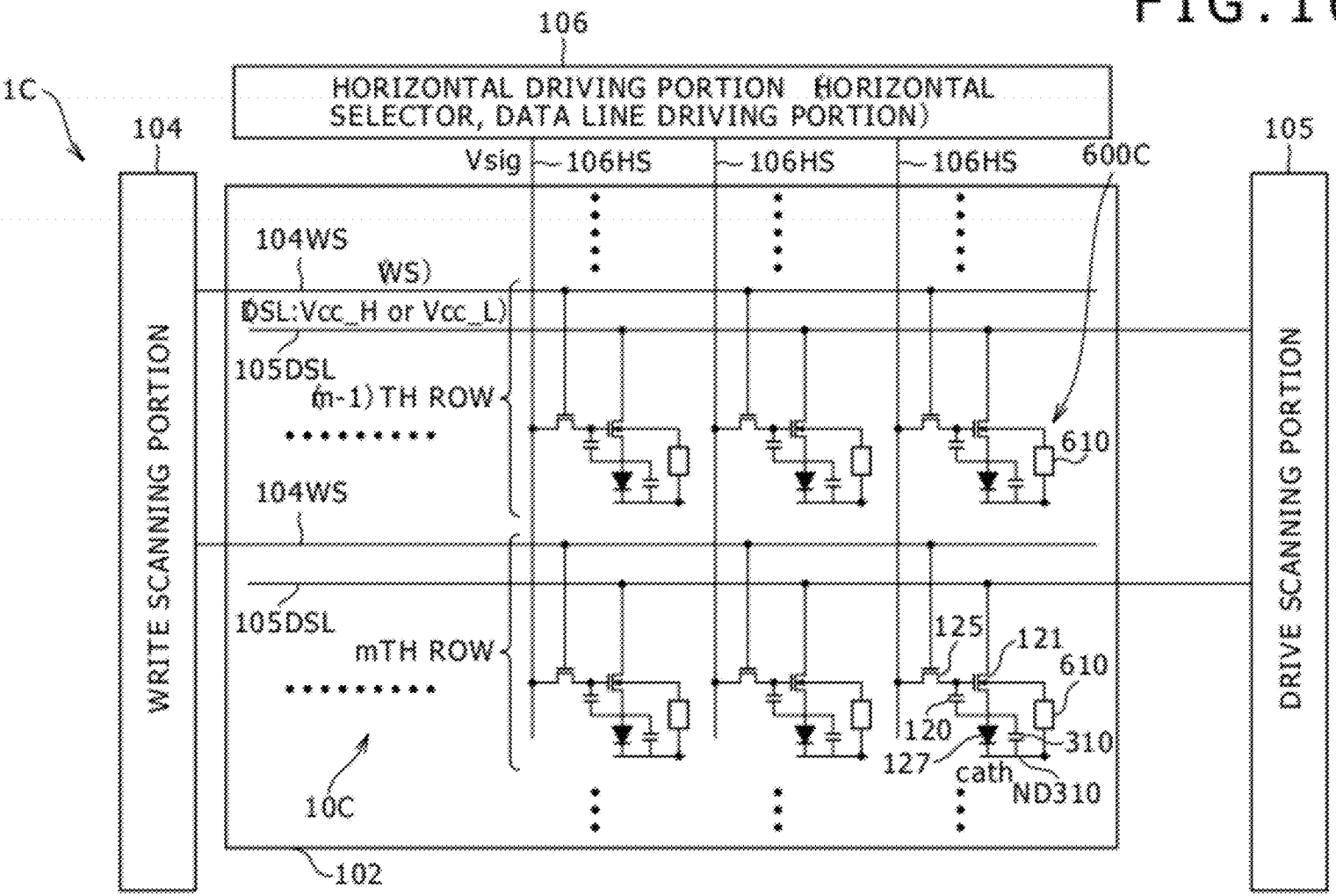
FIG. 16 is a circuit diagram, partly in block, showing a configuration of an entire outline of the display device, including the pixel circuit, of Example 3 of the first embodiment of the present disclosure.

FIGS. 15 and 16 are respectively diagrams showing one form of a pixel circuit 10C and a display device including the pixel circuit 10C of Example 3 of the first embodiment of the present disclosure. The display device including the pixel circuit 10C in the pixel array portion 102 is referred to as the display device 1C of Example 3. FIG. 15 shows a basic configuration (for one pixel), and FIG. 16 shows a concrete configuration (of the entire display device).

As shown in FIGS. 15 and 16, in Example 3, the voltage correcting portion 610 is provided between the transistor characteristics control terminal of the drive transistor 121, and the cathode terminal K of the organic EL element 127 every pixel circuit 10C, thereby configuring a transistor characteristics controlling portion 600C. As far as the voltage correcting portion 610 concerned, it is only necessary to use a suitable non-inversion type amplifying circuit (a gain thereof is by no means limited to one larger than 1, and may be smaller than 1). Although in Example 2, the transistor characteristics control terminal of the drive transistor 121, and the cathode terminal K of the organic EL element 127 are directly connected to each other, in Example 3, the voltage is adjusted by providing the voltage correcting portion 610, whereby the more proper transistor characteristics control signal Vb can be supplied to the transistor characteristics control terminal of the drive transistor 121.

4-4. Example 4

Example 2+Voltage Monitoring

Figure 17:
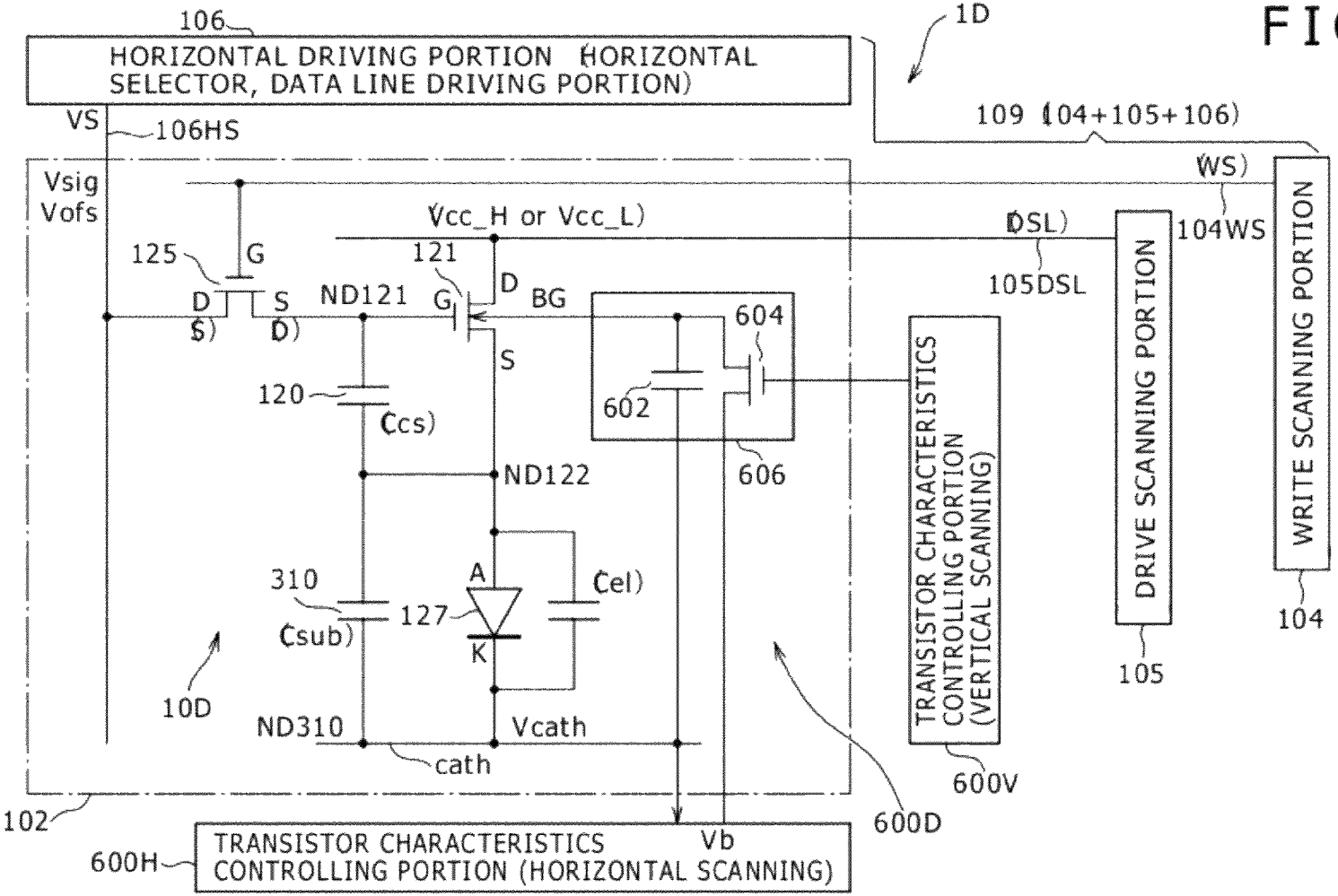
FIG. 17 is a circuit diagram, partly in block, showing a configuration of one form of a pixel circuit in a display device according to Example 4 of the first embodiment of the present disclosure.
Figure 18:
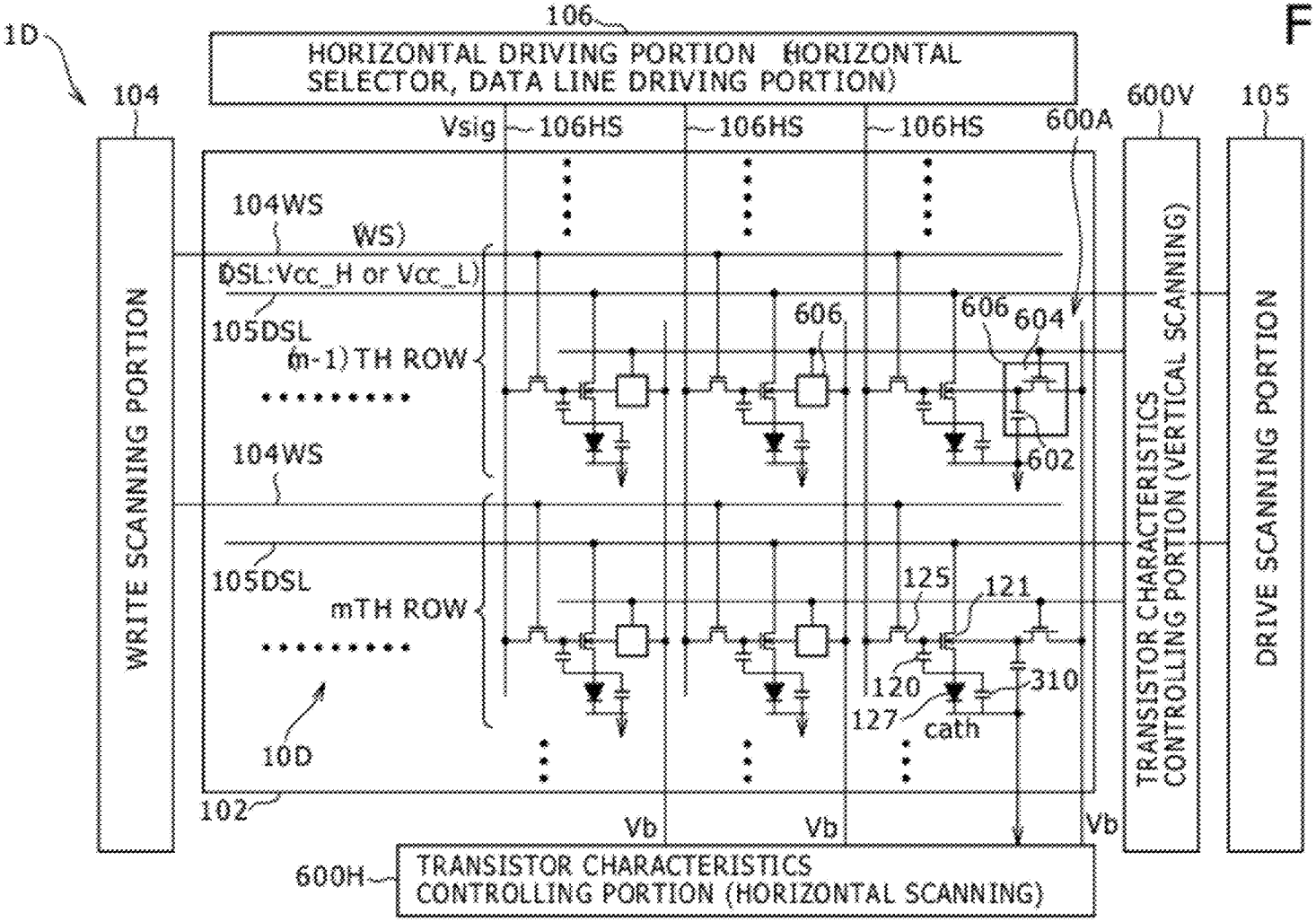
FIG. 18 is a circuit diagram, partly in block, showing a configuration of an entire outline of the display device, including the pixel circuit, of Example 4 of the first embodiment of the present disclosure.

FIGS. 17 and 18 are respectively diagrams showing one form of a pixel circuit 10D and a display device including the pixel circuit 10D of Example 4 of the first embodiment of the present disclosure. The display device including the pixel circuit 10D in the pixel array portion 102 is referred to as the display device 1D of Example 4. FIG. 17 shows a basic configuration (for one pixel), and FIG. 18 shows a concrete configuration (of the entire display device).

As shown in FIGS. 17 and 18, a transistor characteristics controlling portion 600D of Example 4 includes the transistor characteristics controlling portion 600V, the transistor characteristics controlling portion 600H, the hold capacitor 602, and a switching transistor 604 similarly to the case of Example 1. The display device 1D of Example 4 is configured in such a way that a transistor characteristics controlling portion 600H is informed of the electric potential at the cathode terminal K of the organic EL element 127 every pixel circuit 10D with the transistor characteristics controlling portion 600A in Example 1 as a base. The transistor characteristics controlling portion 600H refers (monitors) the electric potential at the cathode terminal K of each of the organic EL elements 127 to set the transistor characteristics control signal Vb, whereby the more proper transistor characteristics control signal Vb can be supplied to the transistor characteristics control terminal of the drive transistor 121. Similarly to the case of Example 2, although the change in the cathode electric potential differs depending on the drain current $I_{ds}$, that is, the video signal $V_{sig}$, the transistor characteristics control terminal can be controlled every pixel circuit 10D by reflecting the differing of the change in the cathode electric potential.

However, since it is necessary to provide a wiring through which the transistor characteristics controlling portion 600H is informed of the electric potential at the cathode terminal K of the organic EL element 127, there is caused a drawback that the configuration of the pixel array portion 102 becomes complicated. In order to solve this drawback, it is only necessary to adopt a configuration in which the transistor characteristics controlling portion 600H is not informed of the electric potential at the cathode terminal K of the organic EL element 127 with respect to all of the pixel circuits 10D, but the transistor characteristics controlling portion 600H is informed of the electric potential at the cathode terminal K of the organic EL element 127 with respect to the pixel circuits 10D selected through the suitable thinning-out (for example, with respect to only the pixel circuits 10D in the peripheral portion (for example, in the vicinity of the side edge or in the vicinity of the vertex), and the pixel circuits 10D in the central portion). In addition, in the case of the color display, it is also only necessary to adopt a configuration in which the transistor characteristics controlling portion 600H is informed of the electric potential at the cathode terminal K of the organic EL element 127 every one unit of the color display (for example, composed of a red color light emission pixel circuit $\mathbf{10}__R$ for emitting a red light, a green color light emission pixel circuit $\mathbf{10}__G$ for emitting a green light, and a blue color light emission pixel circuit $\mathbf{10}__B$ for emitting a blue light).

Comparison Among Example 1 to Example 4

Here, when Example 1 to Example 4 are compared with one another, the display device 1B of Example 2 has the simplest configuration and the display device 1D of Example 4 has the configuration with which the most proper transistor characteristics control signal Vb can be supplied.

5. Examples of Application

FIG. 19 to FIGS. 23A to 23C are respectively views explaining Examples of Application in each of which the display device according to the first embodiment of the present disclosure is applied to the electronic apparatus according to the fourth embodiment of the present disclosure. Specifically, FIG. 19 to FIGS. 23A to 23C show respectively cases of electronic apparatuses each loaded with the display device to which the technique for suppressing and solving the gradation-like display nonuniformity due to the cathode resistance distribution described above is applied. The display nonuniformity suppressing processing in the display device of the first embodiment can be applied to a display device including a current drive type display element used in various kinds of electric apparatuses such as a game machine, an electronic book, an electronic dictionary, and a mobile phone.

5-1. Example 1 of Application

Figure 19:
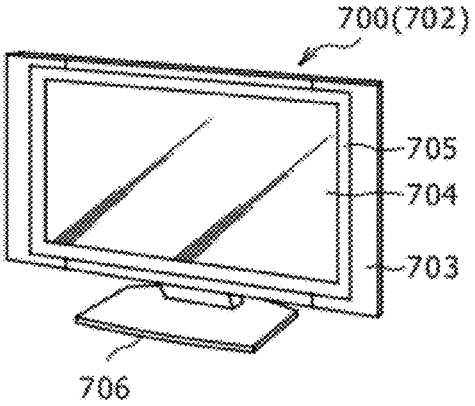
FIG. 19 is a perspective view showing an external appearance of a television receiver as Example 1 of Application to which the display device shown in FIG. 1 of the first embodiment is applied.

For example, FIG. 19 is a perspective view showing an external appearance of a television receiver 702, as Example 1 of Application, in which an electronic apparatus 700 utilizes a display module 704 as an example of a display device. The television receiver 702 has a construction in which the display module 704 is disposed on a front surface of a front panel 703 supposed by a base 706. Also, a filter glass 705 is provided on a display surface. In this case, the display module 704 is manufactured by using the display device 1 according to the first embodiment of the present disclosure.

5-2. Example 2 of Application

Figure 20:
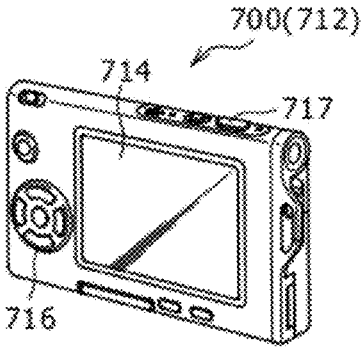
FIG. 20 is a perspective view showing an external appearance of a digital camera as Example 2 of Application, when viewed from a back side, to which the display device shown in FIG. 1 of the first embodiment is applied.

FIG. 20 is a perspective view showing an external appearance of a digital camera, as Example 2 of Application, when the electronic apparatus 700 is a digital camera 712. The digital camera 712 includes a display module 714, a control switch 716, a shutter button 717, and others. In this case, the display module 714 is manufactured by using the display device 1 according to the first embodiment of the present disclosure.

5-3. Example 3 of Application

Figure 21:
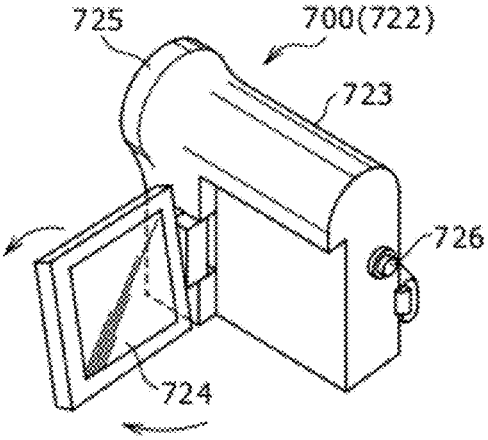
FIG. 21 is a perspective view showing an external appearance of a video camera as Example 3 of Application to which the display device shown in FIG. 1 of the first embodiment is applied.

FIG. 21 is a perspective view showing an external appearance of a video camera, as Example 3 of Application, when the electronic apparatus 700 is a video camera 722. The video camera 722 includes an image capturing lens 725 for capturing an image of a subject in front of a main body 723. In addition, a display module 724, a start/stop switch 726 which is manufactured when an image of a subject is captured, and the like are disposed in the video camera 722. In this case, the display module 724 is manufactured by using the display device 1 according to the first embodiment of the present disclosure.

5-4. Example 4 of Application

Figure 22:
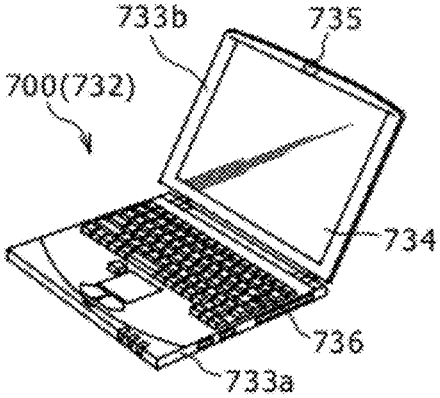
FIG. 22 is a perspective view showing an external appearance of a computer as Example 4 of Application to which the display device shown in FIG. 1 of the first embodiment is applied.

FIG. 22 is a perspective view showing an external appearance of a computer, as Example 4 of Application, when the electronic apparatus 700 is a computer 732. The computer 732 includes a lower side chassis 733*a*, an upper side chassis 733*b*, a display module 734, a Web camera 735, a keyboard 736, and the like. In this case, the display module 734 is manufactured by using the display device 1 according to the first embodiment of the present disclosure.

5-5. Example 5 of Application

Figures 23A, 23B, 23C:
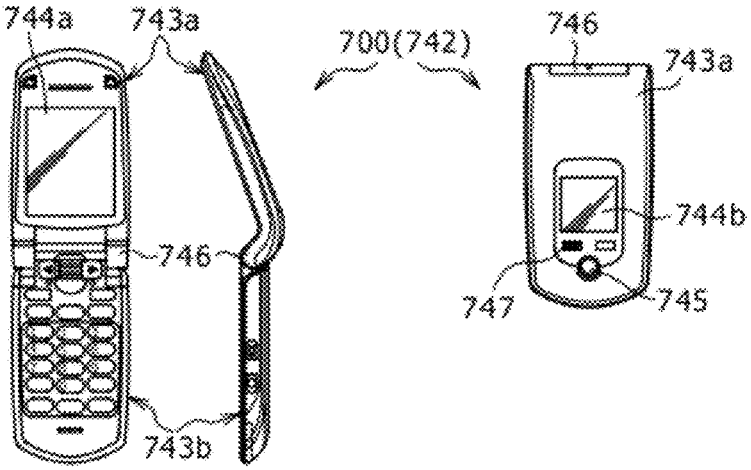
FIGS. 23A, 23B, and 23C are respectively a front view of a mobile phone as Example 5 of Application, in an open state, to which the display device shown in FIG. 1 of the first embodiment is applied, a side elevational view thereof in the open state, and a front view thereof in a close state.

FIGS. 23A, 23B, and 23C are respectively a front view of a mobile phone as Example 5 of Application, in an open state, in which the electronic apparatus 700 is a mobile phone 742, a side elevational view thereof in the open state, and a front view thereof in a close state. The mobile phone 742 is foldable and includes an upper side chassis 743*a*, a lower side chassis 743*b*, a display module 744*a*, a sub display portion 744*b*, a camera 745, a coupling portion 746 (a hinge portion in this case), a picture light 747, and the like. In this case, the display module portion 744*a* and/or the sub display portion 744*b* is manufactured by using the display device 1 according to the first embodiment of the present disclosure.

As a result, in each of the electronic apparatus 700 in Example 1 of Application to Example 5 of Application, not only the dispersion of the luminances due to the dispersion of the threshold voltages and the mobilities (and the dispersion of k) of the drive transistors can be corrected, but also the gradation-like display nonuniformity due to the cathode resistance distribution can be suppressed and solved independently of the change in the environment (for example, the temperature and the humidity). As a result, it is possible to display the high-quality image.

Although the technique disclosed in this specification has been described so far based on the embodiments, Examples, and the like, the technical scope of the contents described in the appended claims is by no means limited to the scope of the description of the embodiments, Examples, and the like. Various kinds of changes and improvements can be made in the embodiments described above without departing from the subject matter of the technique disclosed in this specification, and the modes in which such changes and improvements are made are also contained in the technique disclosed in this specification. The embodiments described above do not limit the technique according to the appended claims and all of combinations of the features explained in the embodiments described above are not necessarily essential to the means for solving the problems that the technique disclosed in this specification is to solve. Various stages of techniques are contained in the embodiments described above and the various kinds of techniques can be extracted based on suitable combinations in plural constituent requirements shown in the embodiments described above. Even when some constituent requirements are deleted from all of the constituent requirements shown in the embodiments described above, the constitutions obtained by deleting some constituent requirements from all of the constituent requirements can also be extracted as the techniques described in this specification as long as the effect corresponding to the problems that the technique disclosed in this specification is to solve can be offered.

For example, it goes without saying that a complementary configuration can be adopted in which for the transistors, the n-channel and the p-channel are replaced with each other, the polarities of the power source and the signals are reversed in accordance with the replacement of the conductivity type, and so forth.

6. Constitutions of the Present Disclosure

In the light of the description of the embodiments, the techniques according to claims disclosed in the scope of the appended claims are merely an example and, for example, the following techniques will be extracted as the constitutions of the present disclosure. Hereinafter, the constitutions of the present disclosure will be listed up as follows.

(1)

A pixel circuit including: a display portion; a drive transistor driving the display portion; and a characteristics controlling portion configured to control characteristics of the drive transistor.

(2)

The pixel circuit described in the paragraph (1), wherein the characteristics controlling portion controls the characteristics of the drive transistor in accordance with an electric potential at one end of the display portion on a side opposite to the drive transistor.

(3)

The pixel circuit described in the paragraph (1) or (2), wherein the drive transistor has a characteristics control terminal through which a threshold voltage is adapted to be controlled; and the characteristics controlling portion supplies a control signal in accordance with which the threshold voltage is controlled to the characteristics control terminal.

(4)

The pixel circuit described in any one of the paragraphs (1) to (3), wherein the drive transistor is a metal oxide field-effect transistor.

(5)

The pixel circuit described in any one of the paragraphs (1) to (3), wherein the drive transistor is a back-gate thin film transistor; and the characteristics controlling portion is a terminal through which a back-gate electric potential is controlled.

(6)

The pixel circuit described in the paragraph (4) or (5), wherein the characteristics controlling portion is configured by connecting one terminal of the display portion, and a back-gate of the drive transistor to each other.

(7)

The pixel circuit described in any one of the paragraphs (1) to (6), further including a pixel portion in which the display portions are disposed, wherein the characteristics controlling portion controls the characteristics of the drive transistor every display portion.

(8)

The pixel circuit described in the paragraph (7), wherein the display portions are disposed in two-dimensional matrix in the pixel portion.

(9)

The pixel circuit described in any one of the paragraphs (1) to (6), further including a pixel portion in which display elements each including a display portion and a driving portion are disposed in a two-dimensional matrix, wherein the characteristics controlling portion controls the characteristics of the drive transistor every display element through scanning processing.

(10)

The pixel circuit described in any one of the paragraphs (1) to (9), wherein the display portion is of a self-emission type.

(11)

The pixel circuit described in the paragraph (10), wherein the display portion includes an electro-luminescence light emitting portion.

(12)

A display device including: a pixel portion in which display elements each including a display portion and a drive transistor driving the display portion are arranged; and a characteristics controlling portion configured to control characteristics of the drive transistor.

(13)

The display device described in the paragraph (12), wherein the characteristics controlling portion controls the characteristics of the drive transistor in accordance with an electric potential at one end of the display portion on a side opposite to the drive transistor.

(14)

The display device described in the paragraph (12) or (13), wherein the drive transistor has a characteristics control terminal through which a threshold voltage is adapted to be controlled; and the characteristics controlling portion supplies a control signal in accordance with which the threshold voltage is controlled to the characteristics control terminal.

(15)

An electronic apparatus including: a pixel portion in which display elements each including a display portion and a drive transistor driving said display portion are arranged; a signal generating portion configured to generate a video signal which is to be supplied to the pixel portion; and a characteristics controlling portion configured to control characteristics of the drive transistor.

(16)

The electronic apparatus described in the paragraph (15), wherein the characteristics controlling portion controls the characteristics of the drive transistor in accordance with an electric potential at one end of the display portion on a side opposite to the drive transistor.

(17)

The electronic apparatus described in the paragraph (15) or (16), wherein the drive transistor has a characteristics control terminal through which a threshold voltage is adapted to be controlled; and the characteristics controlling portion supplies a control signal in accordance with which the threshold voltage is controlled to the characteristics control terminal.

(18)

A method of driving a pixel circuit including a drive transistor driving a display portion, including: controlling characteristics of the drive transistor.

(19)

The method of driving a pixel circuit described in the paragraph (18), wherein characteristics of the drive transistor is controlled in accordance with an electric potential at one end of the display portion on a side opposite to the drive transistor.

(20)

The method of driving a pixel circuit described in the paragraph (18) or (19), wherein the drive transistor has a characteristics control terminal through which a threshold voltage is adapted to be controlled; and a control signal in accordance with which the threshold voltage is controlled is supplied to the characteristics control terminal.

The present disclosure contains subject matter related to that disclosed in Japanese Priority Patent Application JP 2011-138255 filed in the Japan Patent Office on Jun. 22, 2011, the entire content of which is hereby incorporated by reference.

What is claimed is:

1. A display device comprising:

a plurality of pixel circuits arranged in a display region, each of the plurality of pixel circuits including a light emitting element and a drive transistor that drives the light emitting element; and a transistor characteristics controlling portion that variably adjusts a threshold voltage of the drive transistor of each of the plurality of pixel circuits, wherein, for each of the plurality of pixel circuits, a first current terminal of the drive transistor is connected to a first power supply wiring, a second current terminal of the drive transistor is connected to a first electrode of the light emitting element, and a second electrode of the light emitting element is connected to a second power supply wiring, and the transistor characteristics controlling portion variably adjusts the threshold voltages of the drive transistors based on a spatial distribution of resistances of the second power supply wirings, wherein the drive transistor of each of the plurality of pixel circuits includes a characteristic-control terminal such that the threshold voltage of the drive transistor depends on a potential supplied to the characteristic-control terminal thereof, the transistor characteristics controlling portion variably adjusts the threshold voltages of the drive transistors based on the spatial distribution of resistances of the second power supply wirings by, for each of the plurality of pixel circuits, supplying to the characteristic-control terminal of the drive transistor a potential corresponding to a potential of the second electrode of the light emitting element, and for each of the plurality of pixel circuits, the characteristic-control terminal of the drive transistor is directly electrically connected to the second electrode of the light emitting element.

2. The display device of claim, 1 wherein for each of the plurality of pixel circuits the drive transistor is a metal oxide field-effect transistor.

3. The display device of claim, 1 wherein for each of the plurality of pixel circuits the drive transistor is a back-gate thin film transistor;

the transistor characteristics controlling portion variably adjusts the threshold voltages of the drive transistors by controlling a back-gate electric potential of the drive transistors.

4. An electronic apparatus comprising the display device of claim 1.

5. The electronic apparatus of claim 4, wherein for each of the plurality of pixel circuits the drive transistor is a metal oxide field-effect transistor.

6. The electronic apparatus of claim 5, wherein for each of the plurality of pixel circuits the drive transistor is a back-gate thin film transistor, and wherein the transistor characteristics controlling portion variably adjusts the threshold voltages of the drive transistors by controlling a back-gate electric potential of the drive transistors.

* * * * *